US009504303B2

(12) United States Patent
Viscomi

(10) Patent No.: US 9,504,303 B2
(45) Date of Patent: Nov. 29, 2016

(54) HYGIENIC COSMETIC APPLICATOR

(71) Applicant: Brian David Viscomi, Easton, PA (US)

(72) Inventor: Brian David Viscomi, Easton, PA (US)

( * ) Notice: Subject to any disclaimer, the term of this patent is extended or adjusted under 35 U.S.C. 154(b) by 76 days.

(21) Appl. No.: 14/529,198

(22) Filed: Oct. 31, 2014

(65) Prior Publication Data

US 2016/0120289 A1 May 5, 2016

(51) Int. Cl.

*A45D 40/26* (2006.01)
*A45D 33/00* (2006.01)
*A45D 40/24* (2006.01)

(52) U.S. Cl.

CPC ..... *A45D 33/006* (2013.01); *A45D 40/26* (2013.01); *A45D 40/24* (2013.01); *A45D 2200/1018* (2013.01); *A45D 2200/25* (2013.01)

(58) Field of Classification Search

CPC ..... A45D 40/26; A45D 2200/10; A45D 2200/1009; A45D 2200/1018; A45D 2200/1045; A61M 5/178; A61C 3/005; A61C 5/064; B25G 3/08; B25G 3/00; A46B 5/0095

See application file for complete search history.

(56) References Cited

U.S. PATENT DOCUMENTS 5,240,339 A * 8/1993 DeForest ..... A45D 34/04 15/144.2
5,242,433 A * 9/1993 Smith ..... A61K 8/0208 401/132
5,254,109 A * 10/1993 Smith ..... A61F 15/001 401/132
5,368,581 A * 11/1994 Smith ..... A61K 8/0208 206/210
5,568,669 A * 10/1996 Godown ..... A45D 34/04 132/320
6,336,241 B1 * 1/2002 Wilson ..... A47L 13/12 15/144.2
8,015,653 B2 * 9/2011 Bargiel ..... A45D 34/04 15/104.94
9,079,003 B1 * 7/2015 Hoogerwerf ..... A46B 11/0003
2001/0034920 A1 * 11/2001 Brown ..... A47K 7/028 15/244.1
2004/0071494 A1 * 4/2004 Staniforth ..... A61M 35/003 401/262
2005/0055787 A1 * 3/2005 Blum ..... A47K 11/10 15/104.94
2007/0227552 A1 * 10/2007 Abergel ..... A45D 34/041 132/294
2008/0132830 A1 * 6/2008 Hague ..... A61J 7/003 604/36
2008/0267689 A1 * 10/2008 Soller ..... A47L 1/15 401/264
2009/0017080 A1 * 1/2009 Tanner ..... A61K 8/19 424/401
2009/0093743 A1 * 4/2009 Corzine ..... A47K 7/028 601/136
2012/0012126 A1 * 1/2012 Arrington ..... A61M 35/003 132/200

* cited by examiner

*Primary Examiner* — Robyn Doan

(57) ABSTRACT

A hygienic cosmetic applicator system comprising an instrument-like gripping body (2) that has a holder on at least one end to releasably grip single use applicator (12) tips. The gripping body (2) has a handle (4) for grasping with the fingers, a tapered shaft (6) emerging from at least one end, and a apertured holder that is terminally formed onto or into a shafts (6) tapered end. A holder may comprise a ringlet (8) with a centrally formed aperture (10) that is formed onto the shafts (6) tapered end, or alternatively, a suitably deep aperture (10) that is formed into the shafts (6) tapered end. By contrast, an applicator (12) has a shaft-like inserting member (14) to frictionally plug into an aperture (10) and furthermore, a terminally formed base (6) on its non-inserting end for holding an applicating member therein or thereon.

9 Claims, 53 Drawing Sheets

HYGIENIC COSMETIC APPLICATOR

CROSS REFERENCES TO RELATED APPLICATION

This application claims the benefit of provisional Application Ser. Nos. 61/897,841 filed 2013 Oct. 31; 61/927,429 filed 2014 Jan. 14; 61/950,170 filed 2014 Mar. 9, by the present inventor

FEDERALLY SPONSORED RESEARCH

Not applicable

SEQUENCE LISTING OR PROGRAM

Not applicable

BACKGROUND OF INVENTION

This invention applies to the area cosmetology specifically to the application of cosmetics to dermal tissues in a hygienic fashion to preclude cross contamination of microorganisms when sampling or applying a given cosmetic.

BACKGROUND

Prior Art

The field of cosmetology encompasses a myriad powders, creams, and glosses in a variety of shades and hues for application to dermal tissues. This allows the user to select the shade (s) most suitable to one's complexion and facial components. Typically, the user will use a swatch or a handled brush for application whether it is at a cosmetic counter or one's home. More often than not, the selection process narrows the range between two or more shades. In addition, there may be the inclination to select a shade combination that is contrary to the customary shade preferences of the user, or even to try a recently introduced medium. To arrive at a decision requires one to alternatively select from an array of shade samples. The HYGIENIC COSMETIC APPLICATOR presents as a palettes to contain an array of cosmetic shades from which to choose from. To avoid shade contamination between samples, it is desirable to employ a fresh, uncontaminated applicator to properly sample the individual shade specimens. Also, microbial cross contamination from multiple users employing the same applicator can give rise to the potential for dermal infections among users. In particular are Staphylococcal and Streptococcal organisms which contribute to many skin infections and are readily transferrable. Additionally, one may desire to employ a fresh applicator even if habitually using the same shade. The HYGIENIC COSMETIC APPLICATOR therefore allows for the commercial hygienic sampling of a cosmetic to permit shade selection without cross contamination from person to person

OBJECTS AND ADVANTAGES

Accordingly, several advantages of the present patent application HYGIENIC COSMETIC APPLICATOR are:

(a) Permits hygienic application of a cosmetic onto a dermal surface (b) Aids in preventing microbial cross-contamination between users (c) Prevents cross-contamination between cosmetic samples (d) Accompanying palette presents an array of shades to facilitate sampling (e) May be preloaded with cosmetic for convenience (f) Vastly reduces material waste (g) Minimalist design is economical versus conventional disposables (h) Permits vast array of applicator types using a cohesive format (i) Medical style gripping system affords precise handling and dexterity

SUMMARY OF THE INVENTION

A hygienic cosmetic applicator system comprising an instrument-like gripping body that has a holder on at least one end to releasably grip single use cosmetic applicator tips. The gripping body has a handle for grasping with fingers, a tapered shaft emerging from at least one end, and an apertured holder that is terminally formed onto or onto a shaft's tapered end. A holder may comprise a ringlet with a centrally formed aperture that is formed onto the shaft's tapered end, or alternatively, a suitably deep aperture that is formed within the shafts tapered end. By contrast, an applicator has a shaft-like inserting member to frictionally plug into an aperture and furthermore, a terminally formed base on its non-inserting end for holding an applicating member therein or thereon.

Accordingly, an operator can hygienically apply a cosmetic material on a per person basis by first conjoining an applicator's inserting member end into the gripping body's aperture holder and then, apply a desired uncontaminated cosmetic material using the applicating member's end, and then disposing of the used applicator into a suitable receptacle.

DRAWINGS

Figures

Figure 5A:
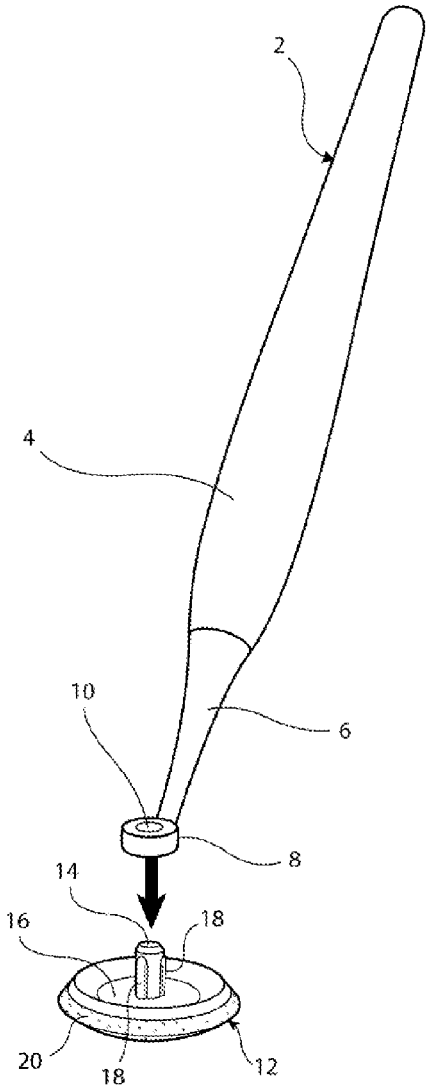
Figure 5B:
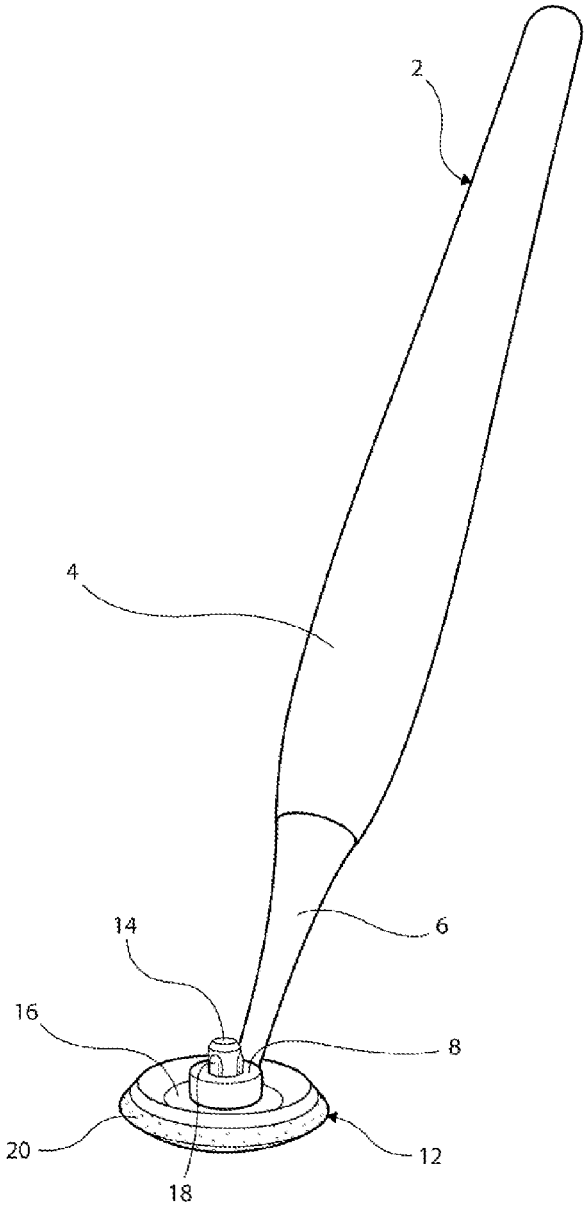

FIGS. 5A and 5B sequentially depict a gripping body's ringlet holder inserting onto an applicators inserting member.

Figure 6A:
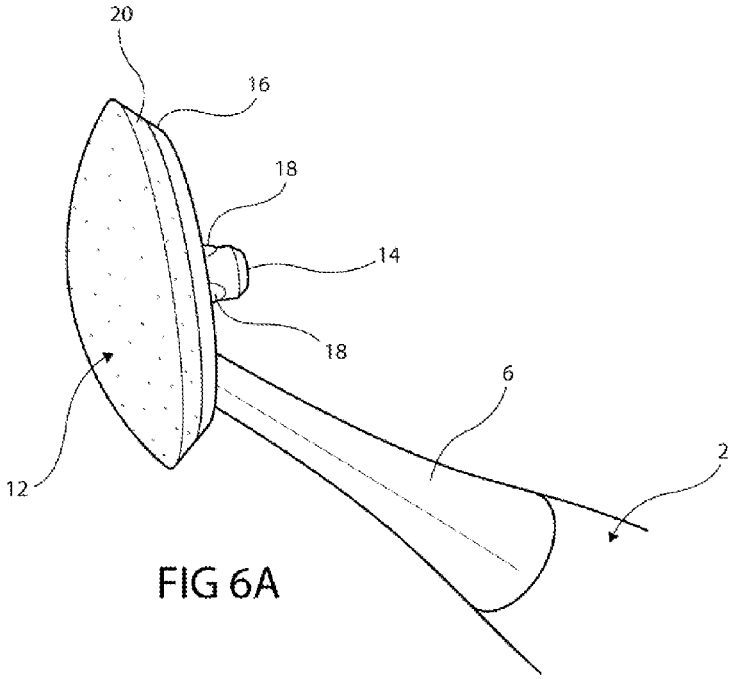
Figure 6B:
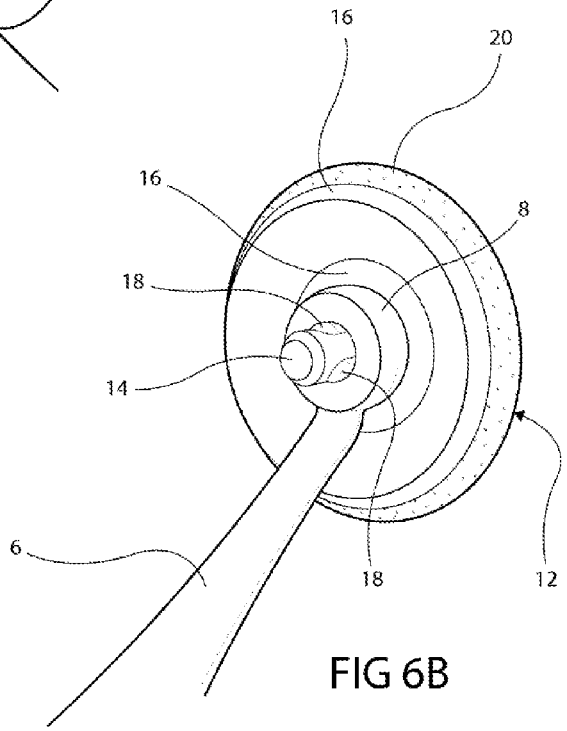

FIGS. 6A and 6B show frontal and rear side views of an applicator that is operably conjoined with a gripping body's ringlet.

Figure 7:
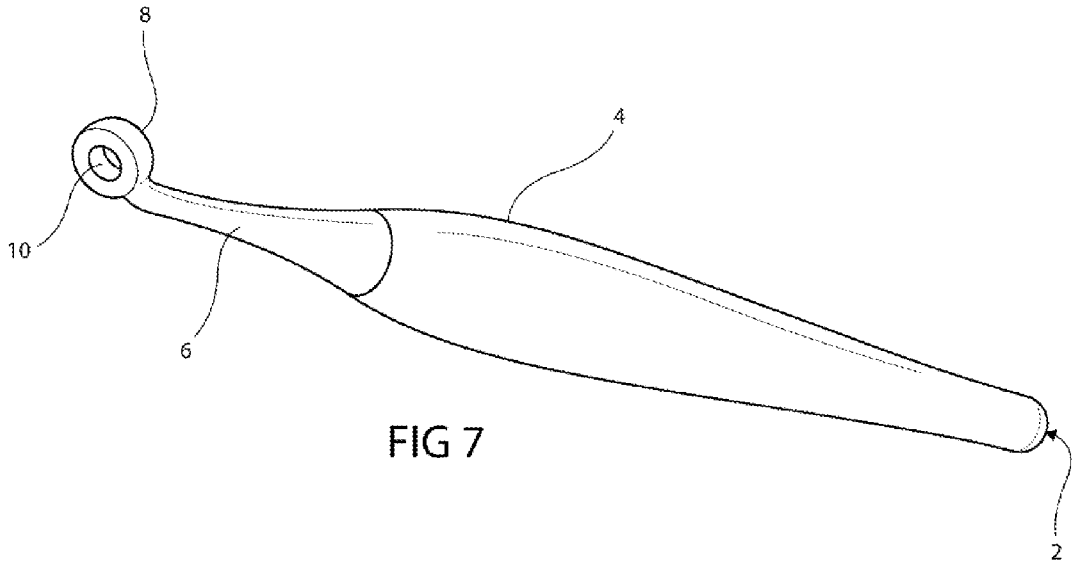

FIG. 7 shows a frontal dimensional view of a gripping body to reveal its tapered shaft portion.

Figure 8:
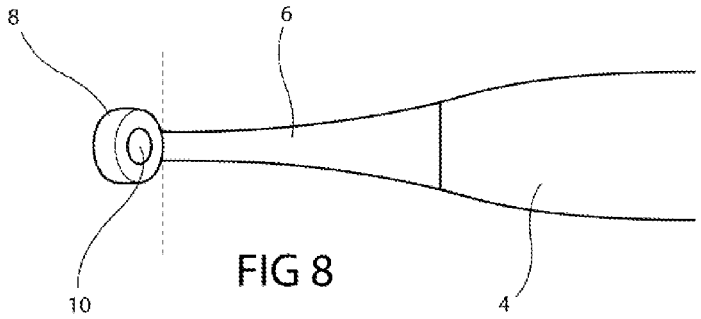

FIG. 8 shows a top view of a shaft that has been attached or bonded onto a handle.

Figure 9:
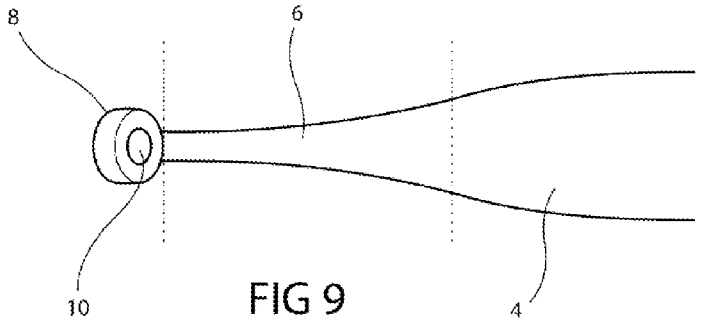

FIG. 9 shows a top view of a shaft that is formed as an integral part of the handle.

Figure 10:
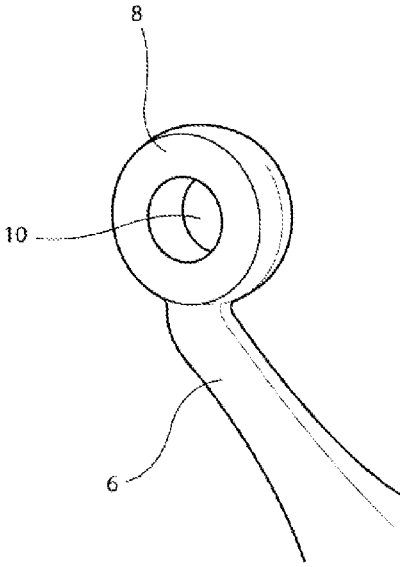

FIG. 10 shows a dimensional view of a gripping body's ringlet holder.

Figure 11:
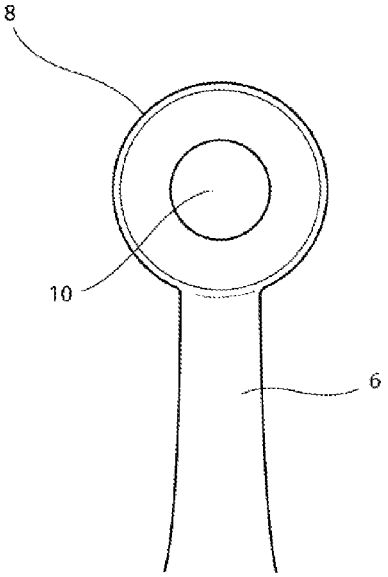

FIG. 11 shows a front view of a ringlet to reveal its centrally formed aperture.

Figure 12:
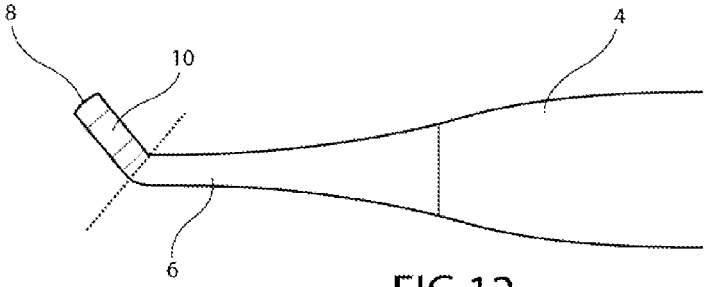

FIG. 12 shows the side view of a ringlet that is angled at about fifty degrees at its juncture with the tapered shaft's end.

Figure 13:
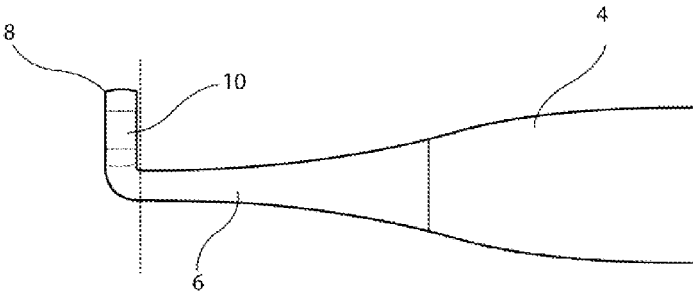

FIG. 13 shows the side view of a ringlet that is angled at about ninety degrees at its juncture with the tapered shaft's end.

Figure 14A:
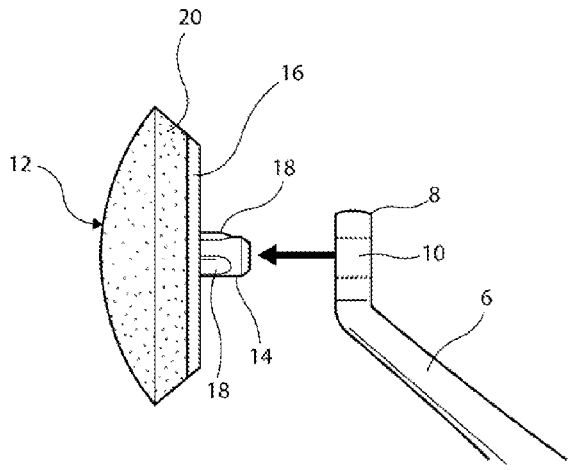

FIG. 14A shows the side view of a convexly shaped applicator before it is inserted into a ringlet that is angled at about fifty degrees.

Figure 14B:
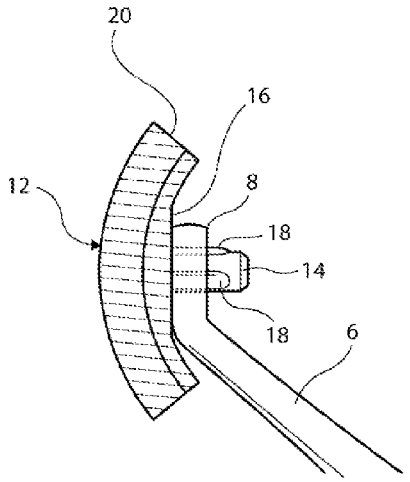

FIG. 14B shows a cutaway side view of the applicator after it is inserted into a ringlet.

Figure 15A:
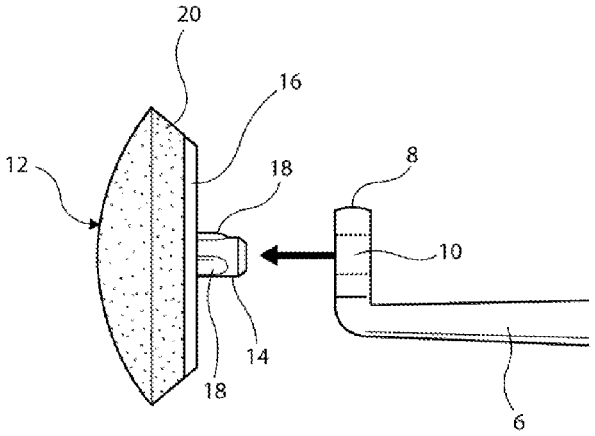
Figure 15B:
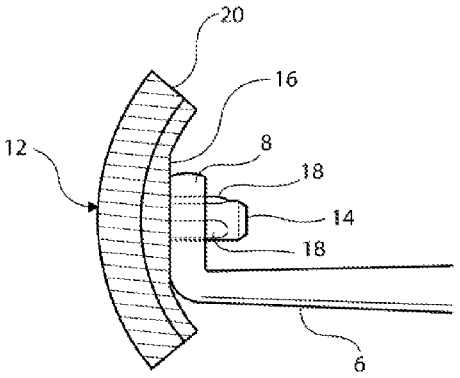

FIG. 15A shows the side view of a convexly shaped applicator before it is inserted into a ringlet that is angled at about ninety degrees FIG. 15B shows a cutaway side view of the applicator after it is inserted into a ringlet.

Figure 16:
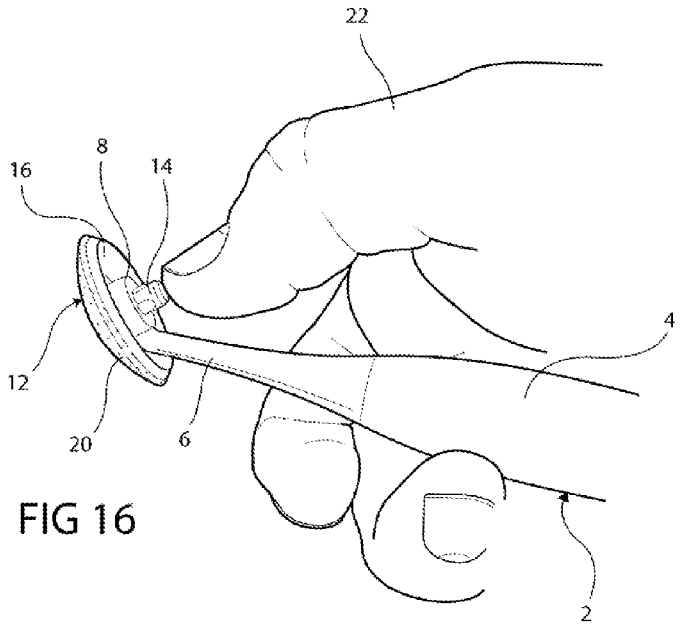

FIG. 16 shows an operator holding a gripping body by its handle while simultaneously placing a thumb onto an applicator's exposed inserting member end.

Figure 17:
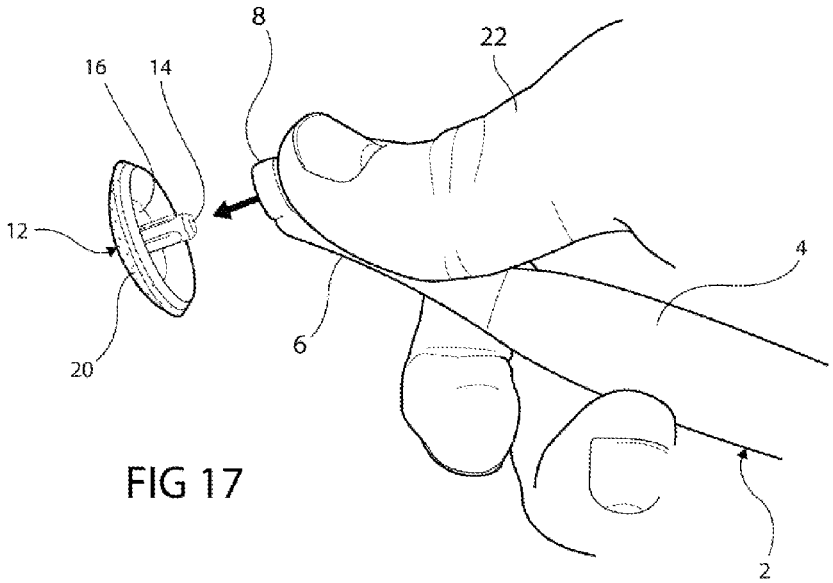

FIG. 17 shows an operator pressing on the inserting member's end to expel the cosmetic applicator from the ringlet.

Figure 18:
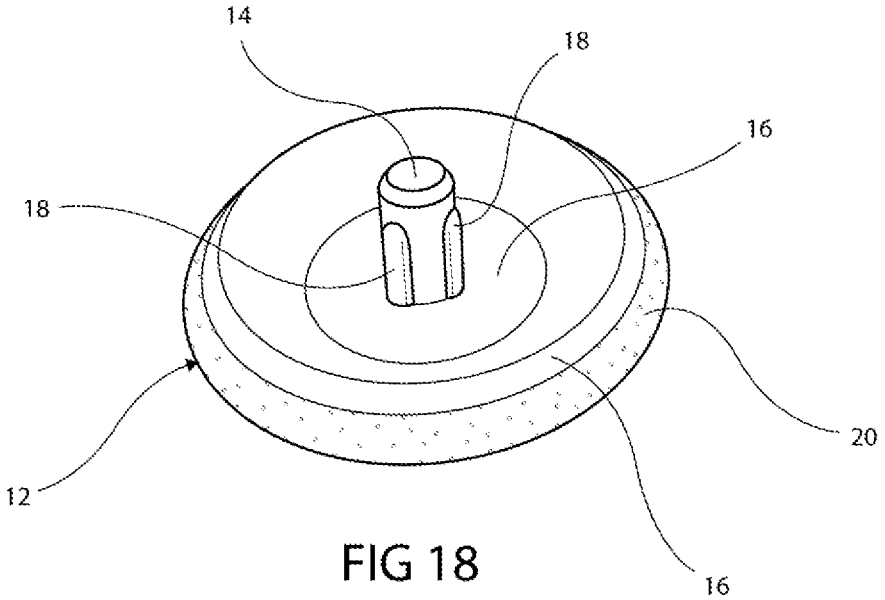

FIG. 18 shows a dimensional underside view of an applicator that reveals the inserting member's origin within the base's flattened center.

Figure 19:
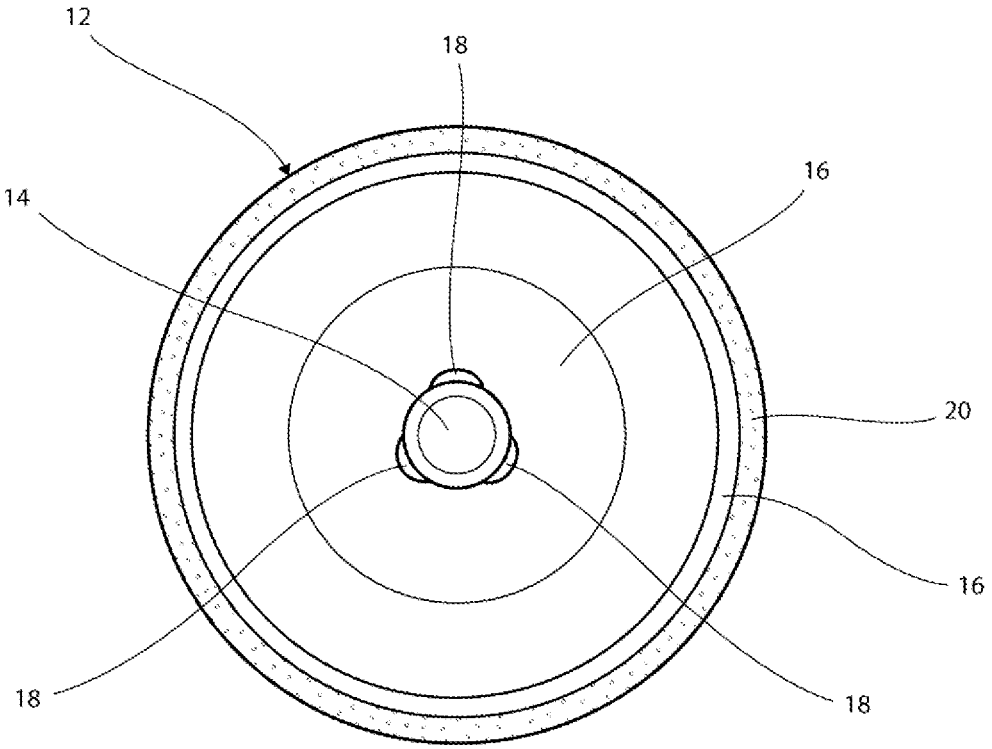

FIG. 19 shows a plan view that reveals the inserting member's circumferentially formed fluted extrusions.

Figure 20:
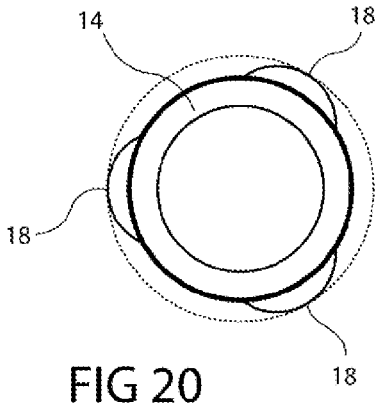

FIG. 20 shows a dotted line encircling an inserting members fluted extrusions to reveal how they intermittently increase its thickness.

Figure 21:
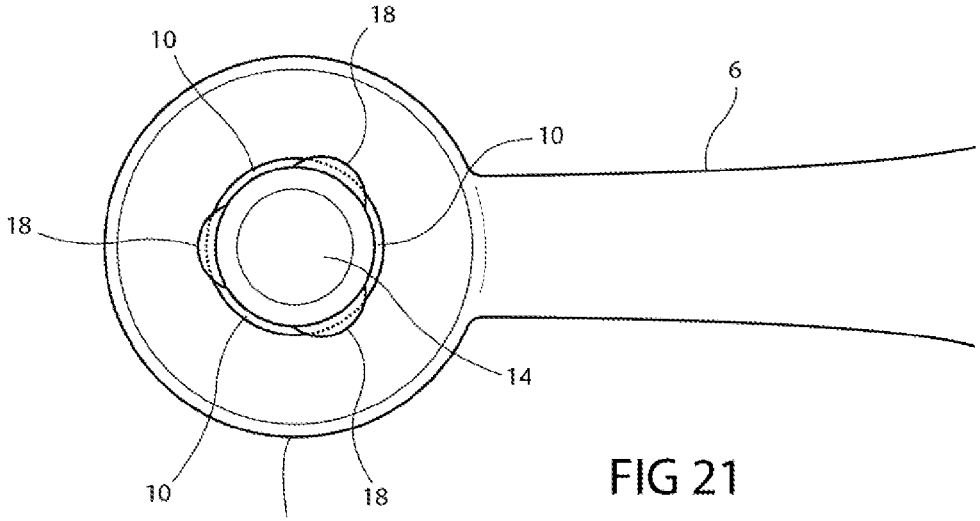

FIG. 21 shows a plan view of an applicator's fluted inserting member prior to its insertion into a ringlet's aperture.

Figure 22:
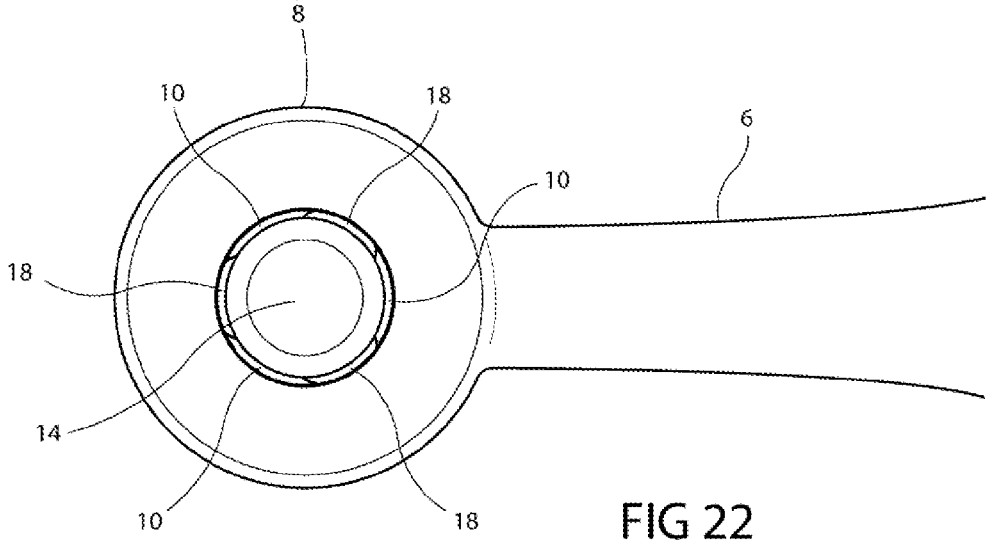

FIG. 22 shows a plan view of the applicator's fluted inserting member after it has been inserted into a ringlet's aperture.

Figure 23A:
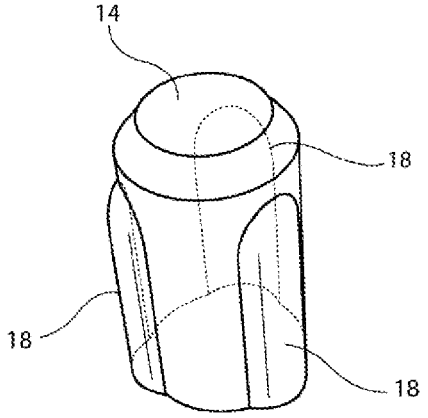

FIG. 23A shows a dimensional view of an inserting member that has three fluted extrusions formed around its circumference.

Figure 23B:
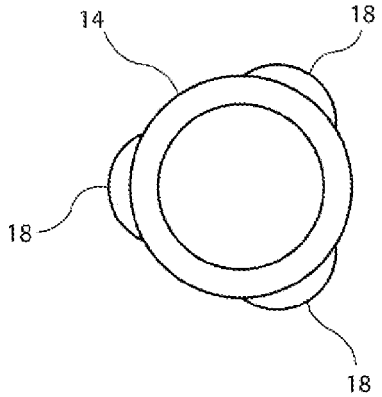

FIG. 23B shows a plan view of an inserting member that has three fluted extrusions formed around its circumference.

Figure 24A:
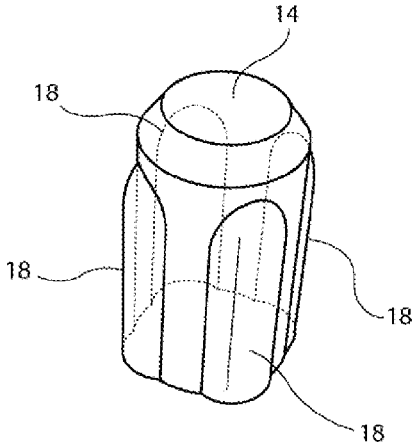

FIG. 24A shows a dimensional view of an inserting member that has four fluted extrusions formed around its circumference.

Figure 24B:
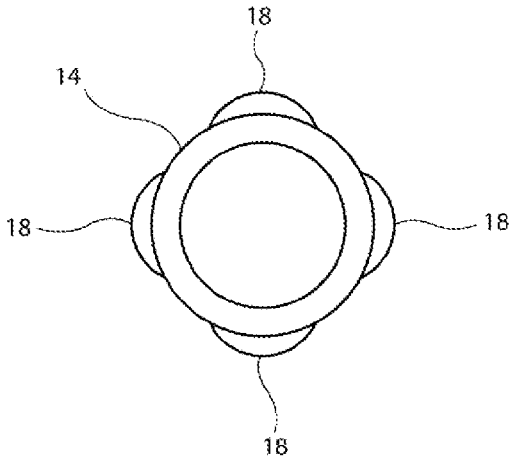

FIG. 24B shows a topside view of an inserting member that has four fluted extrusions formed around its circumference.

Figure 25:
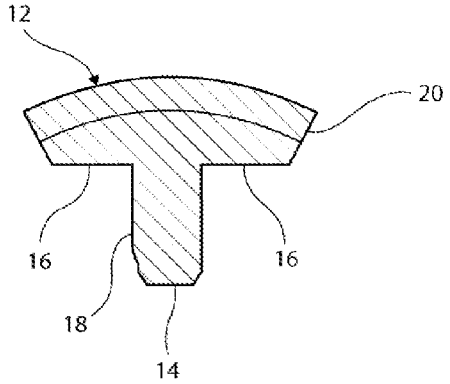

FIG. 25 shows the cross section of an applicator having a base with convex topside and a wholly flat underside.

Figure 26:
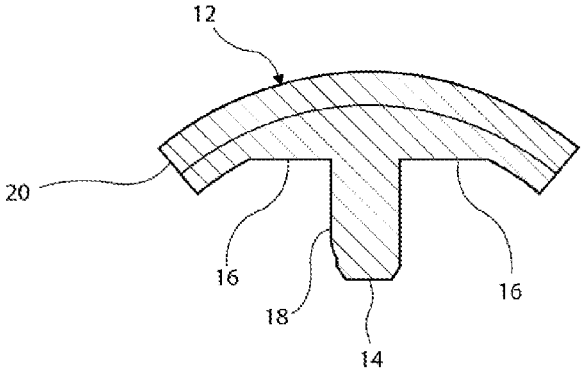

FIG. 26 shows a cross section of an applicator having a base with a convex topside and a generally concave underside with a flattened center area.

Figure 27:
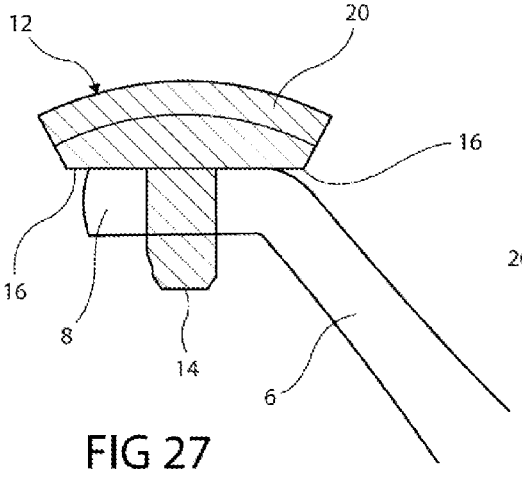

FIG. 27 shows a ringlet conjoined to the cross section of an applicator with a wholly flat underside.

Figure 28:
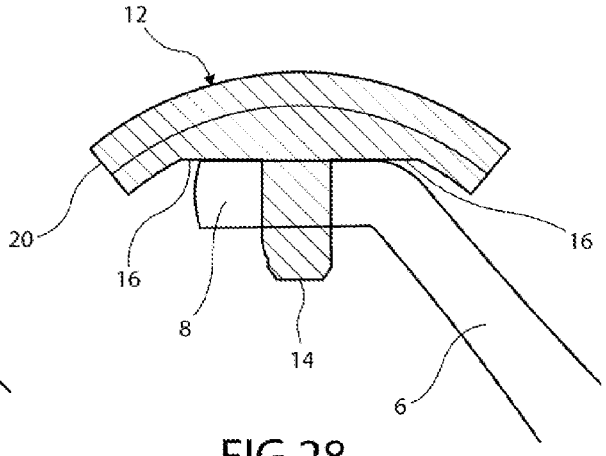

FIG. 28 shows a ringlet conjoined to the cross section of an applicator having a generally concave underside with a flattened center area.

Figure 29:
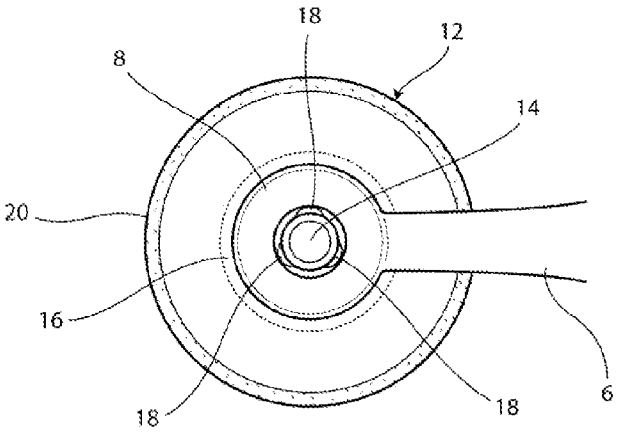

FIG. 29 shows a plan view that relates a ringlet's width to an applicators flat base underside, and the base's underside area is indicated by a dotted circle.

Figure 30:
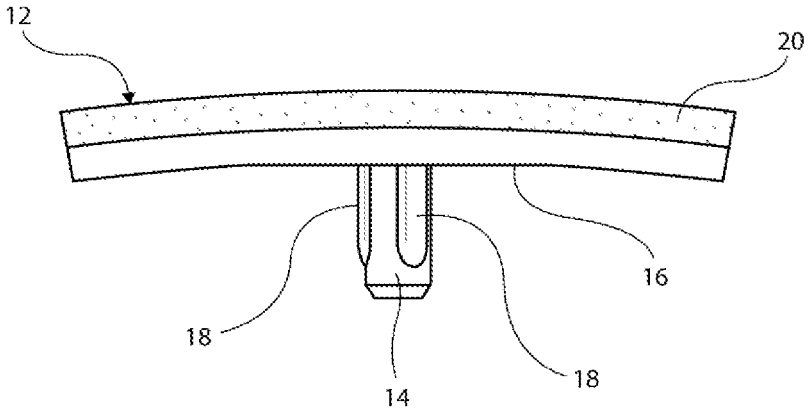

FIG. 30 shows the profile of an applicator having a minimally convex base shape.

Figure 31:
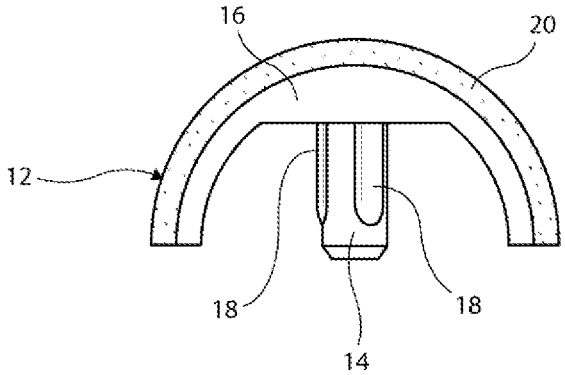

FIG. 31 shows the profile of an applicator having a substantially hemispherical base shape.

Figure 32:
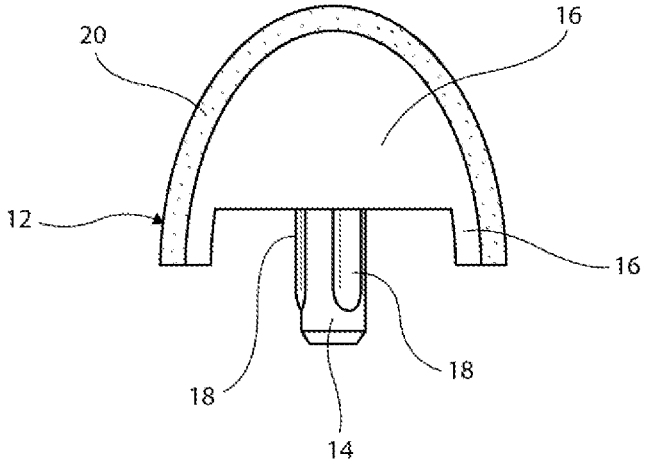

FIG. 32 shows the profile of an applicator having a substantially ovoid base shape.

Figure 33A:
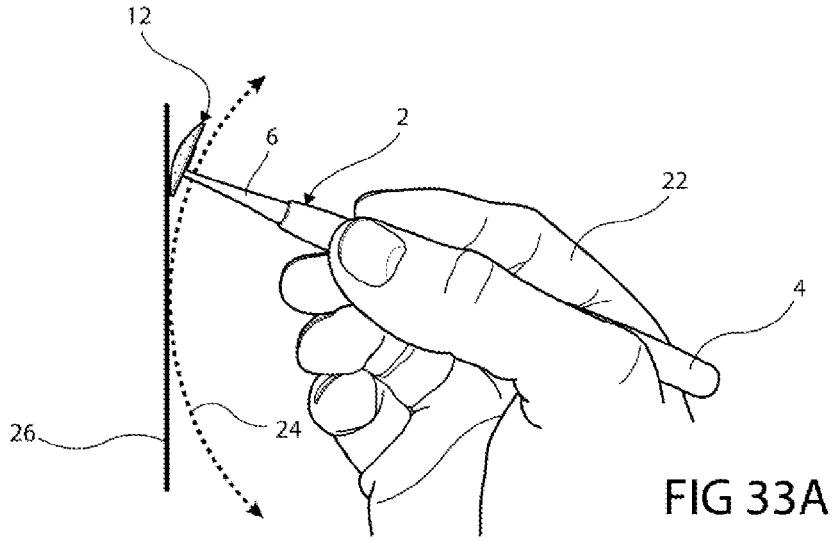
Figure 33B:
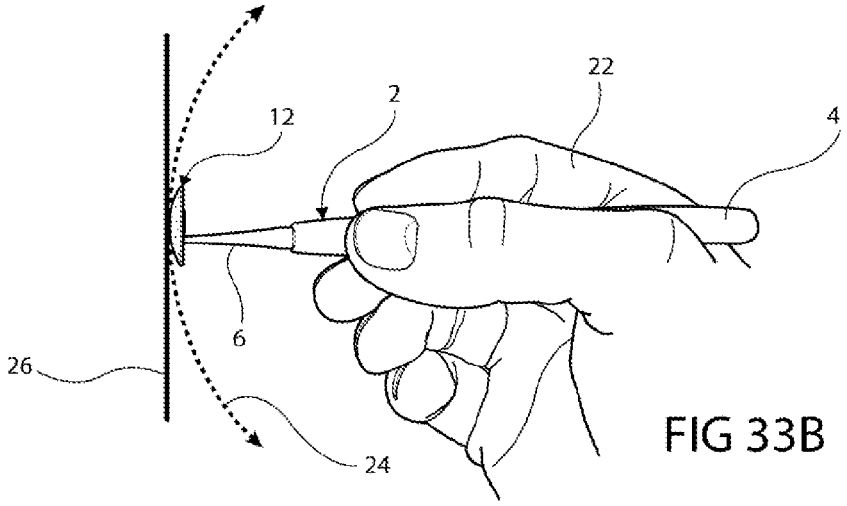
Figure 33C:
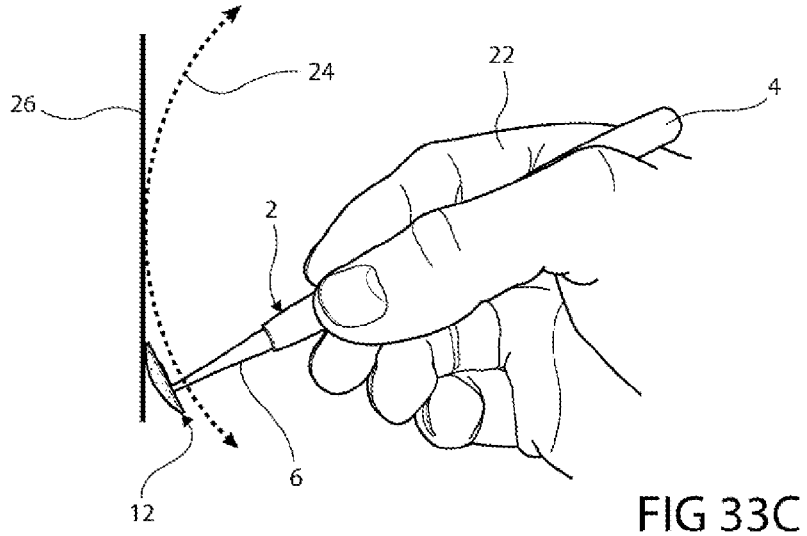

FIGS. 33A to 33C show a sequence that depicts how a convexly shaped applicator maintains contact with a surface during a radial brushing motion.

Figure 34:
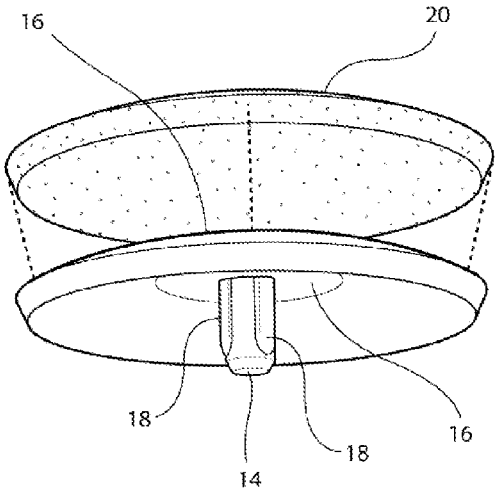

FIG. 34 is a dimensional underside view that depicts the applicator's applicating member detached from its saucer-like base.

Figure 35:
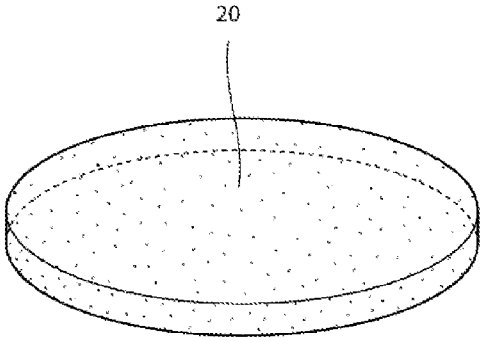

FIG. 35 shows a preferred applicating member shape that is generally cylindrical and is made from foam.

Figure 36:
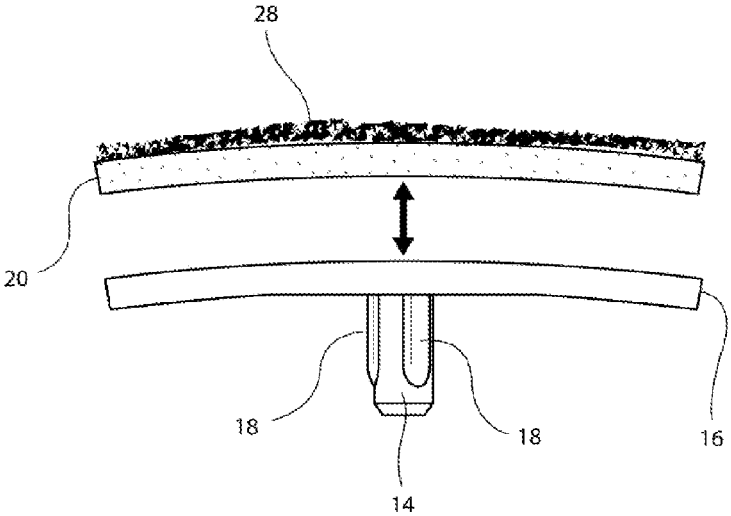

FIG. 36 is a profile view that reveals an applicating member's first side to bond with a saucer-like base and second side to hold a cosmetic material.

Figure 37:
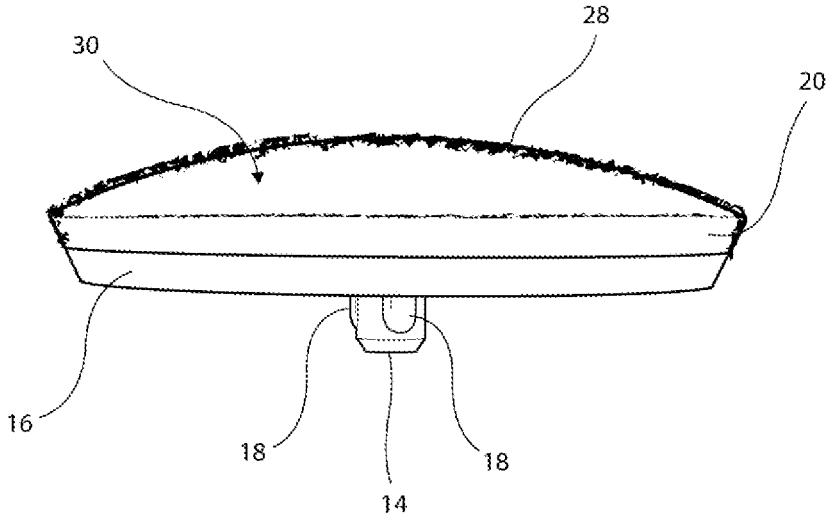

FIG. 37 shows an applicator that has been preloaded with a cosmetic material during manufacture.

Figure 38:
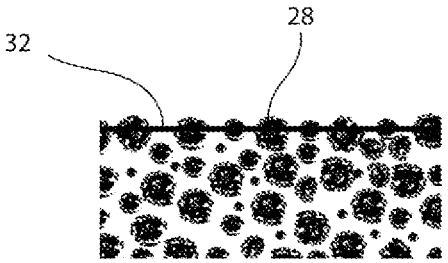

FIG. 38 shows a cellular detail view of an open cell foam applicating member having a cosmetic material pre-loaded into its open cells.

Figure 39:
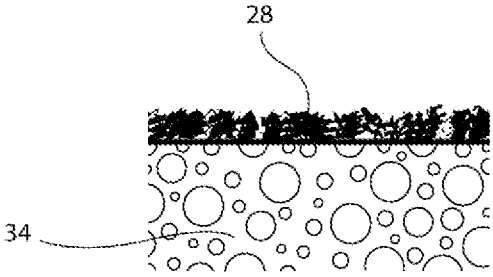

FIG. 39 shows a cellular detail view of a closed cell foam applicating member having a cosmetic material pre-loaded onto its exterior.

Figure 40A:
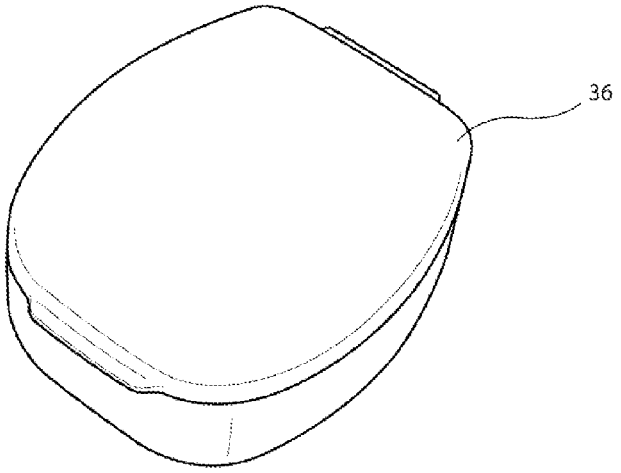
Figure 40B:
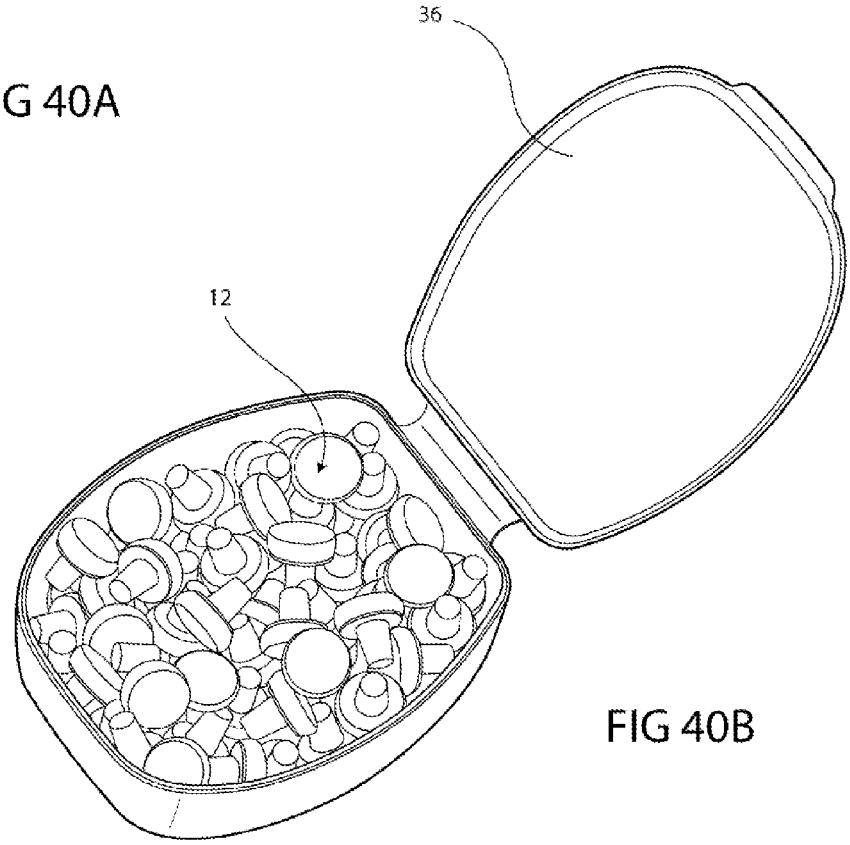

FIGS. 40A and 40B depicts a format for packaging applicator tips into a container.

Figure 41:
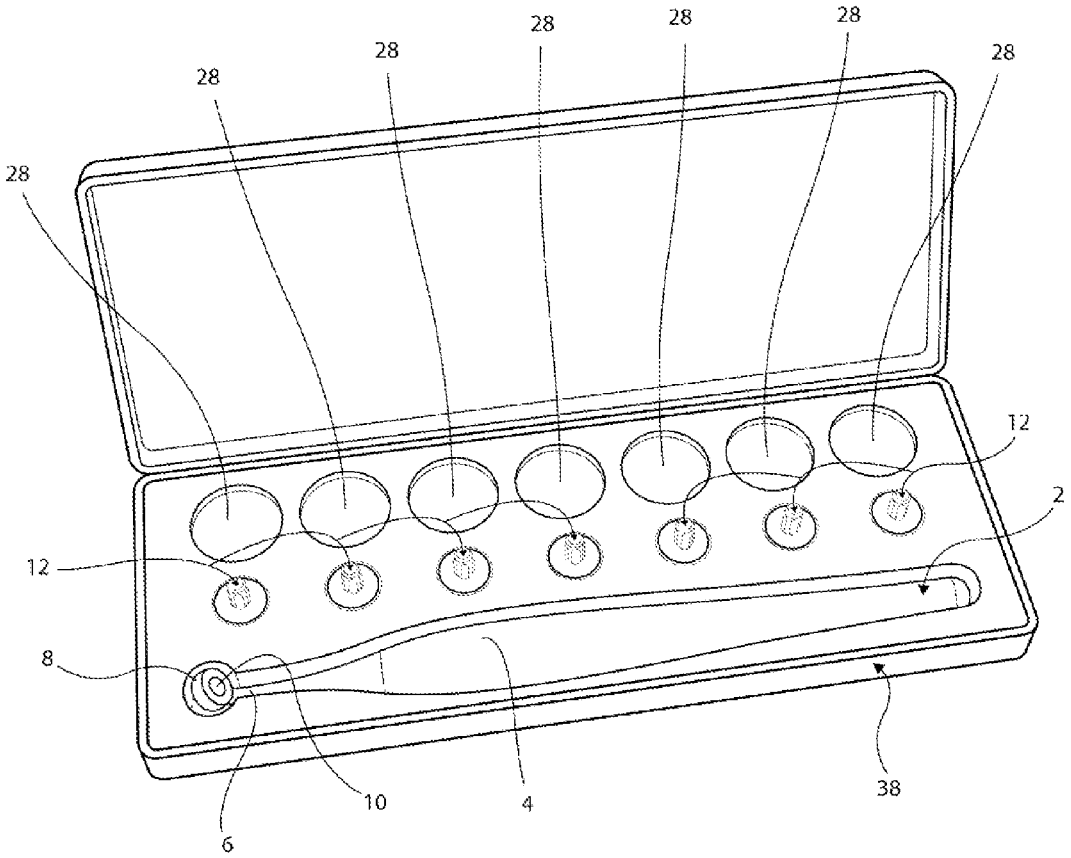

FIG. 41 depicts a format for integrating the hygienic applicator system into a representative cosmetic kit.

Figure 42:
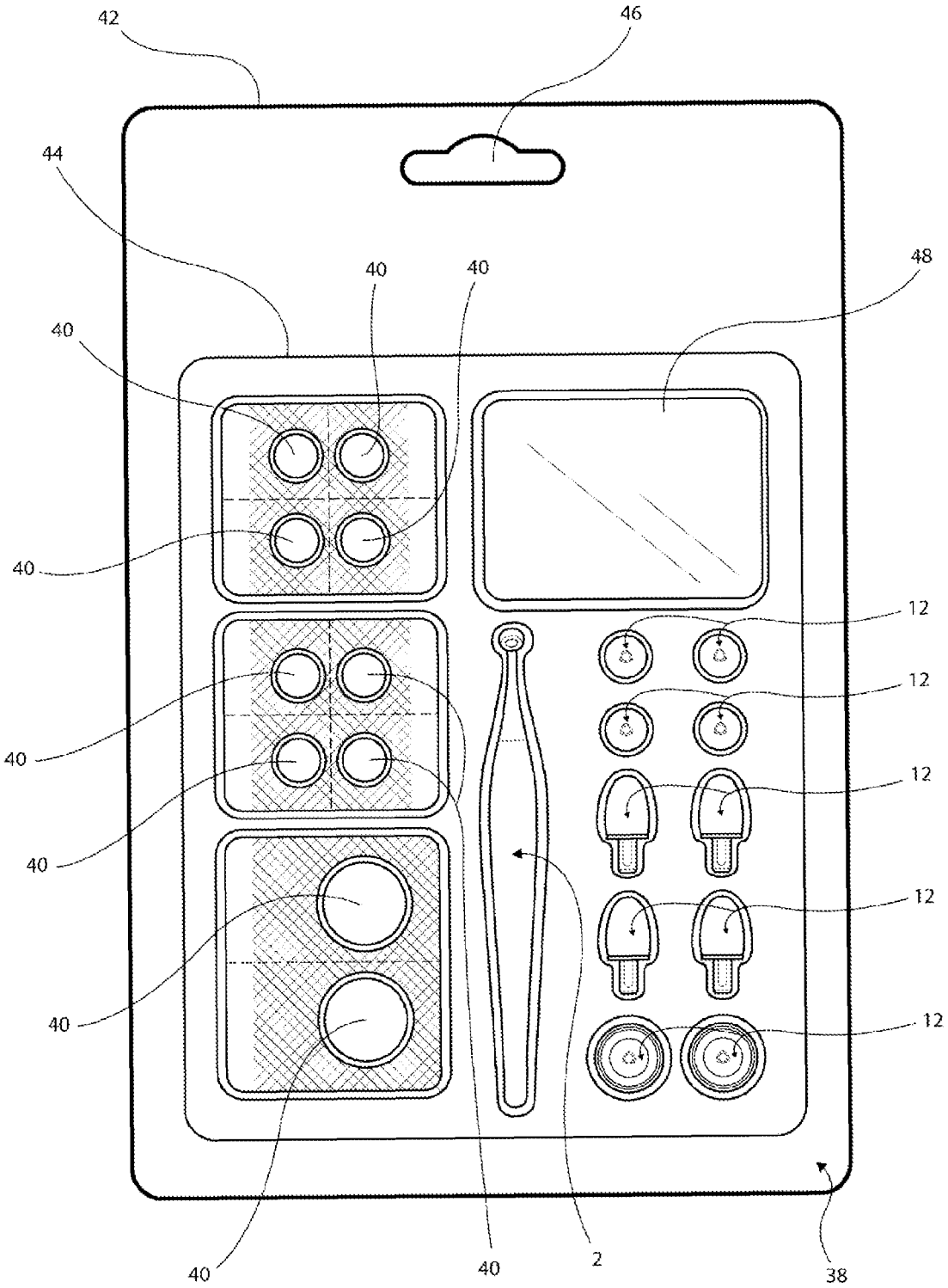

FIG. 42 depicts a packaging format that integrates the hygienic applicator into a cosmetic trial product that contains blister packed cosmetic unidoses.

Figure 43:
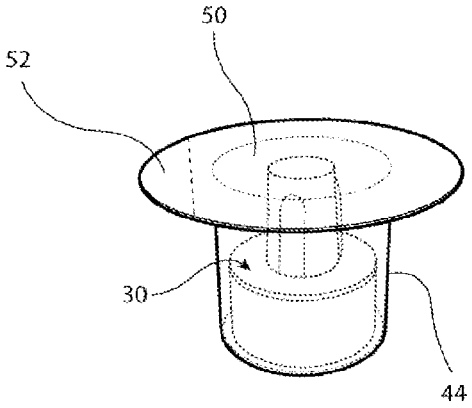

FIG. 43 depicts a packaging format that seals a single preloaded applicator into a blister cavity.

Figure 44:
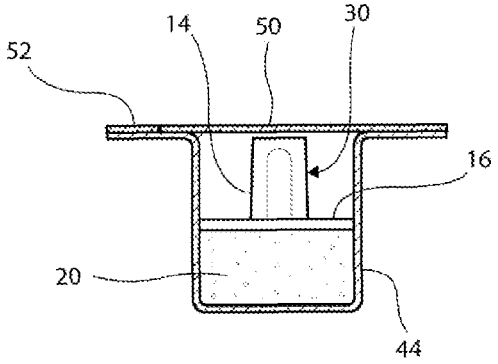

FIG. 44 shows a cutaway package view of a preloaded applicator that is sealed within a blister cavity.

Figure 45:
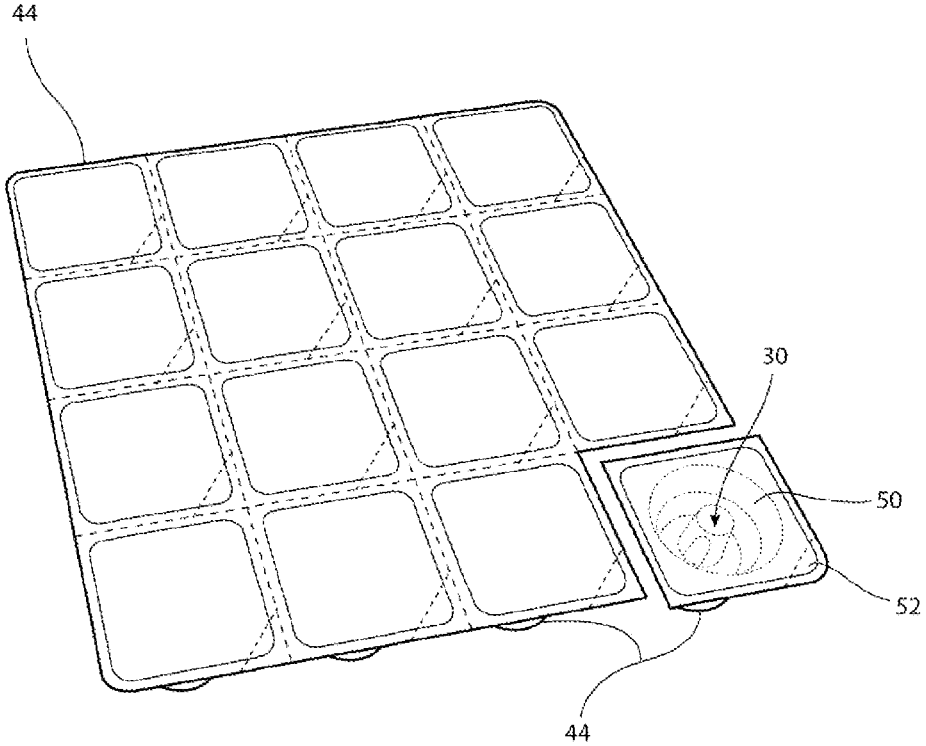

FIG. 45 depicts a packaging format that individually seals a plurality of preloaded applicators within separably attached blister pack modules.

Figure 46:
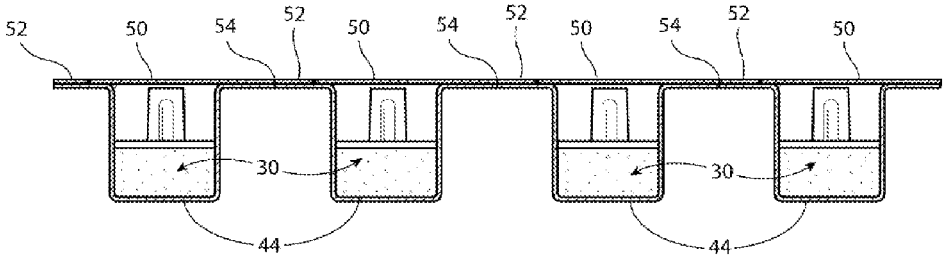

FIG. 46 shows a cutaway package view of a plurality of preloaded applicators that are individually sealed into separably attached blister pack modules.

Figure 47A:
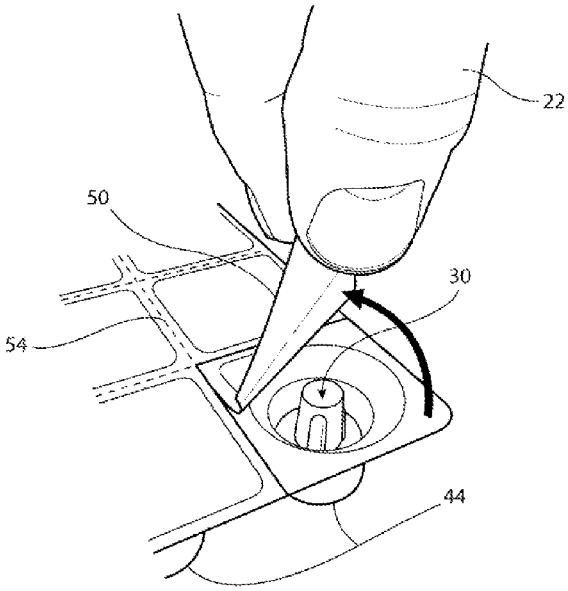
Figure 47B:
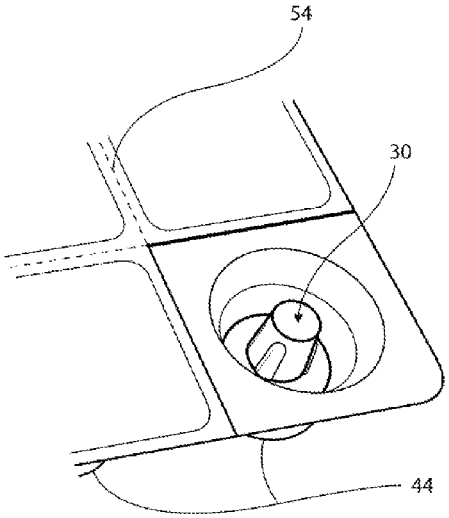

FIGS. 47A and 47B shows an operator removing a cover to expose a preloaded applicator that has been sealed into a blister pack module.

Figure 48:
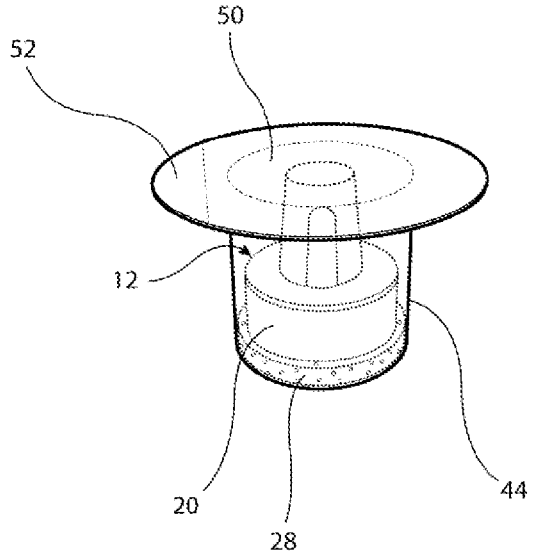

FIG. 48 depicts a packaging format that seals a blank applicator within a blister cavity that has a cosmetic material deposited onto its bottom.

Figure 49:
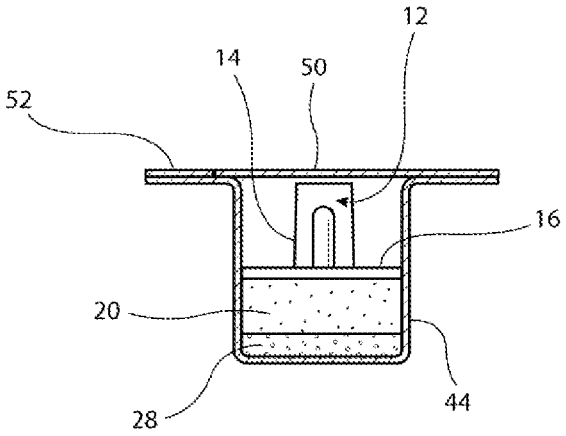

FIG. 49 shows a cutaway package view of a blank applicator that is sealed within a blister cavity that has a cosmetic material deposited onto its bottom.

Figure 50:
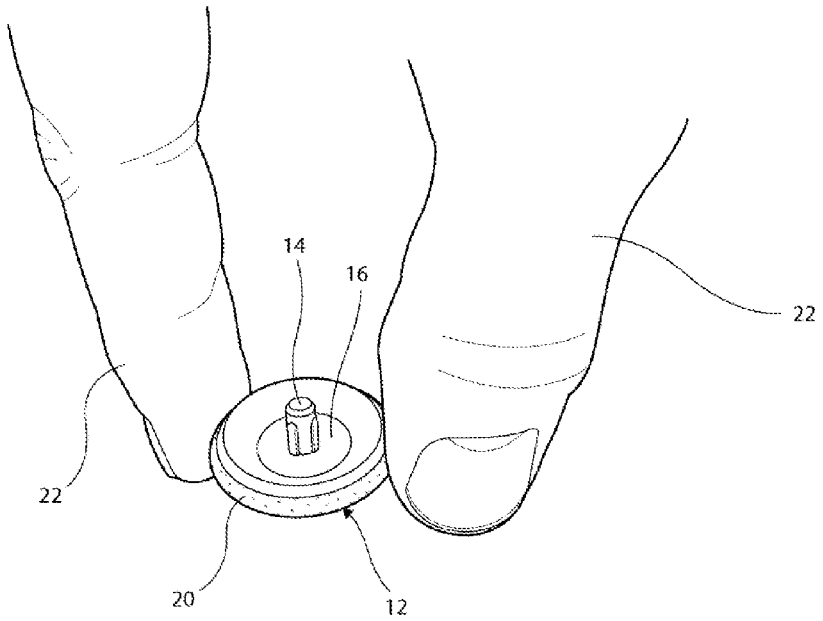

FIG. 50 shows an operator grasping an applicator by its base.

Figure 51:
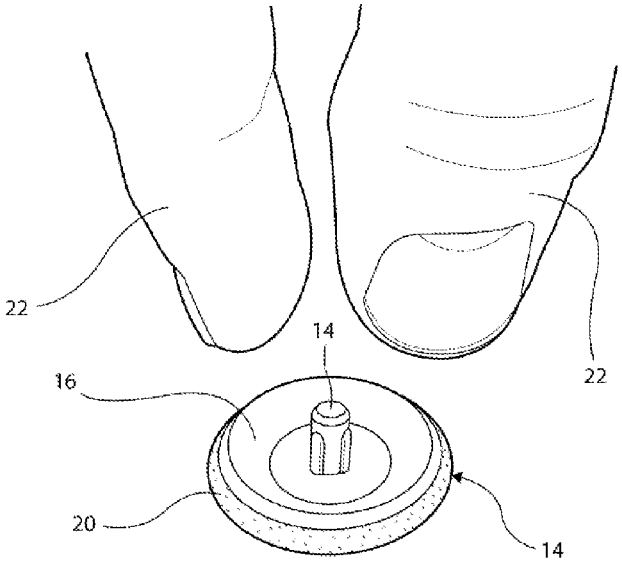

FIG. 51 shows an operator placing an applicator onto a surface so that its applicating member end faces down and its inserting member end faces up.

Figure 52:
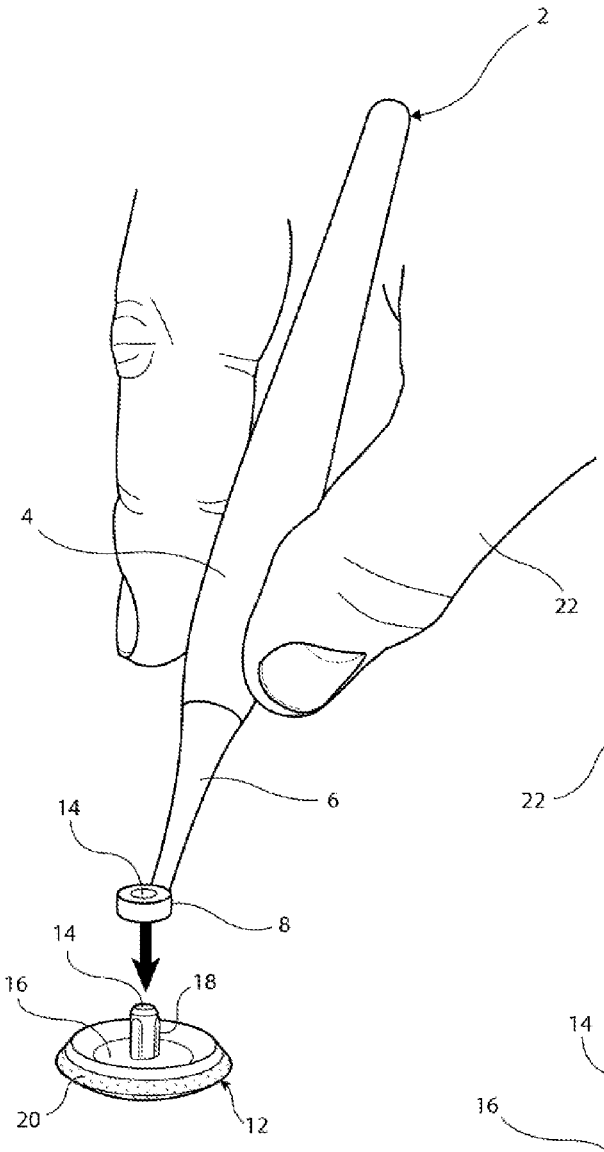

FIG. 52 shows an operator aligning a ringlet's aperture over top of an applicators inserting member.

Figure 53:
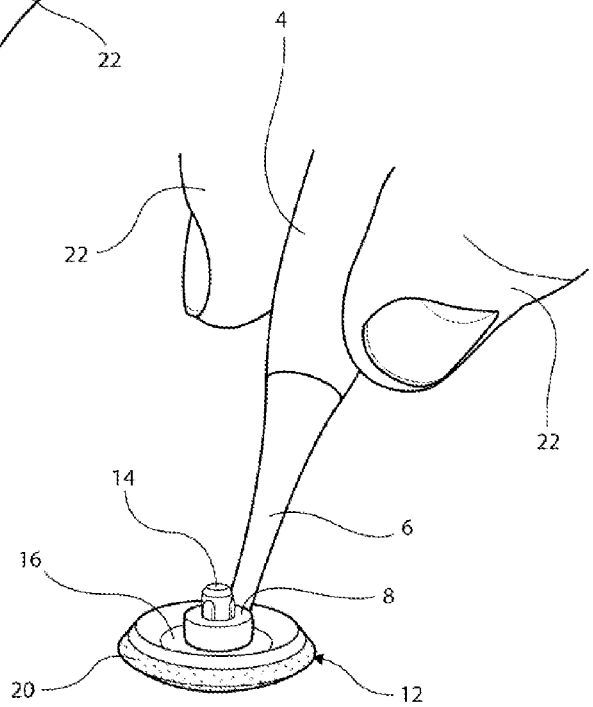

FIG. 53 shows an operator pressing down to plug an applicators inserting member into the ringlet's aperture.

Figure 54:
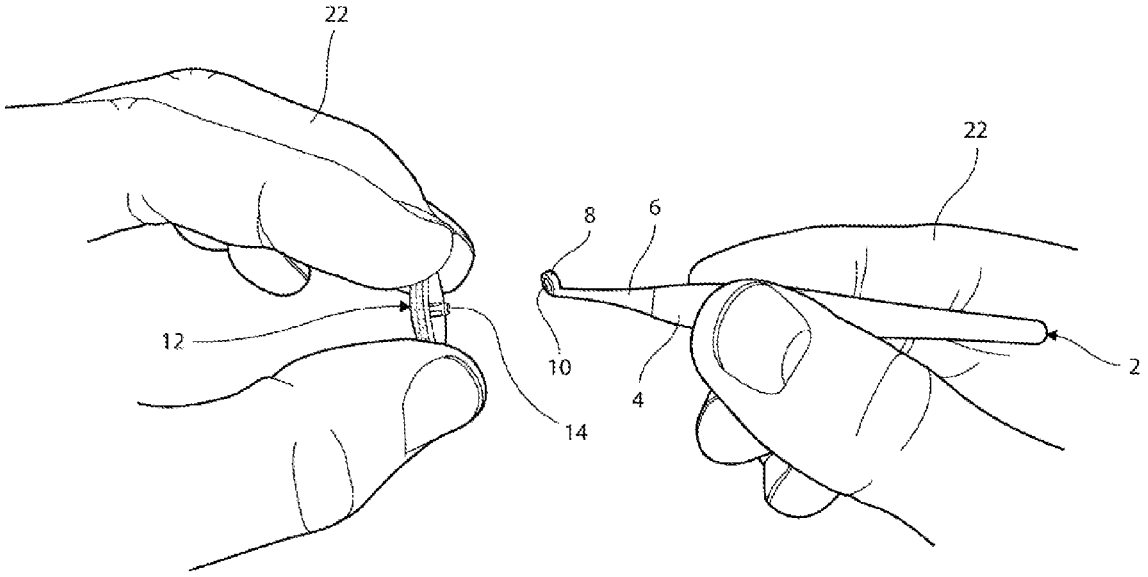

FIG. 54 shows an alternative first step for placing an applicator into a ringlet by first holding the applicator in the fingers and then aligning its inserting member with the ringlets aperture.

Figure 55:
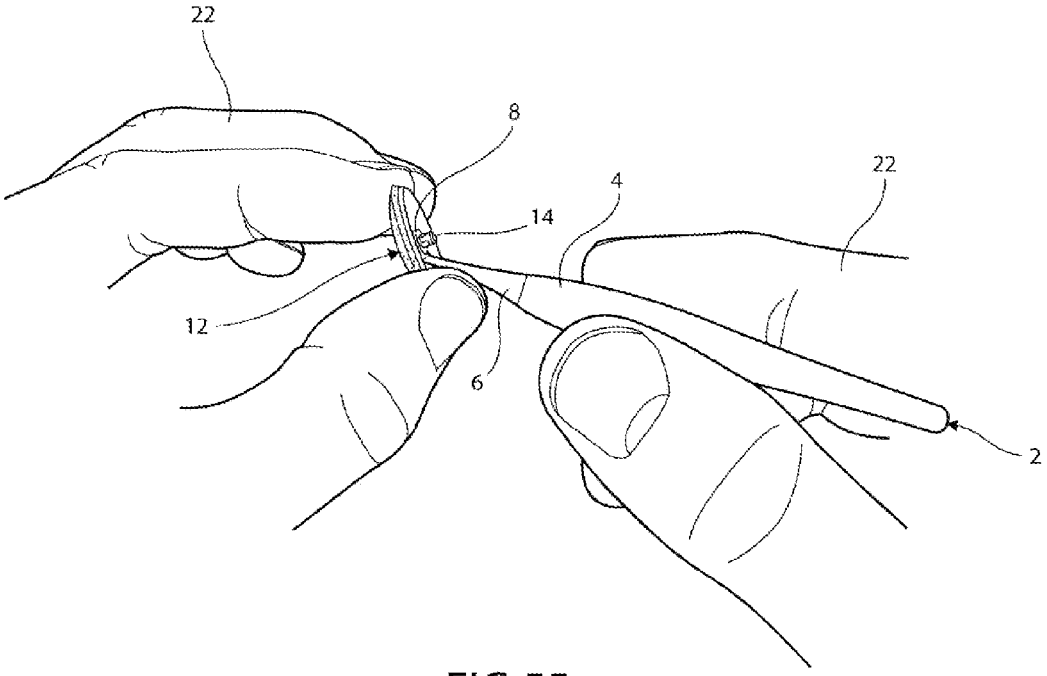

FIG. 55 shows an alternative second step for placing an applicator into a ringlet by first pushing on the applicators base to plug its inserting member into the ringlet's aperture.

Figure 56:
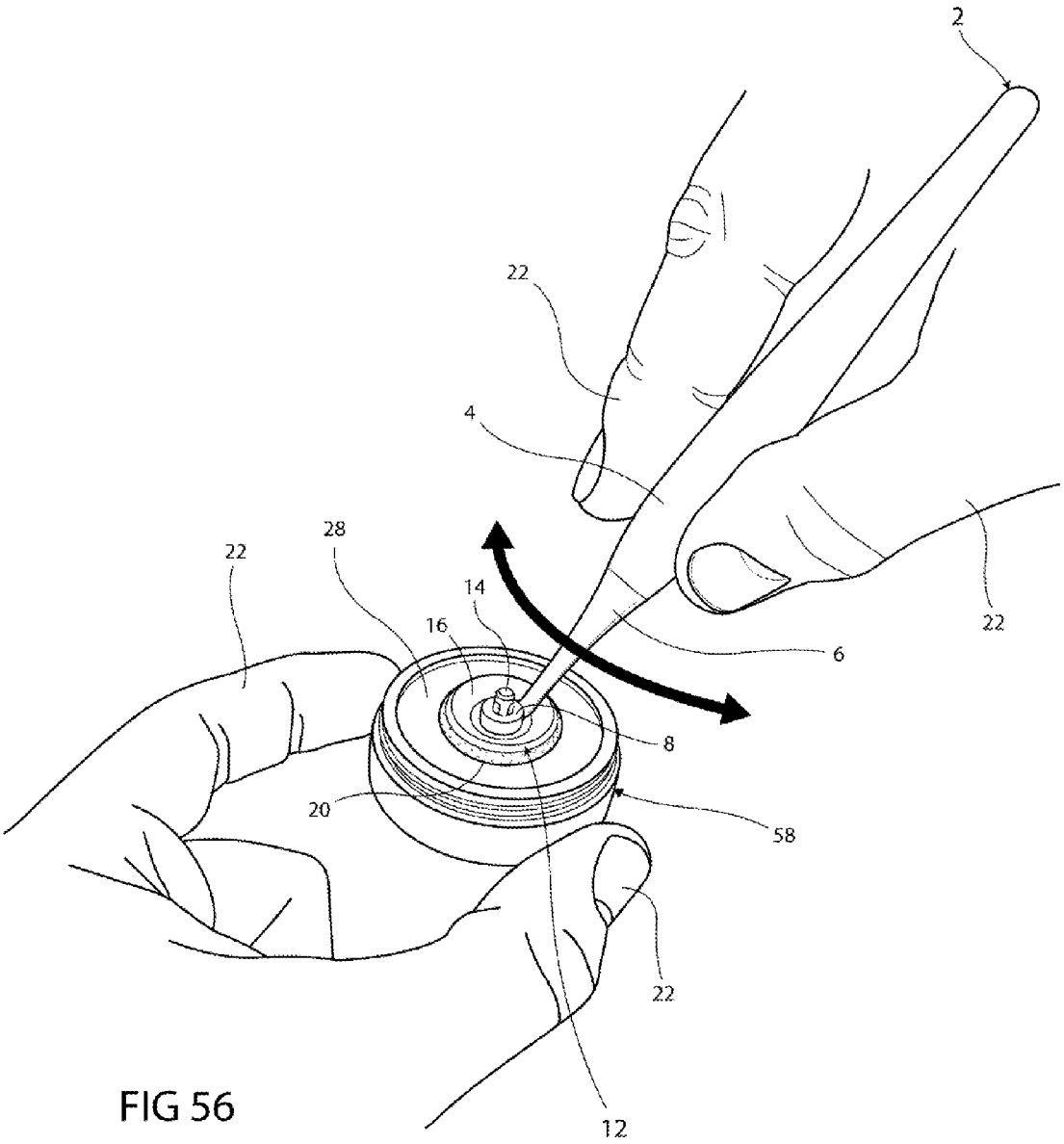

FIG. 56 shows an operator impregnating an applicator's applicating member with a cosmetic material from a cosmetic source.

Figure 57:
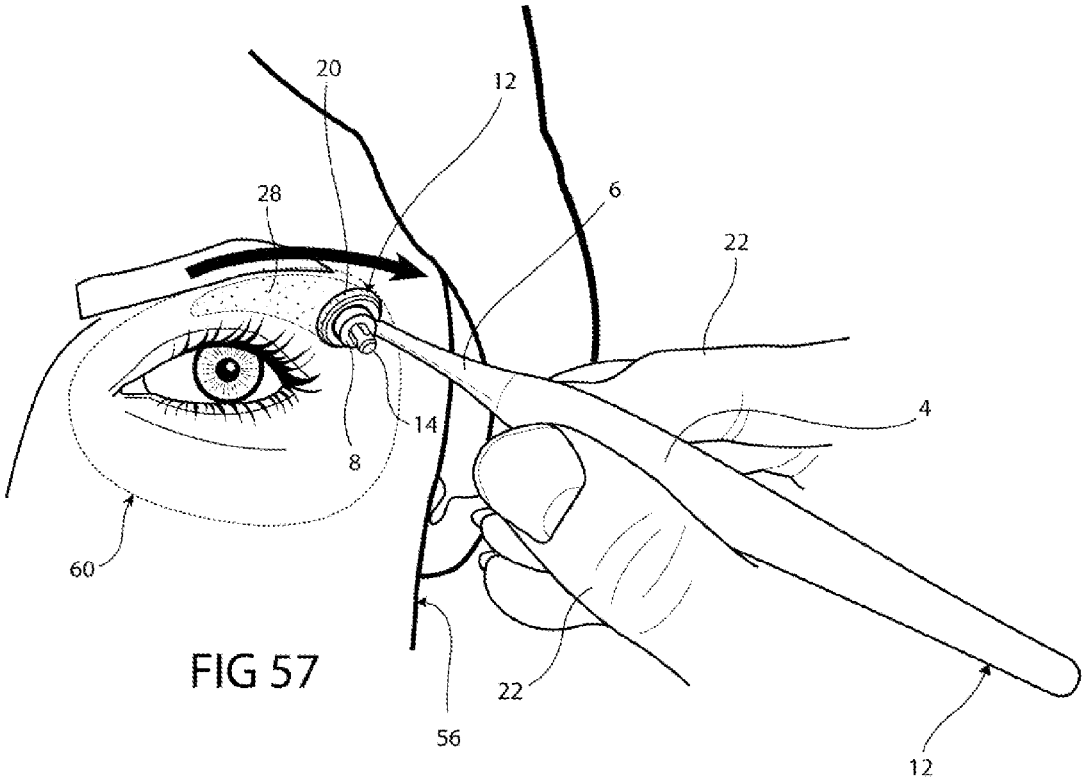

FIG. 57 shows an operator applying a cosmetic material to an applicant's orbital area.

Figure 58:
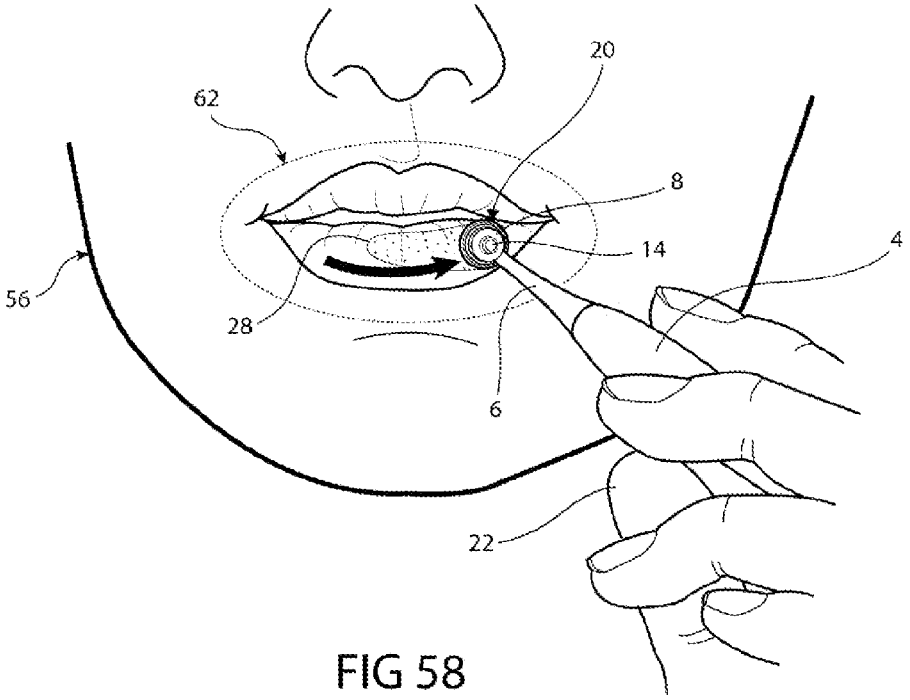

FIG. 58 shows an operator applying a cosmetic material to an applicant's lips.

Figure 59:
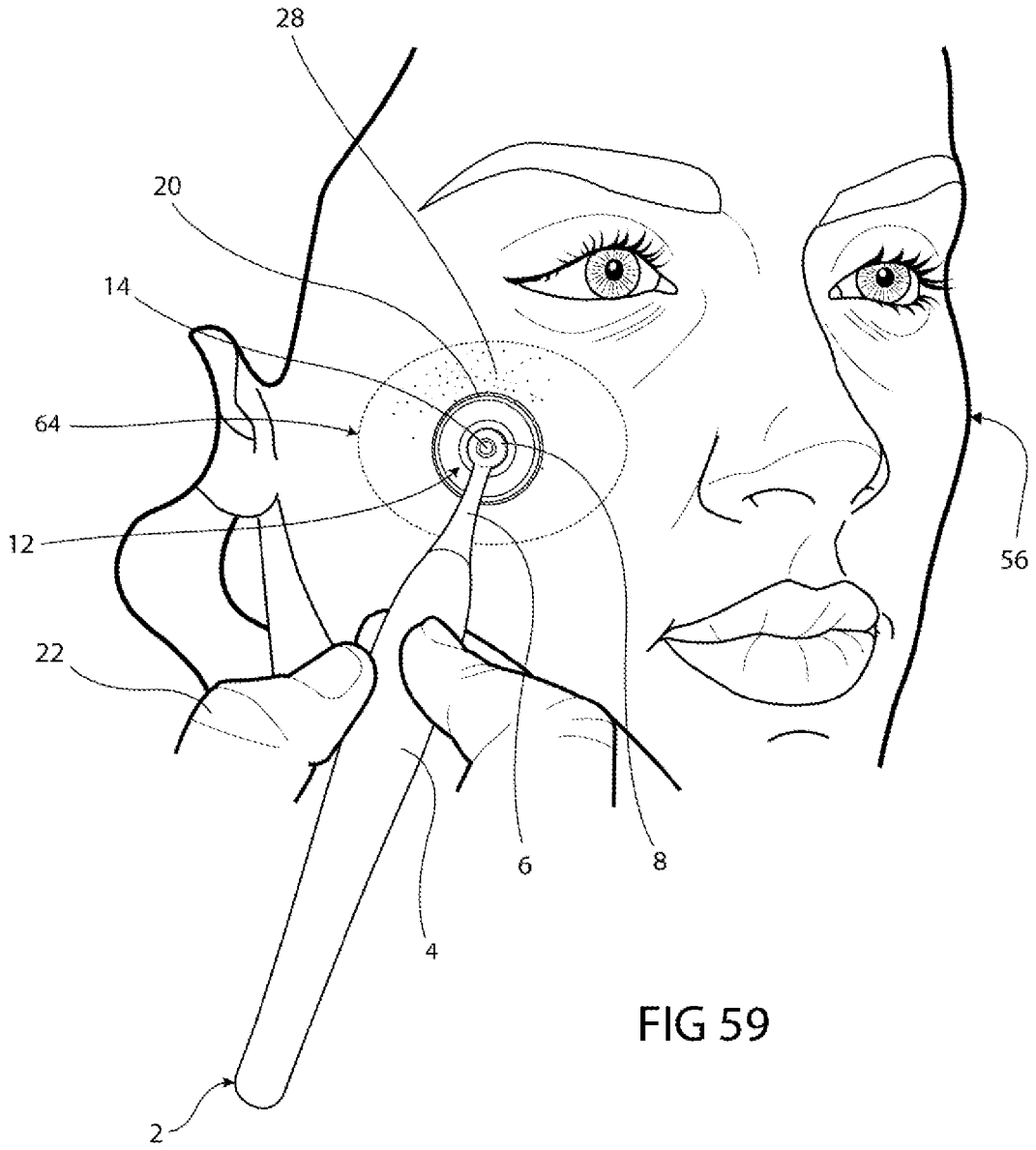

FIG. 59 shows an operator applying a cosmetic to an applicant's face.

Figure 60:
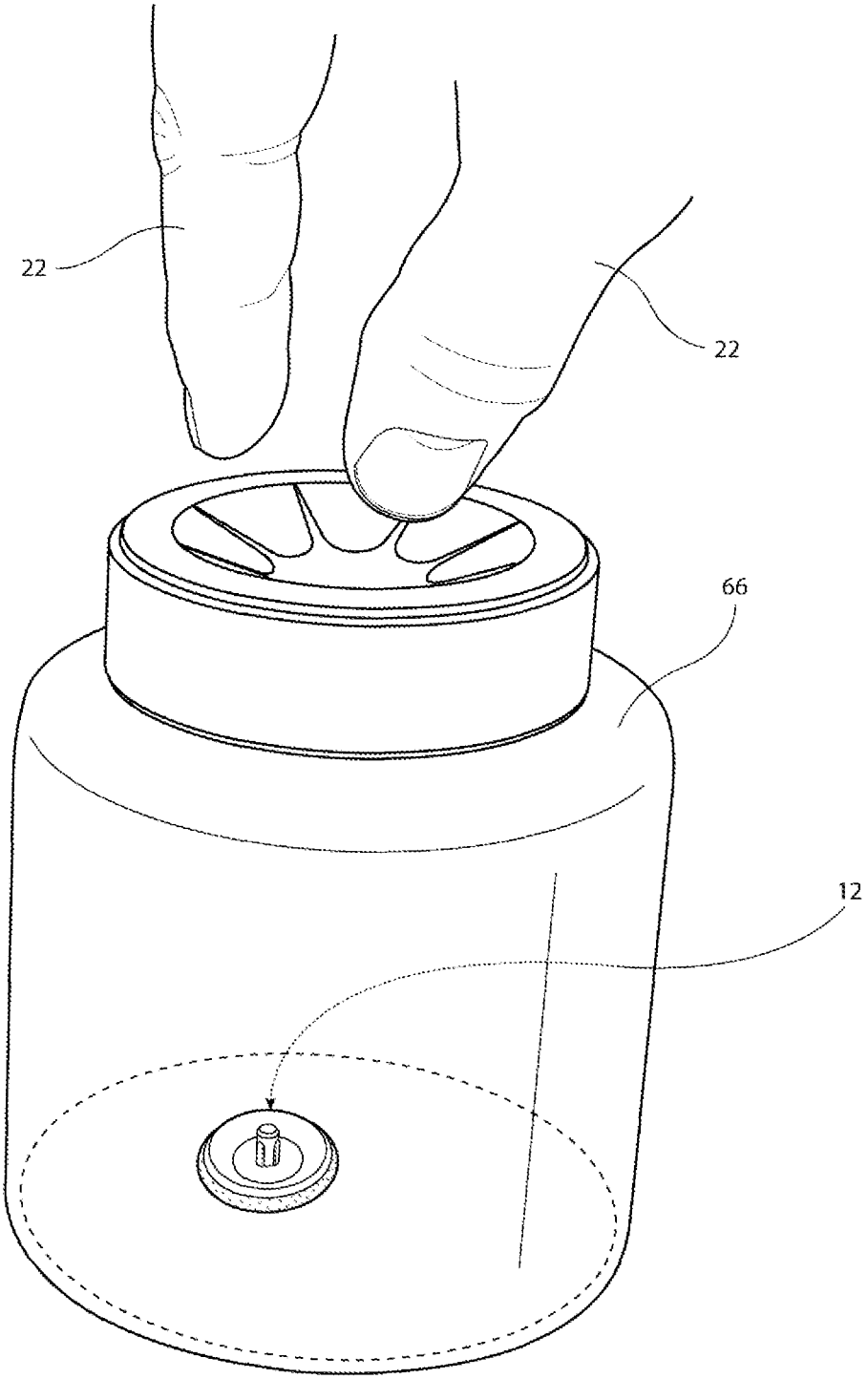

FIG. 60 shows an operator disposing of a used applicator into a receptacle.

Figure 61A:
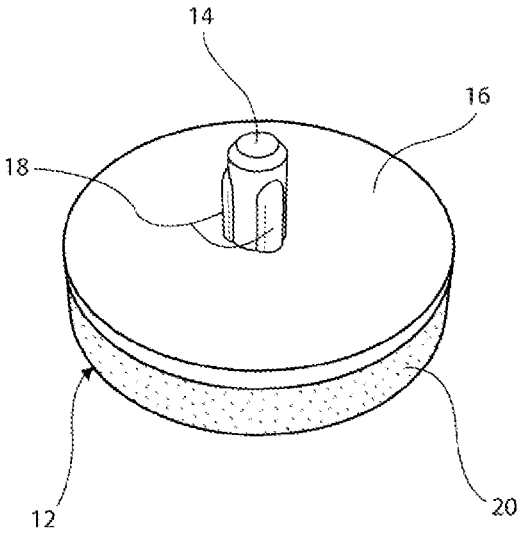
Figure 61B:
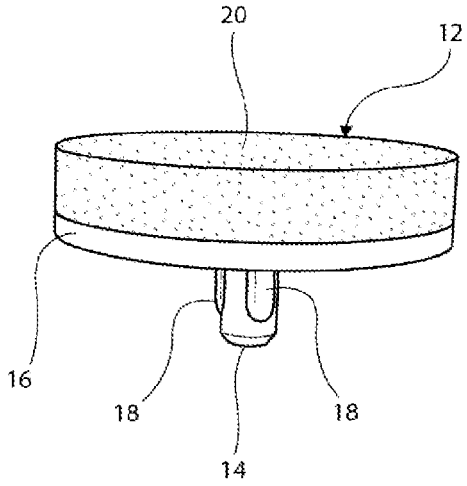
Figure 61C:
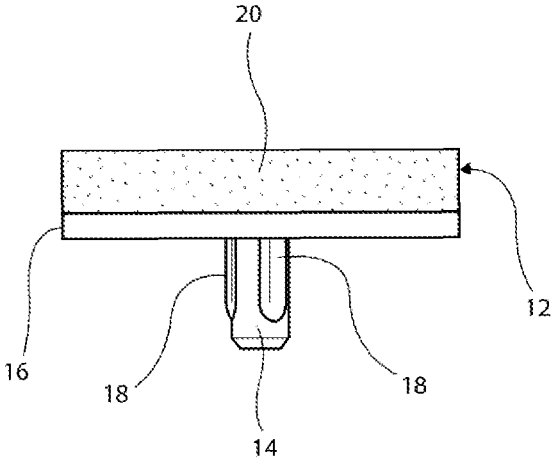

FIGS. 61A to 61C show various views of an applicator with a substantially flat base and an adherent applicating member.

Figure 62:
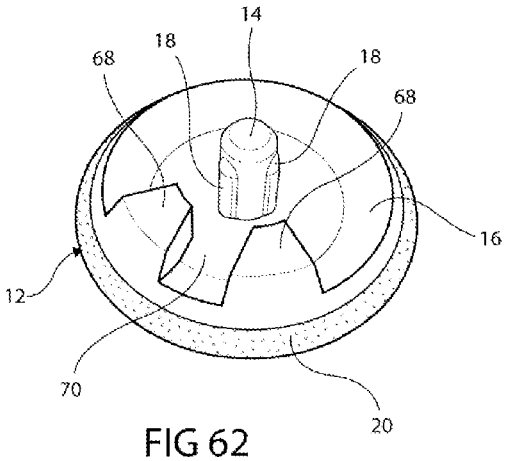

FIG. 62 Dimensionally depicts an applicator that has a bilaterally formed with stop on its underside base area.

Figure 63:
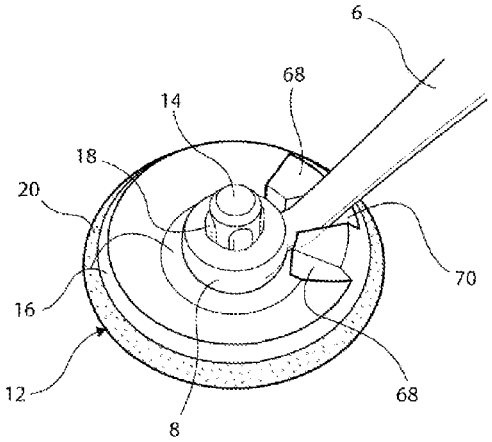

FIG. 63 depicts a tapered shaft's end that is sandwiched in-between a bilaterally formed stop.

Figure 64:
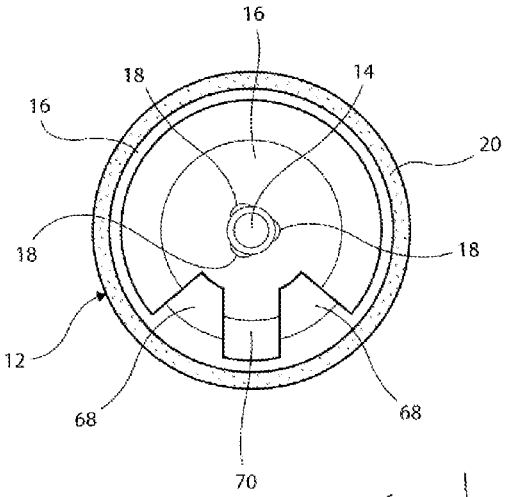

FIG. 64 shows a plan view of a bilaterally formed stop that is formed on a base's underside area.

Figure 65:
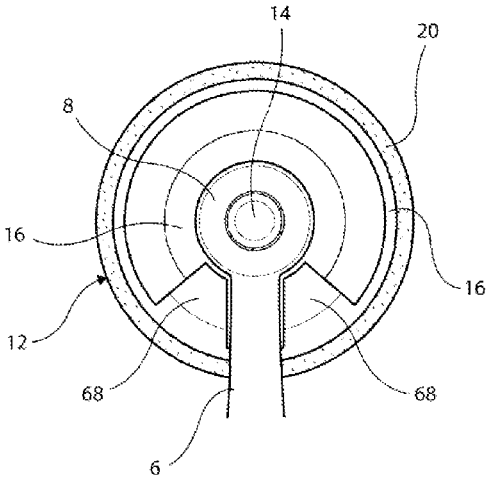

FIG. 65 shows a plan view of a ringlet that is inserted onto an applicators inserting member so that its tapered shaft end is sandwiched in-between a stop's bilateral extrusions.

Figure 66:
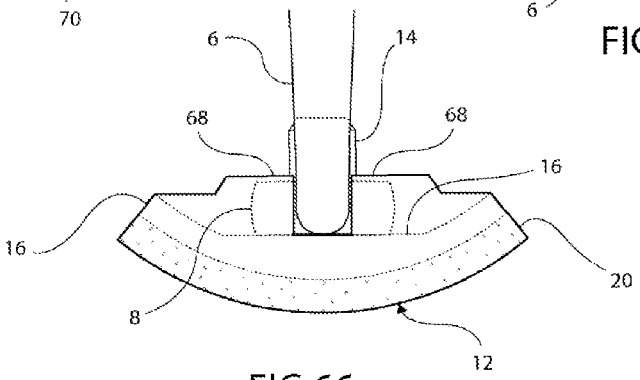

FIG. 66 shows the side view of a shaft's tapered end that is sandwiched in-between a stop's bilateral extrusions.

Figure 67:
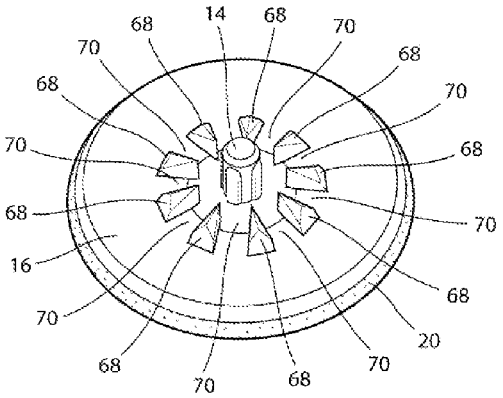

FIG. 67 Dimensionally shows an applicator that has a plurality of stops that are radially distributed around underside base area.

Figure 68:
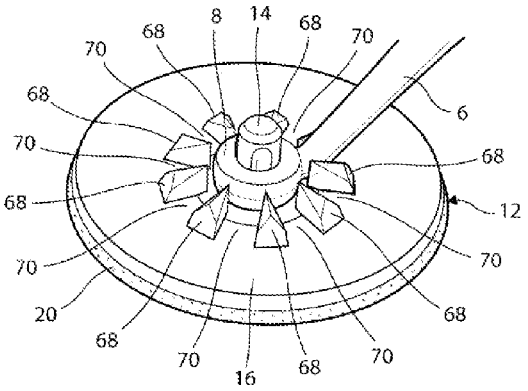

FIG. 68 Dimensionally shows a ringlet's tapered shaft end that is sandwiched in-between one of many stops, that are radially distributed around a base's underside area.

Figure 69:
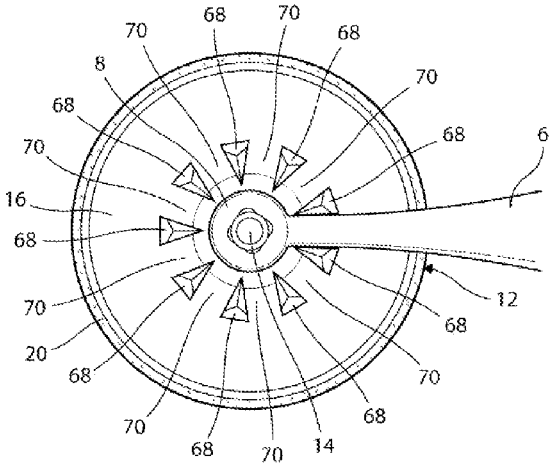

FIG. 69 shows a plan view of a ringlet that is inserted onto an applicators inserting member so that its tapered shaft end is sandwiched in-between one of many stops that are radially distributed around a base's underside area.

Figure 70:
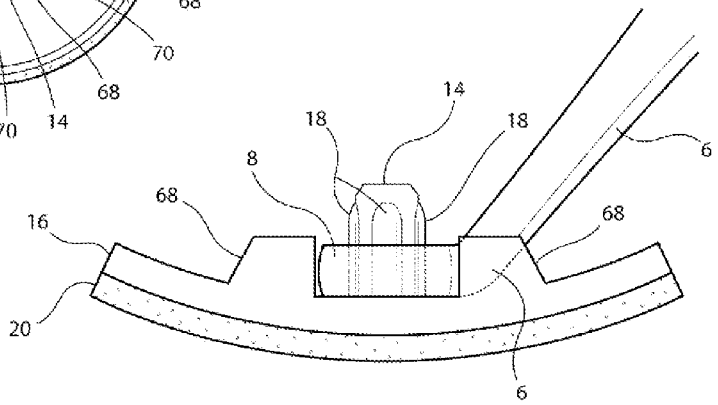

FIG. 70 shows a partially see-through side view that reveals a shaft's tapered end sandwiched in-between one of many stops that are distributed around a base's underside area.

Figure 71:
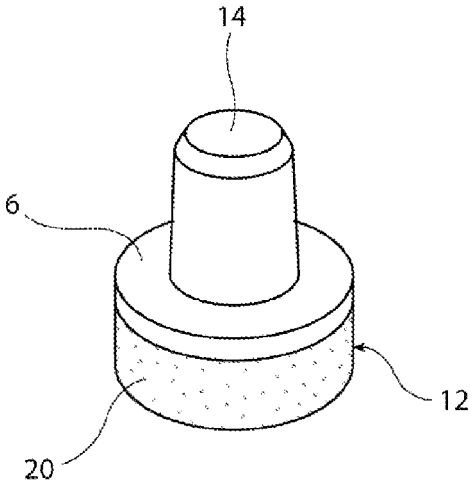

FIG. 71 dimensionally depicts an applicator that has a generally tapered inserting member.

Figure 72:
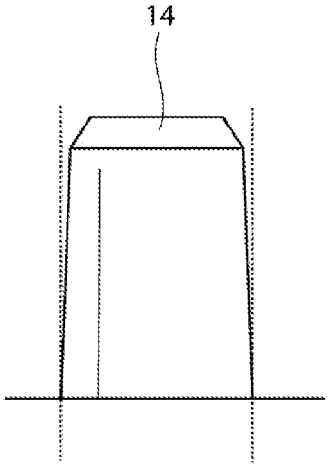
Figure 73A:
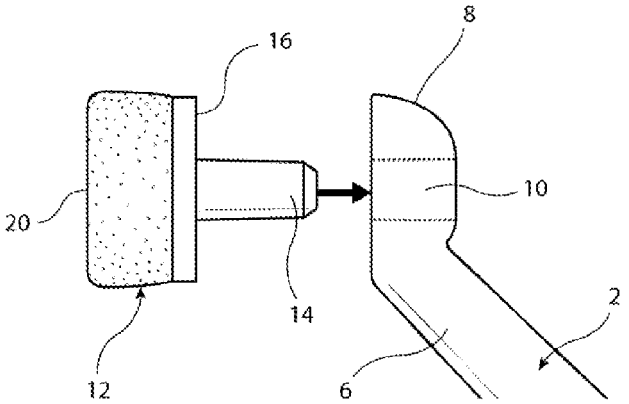
Figure 73B:
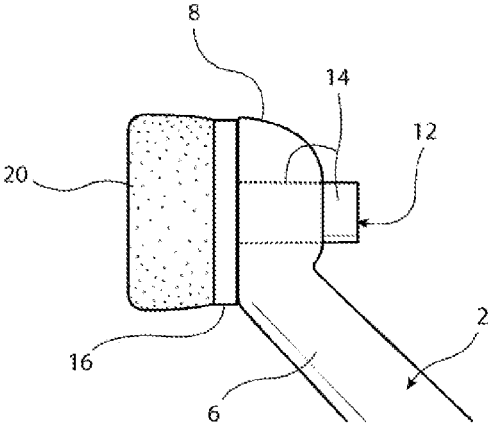

FIG. 72 Shows the side view of an inserting member's tapered profile, wherein the profile is indicated by a set of vertical dotted lines on either side FIGS. 73A and 73B depict a side view sequence of an applicator's tapered inserting member before and after frictionally inserting into a corresponding ringlet's aperture.

Figure 74A:
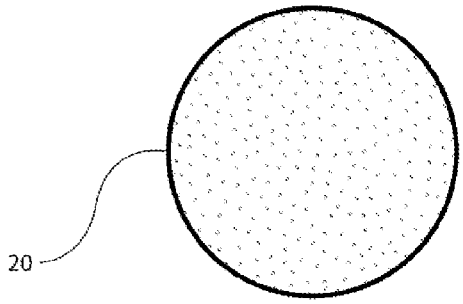
Figure 74B:
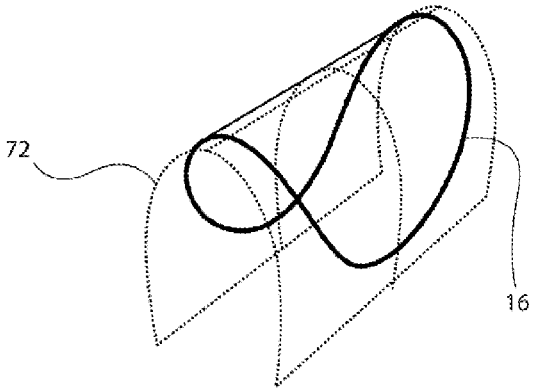

FIGS. 74A and 74B show a how a round applicating member shape's is mapped and subsequently outlined onto a surface, curved along one axis, to indicate an underlying base's shape.

Figure 75A:
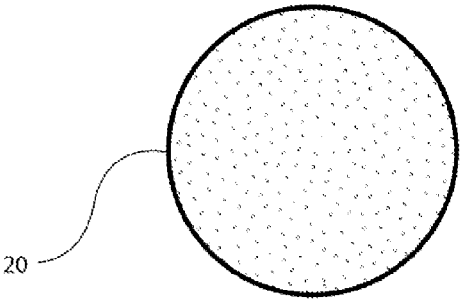
Figure 75B:
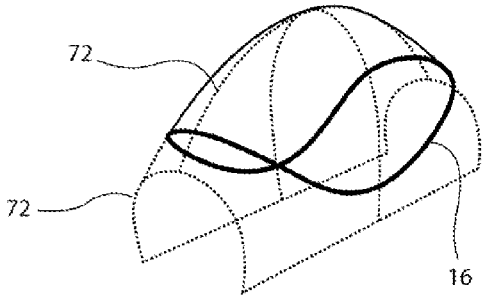

FIGS. 75A and 75B show a how a round applicating member shape's is mapped and subsequently outlined onto a surface, curved along two axes, to indicate an underlying base's shape.

Figure 76A:
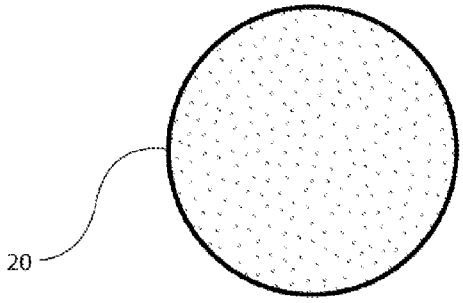
Figure 76B:
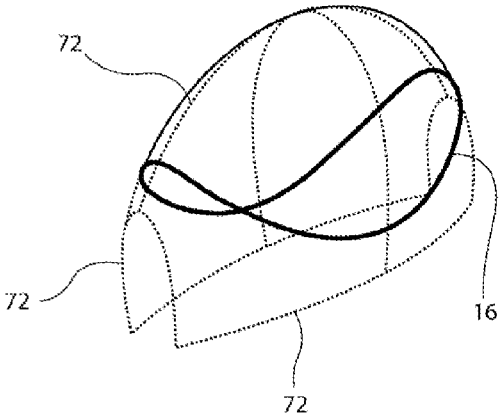

FIGS. 76A and 76B show a how a round applicating member shape's is mapped and subsequently outlined onto a surface, curved along three axes, to indicate an underlying base's shape.

Figure 77:
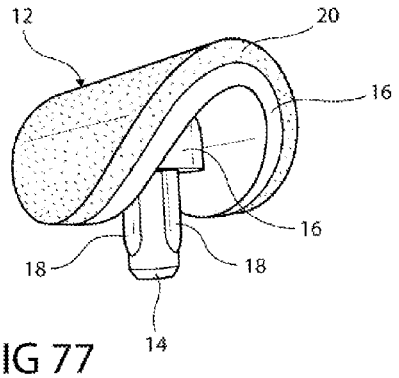

FIG. 77 shows a three quarter view of an applicator that is substantially curved along one axis to form a taco shell-like shape having curved sides and a straight top.

Figure 78:
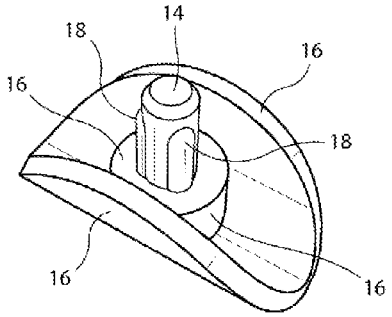

FIG. 78 shows a dimensional underside view of the applicators taco-like base that reveals its platform-like underside and centrally formed inserting member.

Figure 79:
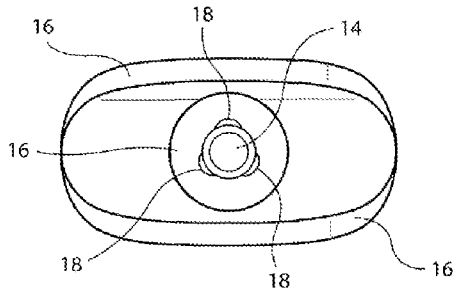

FIG. 79 shows an underside side plan view of the applicator's taco-like base that reveals its platform-like underside and centrally formed inserting member.

Figure 80:
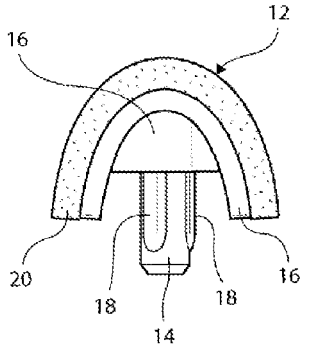

FIG. 80 shows a profile view that reveals the taco-like applicators curve along its single axis.

Figure 81:
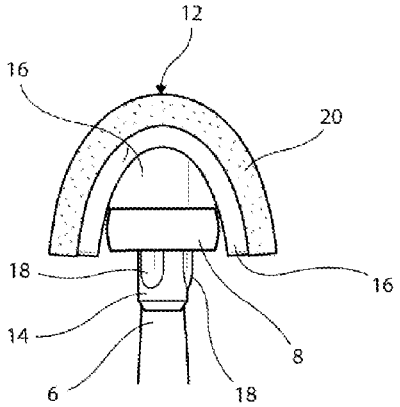

FIG. 81 shows a profile view of a ringlet fully inserted onto the applicators inserting member so that its bottom side rests flush with the base's flat underside platform.

Figure 82:
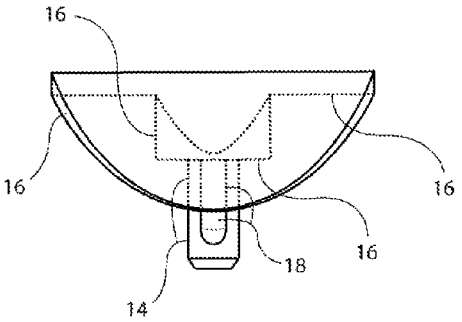

FIG. 82 shows a side view that reveals the taco-like applicators straight topside.

Figure 83:
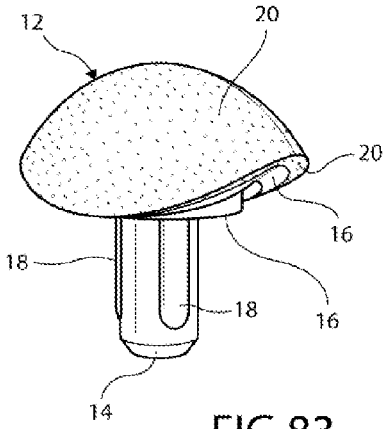

FIG. 83 shows a three quarter view of an applicator that is substantially curved along multiple axes to form a shell like profile.

Figure 84:
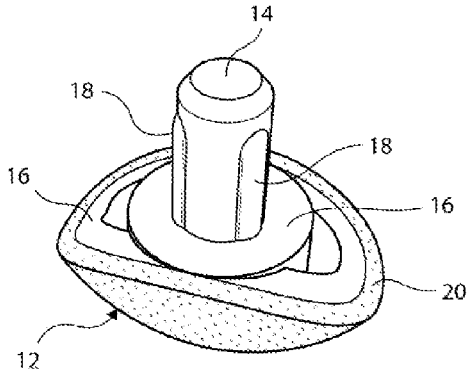

FIG. 84 shows a three quarter underside view of applicators inserting member and its flat circular base area that is substantially flush with its bottom side.

Figure 85:
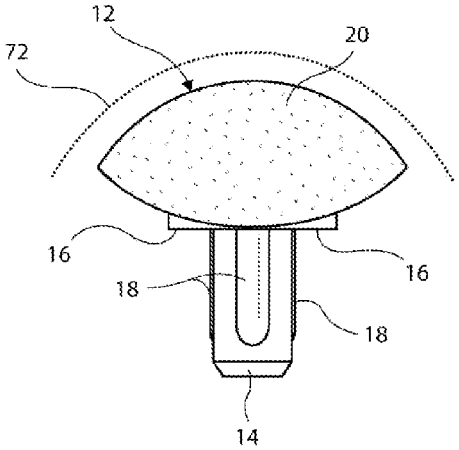

FIG. 85 is a side view that shows the applicator's curvature along a first axis.

Figure 86:
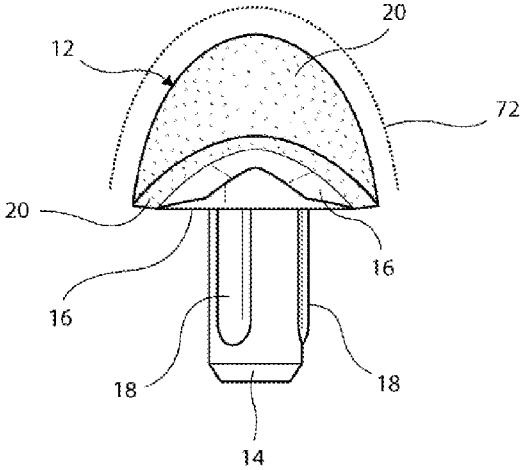

FIG. 86 is a profile view that shows the applicator's curvature along a second axis.

Figure 87:
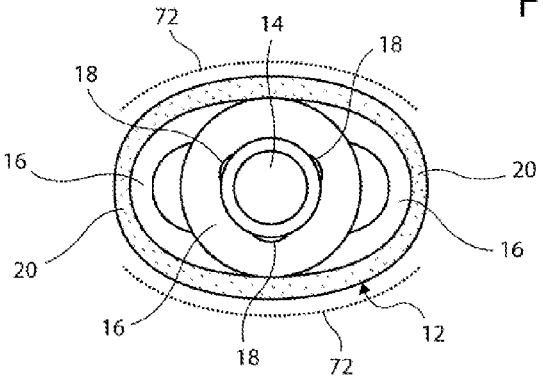

FIG. 87 is an underside view, shows the applicator's curvature along a third axis.

Figure 88A:
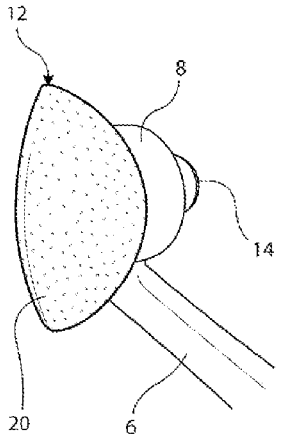
Figure 88B:
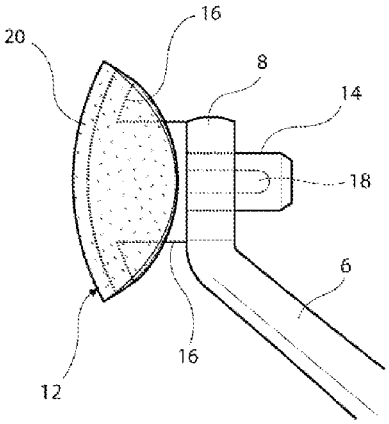
Figure 88C:
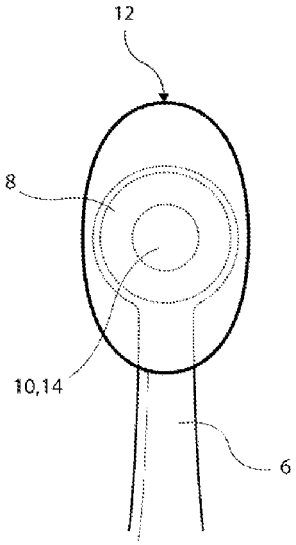

FIGS. 88A to 88C show various views of an applicator that has been selectively rotated within a ringlet to produce a vertical applicating orientation.

Figure 89A:
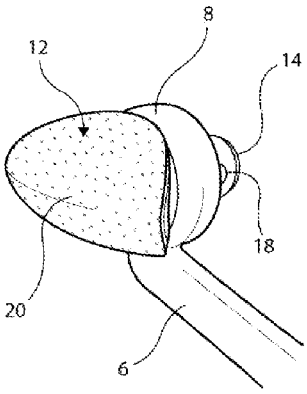
Figure 89B:
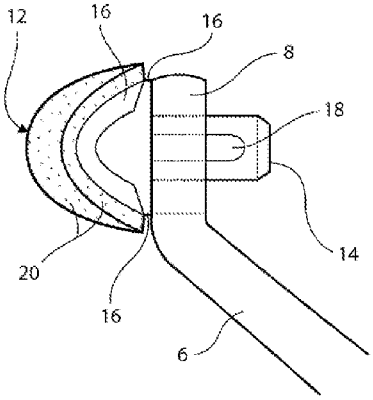
Figure 89C:
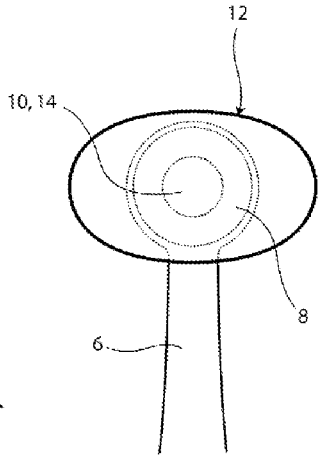

FIGS. 89A to 89C show various views of an applicator that has been selectively rotated within a ringlet to produce a horizontal applicating orientation.

Figure 90:
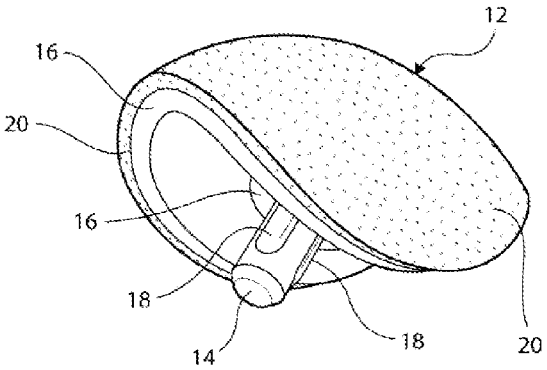

FIG. 90 shows a three quarter view of an applicator that has a substantially contra-angled underside base portion.

Figure 91:
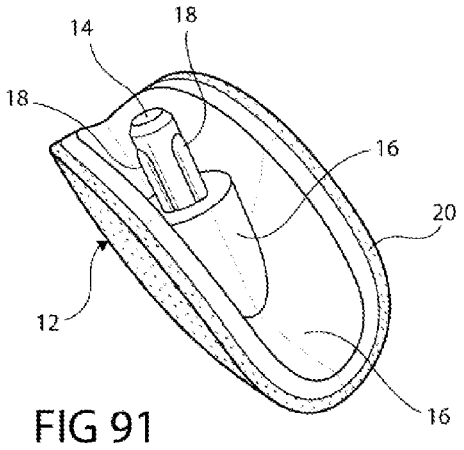

FIG. 91 Shows a dimensional underside view of an applicator's substantially contra-angled base portion and its centrally formed inserting member.

Figure 92:
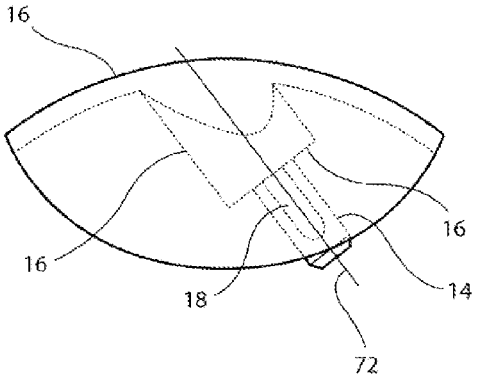

FIG. 92 shows a see through side view of the applicator's substantially contra-angled underside base platform.

Figure 93:
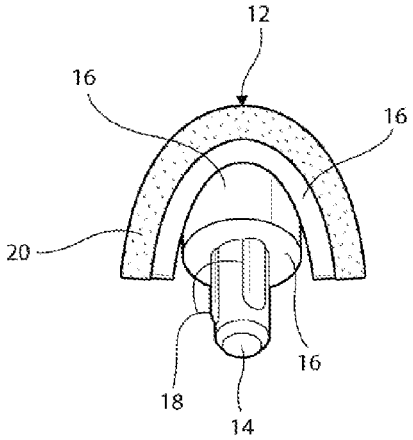

FIG. 93 shows a profile view of the applicator's substantially contra-angled underside base platform.

Figure 94:
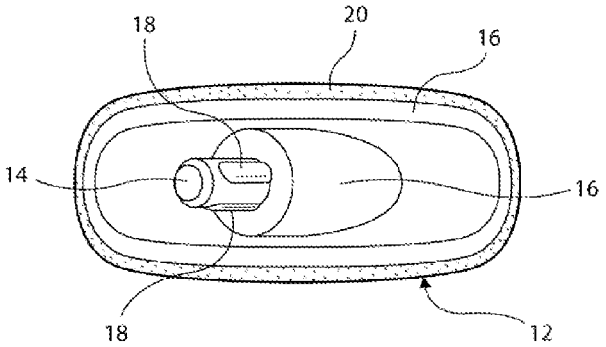

FIG. 94 shows an underside plan view of the applicator's substantially contra-angled underside base platform.

Figure 95:
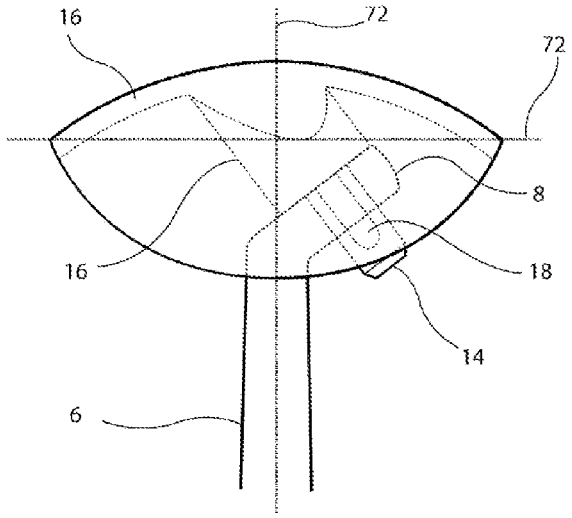

FIG. 95 shows a contra-angled applicators horizontal, or perpendicular orientation within a ringlet that is angled at forty five degrees.

Figure 96:
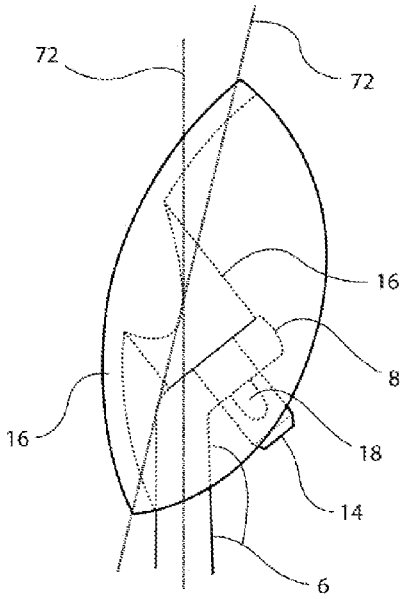

FIG. 96 shows a contra-angled applicators substantially vertical orientation within a ringlet that is angled at forty five degrees.

Figure 97:
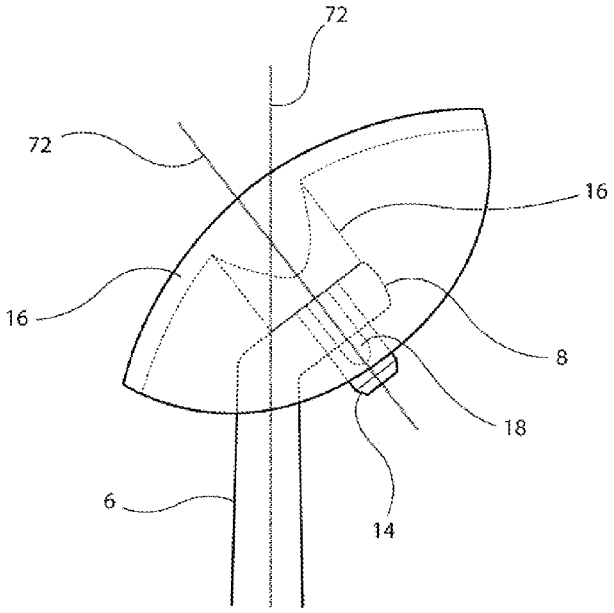

FIG. 97 shows, as a basis for comparison, a non contra-angled applicators fixed orientation within a ringlet that is angled at forty five degrees.

Figure 98:
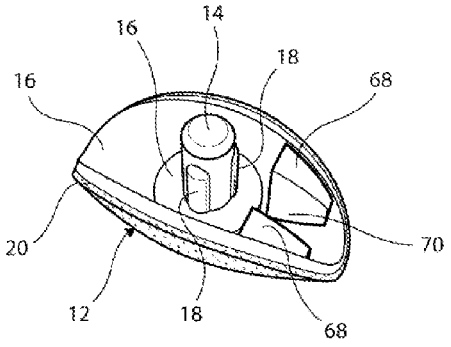

FIG. 98 shows a dimensional underside view of an applicator having a bilaterally formed stop on one half of its inner base area.

Figure 99:
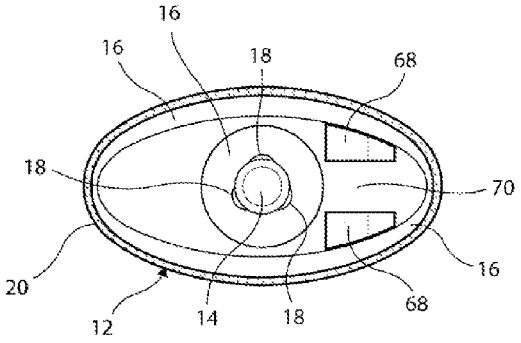

FIG. 99 shows an underside side plan view of an applicator having a bilaterally formed stop formed on one half of its inner base area.

Figure 100:
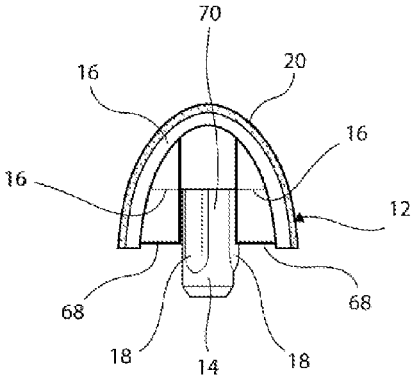

FIG. 100 Shows a profile view of the applicator's bilaterally formed stop and resultant gap in-between.

Figure 101:
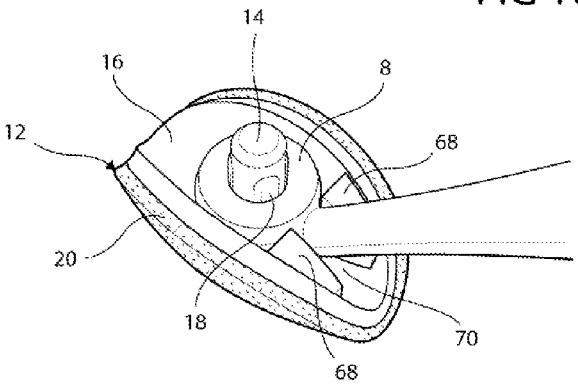

FIG. 101 dimensionally depicts a ringlet that is fully inserted onto the applicators inserting member so that its tapered shaft juncture is sandwiched in-between the stop's bilateral extrusions.

Figure 102:
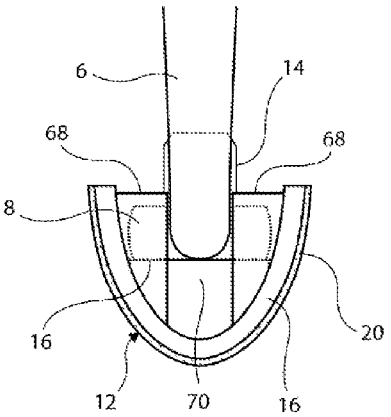

FIG. 102 Depicts a profile view revealing a shaft's tapered end inserted into the resultant gap that is in-between the stop's sandwiching extrusions.

Figure 103:
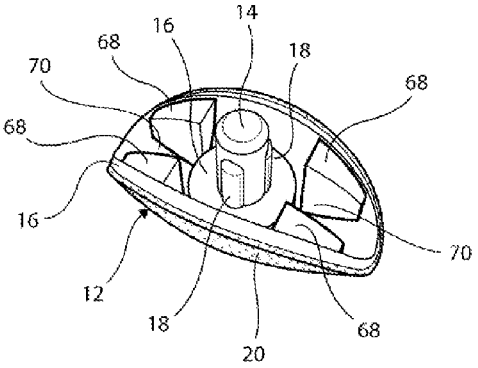

FIG. 103 shows a dimensional underside view of an applicator having bilaterally formed stops formed on both halves of its inner base area.

Figure 104:
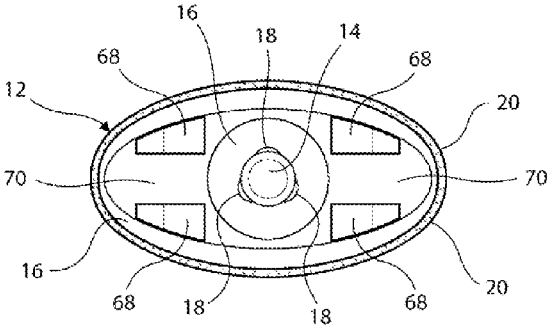

FIG. 104 shows an underside plan view of an applicator having bilaterally formed stops formed on both halves of its inner base area.

Figure 105:
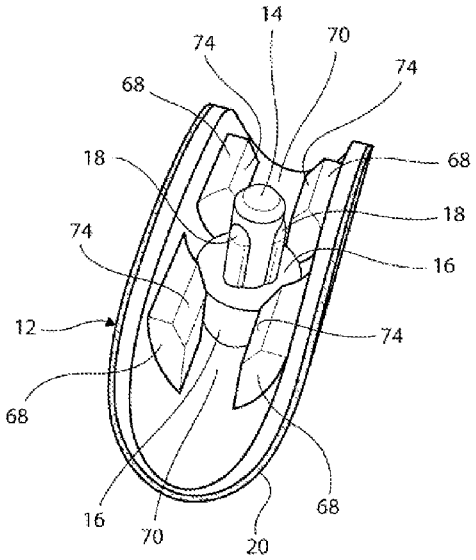

FIG. 105 dimensionally depicts an underside view of an applicator underside interior having stops that are superiorly beveled or tapered.

Figure 106:
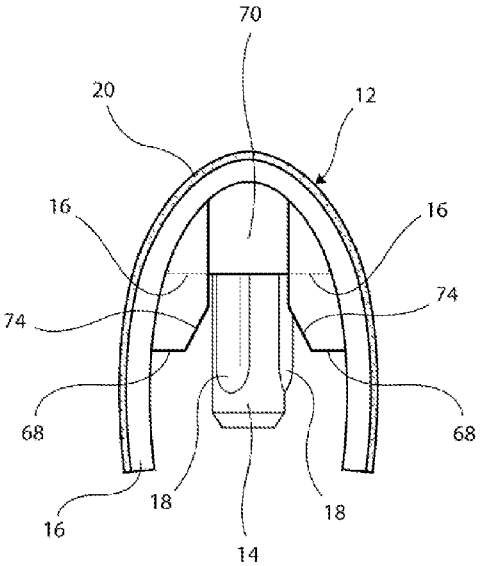

FIG. 106 depicts the applicators substantially tapered stops from a profile view.

Figure 107:
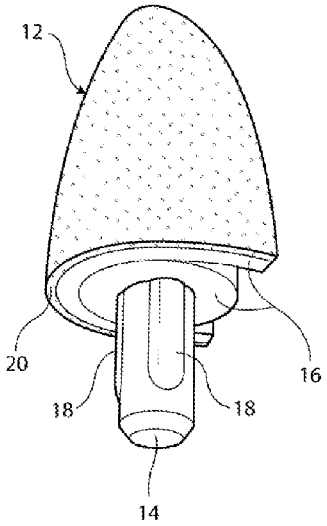

FIG. 107 depicts a three quarter anterior view of a partially conical applicator that has a flat bottomed base portion with an inserting member emerging from thereof.

Figure 108:
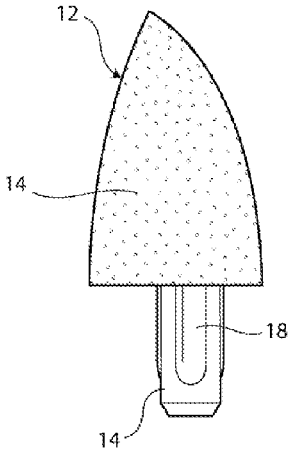

FIG. 108 Depicts a partially conical applicator from a side view

Figure 109:
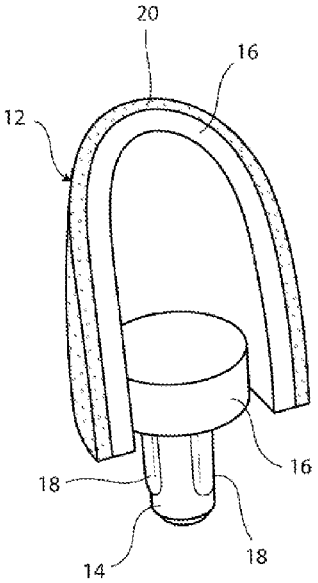

FIG. 109 depicts a three quarter posterior view of a partially conical applicator that reveals its incomplete cone shape.

Figure 110:
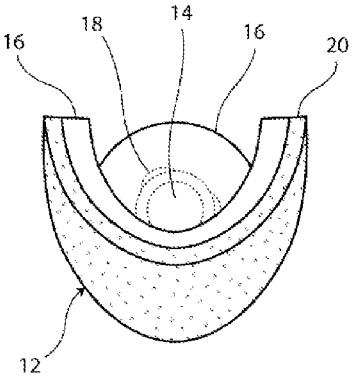

FIG. 110 a topside plan view of a partially conical applicator.

Figure 111:
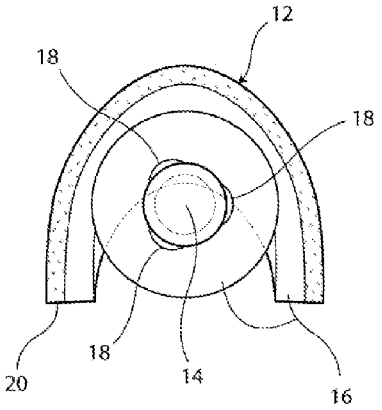

FIG. 111 an underside plan view of a partially conical applicator.

Figure 112:
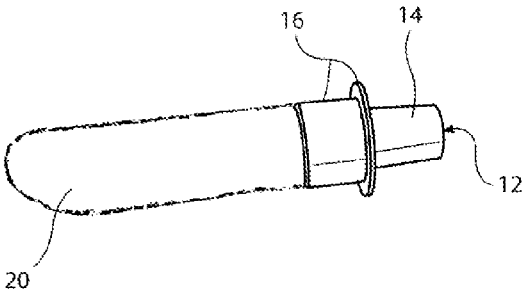

FIG. 112 shows a flocked lip gloss applicator embodiment.

Figure 113:
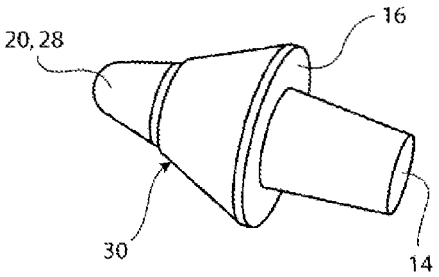
Figure 114:
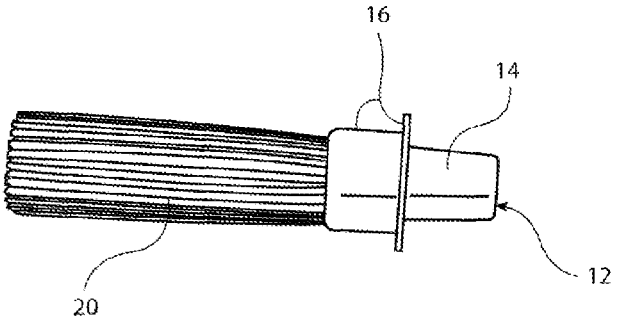

FIG. 113 shows a preloaded applicator having a socketed base to hold a suitably stable cosmetic material such as eye pencil FIG. 114 shows a bristled cosmetic brush applicator embodiment.

Figure 115:
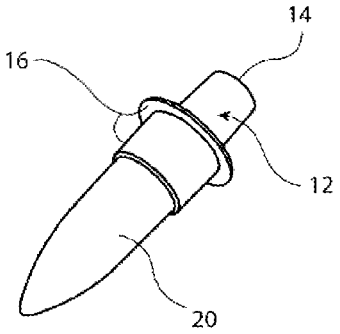

FIG. 115 shows a substantially conical eye liner applicator embodiment.

Figure 116:
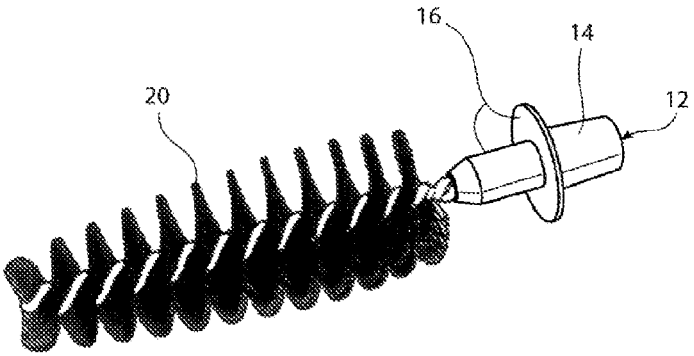

FIG. 116 shows a conventional mascara brush applicator embodiment.

Figure 117:
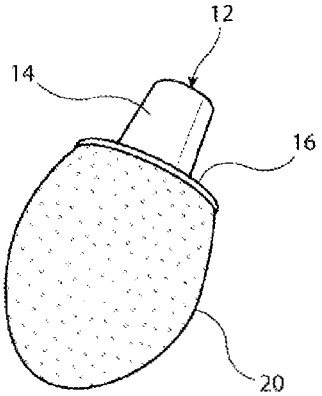

FIG. 117 shows a generally paddle shaped eye shadow applicator embodiment.

Figure 118A:
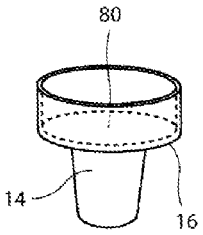
Figure 118B:
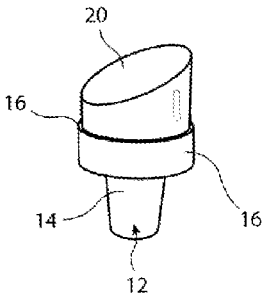

FIGS. 118A and 118B dimensionally show an inserting member that has a socketed, cup like base both with and without an applicating member.

Figure 119A:
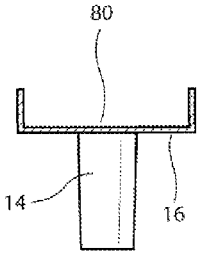

FIG. 119A an 119B show the side view of an inserting member that has a socketed, cup like base both with and without an applicating member.

Figure 120:
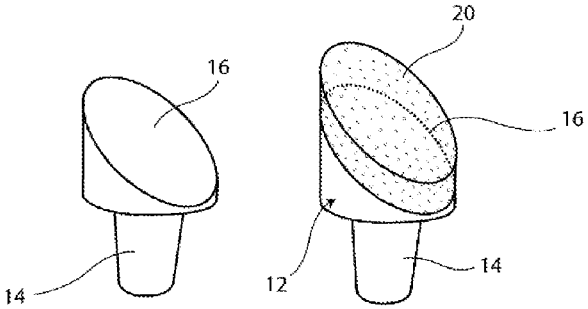

FIG. 120 shows two views of a wedge shaped applicator both with and without an applicating member.

Figure 121:
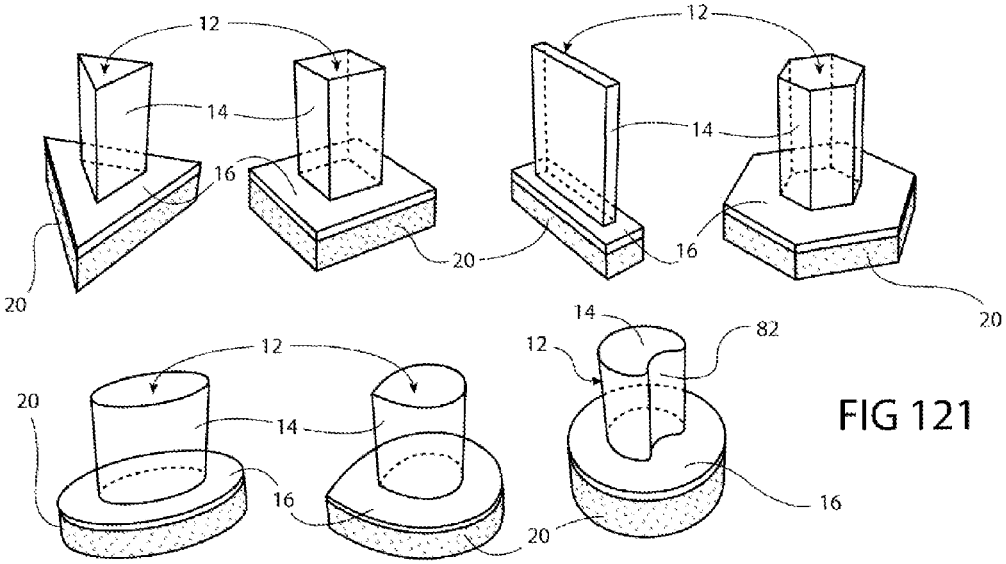

FIG. 121 shows a variety of applicator permutations having variously shaped inserting member's and base's.

Figure 122:
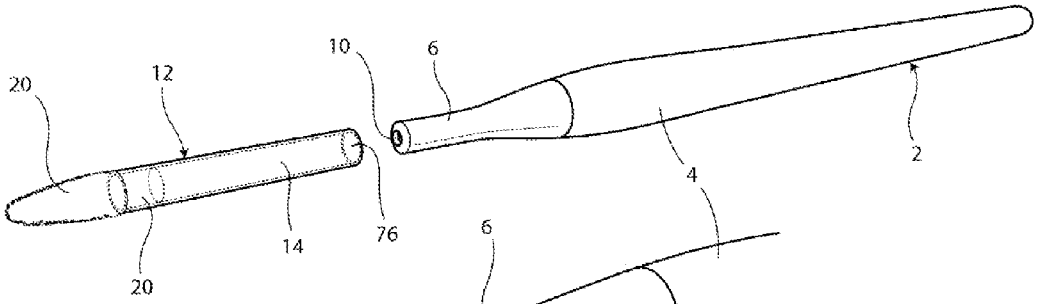

FIG. 122 shows a gripping body that has a tapered shaft with a terminally formed aperture for holding various applicators therein.

Figure 123:
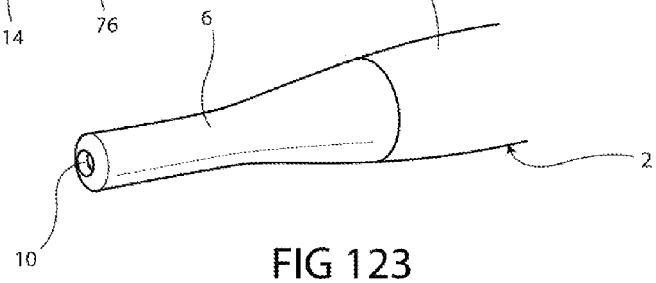
Figure 124:
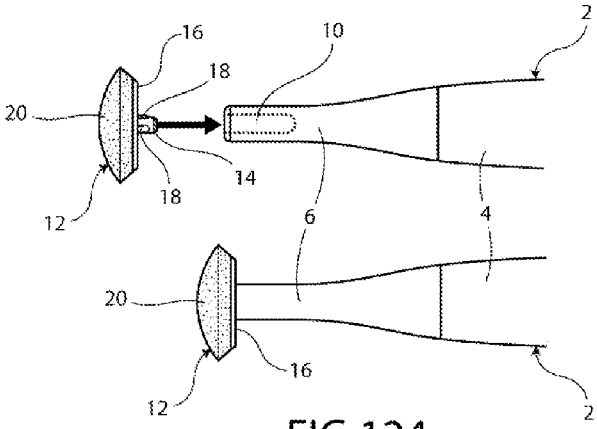

FIG. 123 shows a close up view of a shaft that has a terminally formed aperture into its end FIG. 124 shows a sequence depicting a prototypical applicator being inserted into a shaft's terminally formed aperture.

Figure 125:
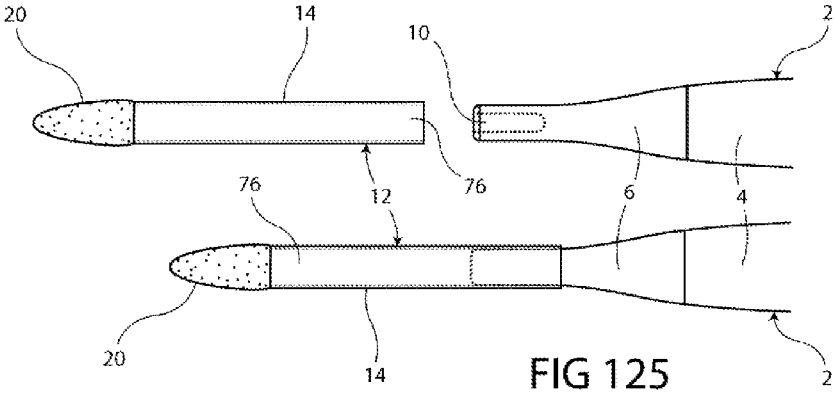

FIG. 125 Shows a sequence depicting an applicator having a tubular bodied inserting member being placed onto a shaft's tapered end.

Figure 126:
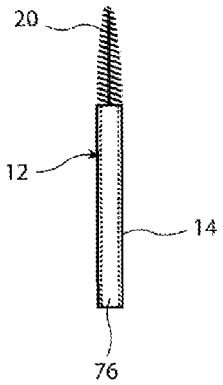

FIG. 126 shows a cosmetic applicator having a mascara brush applicating member attached to one end of a substantially elongated tubular body.

Figure 127:
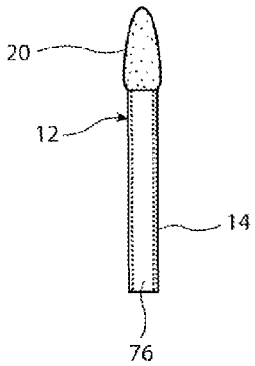

FIG. 127 shows a cosmetic applicator having a fiber tipped applicator attached to one end of a substantially elongated tubular body.

Figure 128:
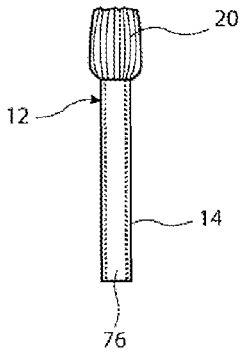

FIG. 128 shows a cosmetic applicator having a bristled brush attached to one end of a substantially elongated tubular body.

Figure 129:
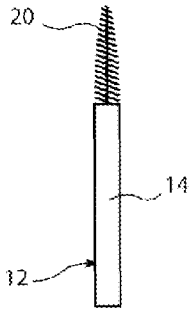

FIG. 129 shows a cosmetic applicator having a mascara brush attached to one end of substantially elongated inserting member.

Figure 130:
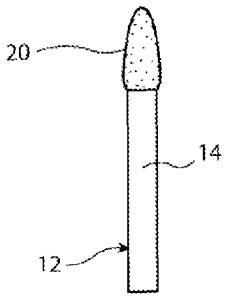

FIG. 130 shows a cosmetic applicator having fiber tipped applicating member attached to one end of substantially elongated inserting member.

Figure 131:
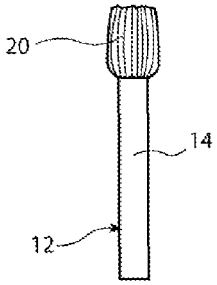

FIG. 131 shows a cosmetic applicator having a bristled brush attached to one end of substantially elongated inserting member.

Figure 132:
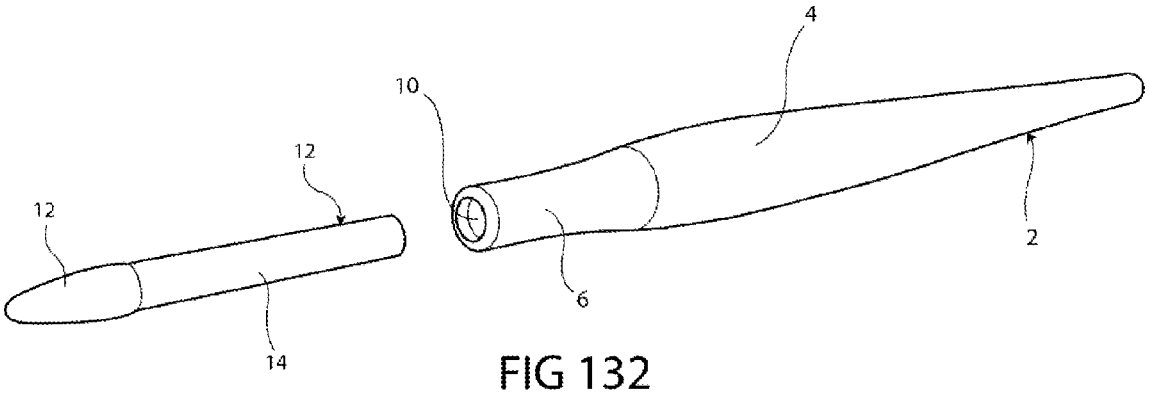

FIG. 132 shows a gripping body with a tapered shaft that has a substantially large aperture formed into its end so that it can hold conventionally sized disposable applicators therein.

Figure 133:
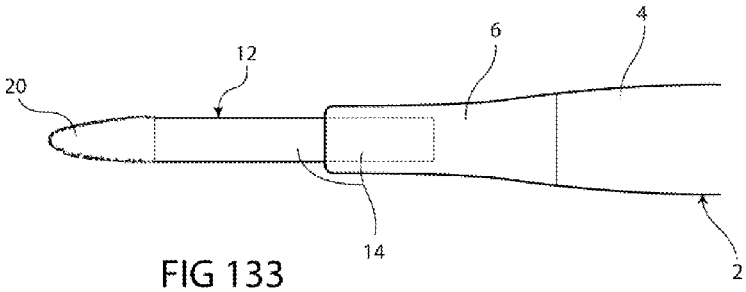

FIG. 133 Shows the side view of a tapered shaft that has a conventionally sized disposable applicator frictionally inserted within its terminally formed aperture.

Figure 134:
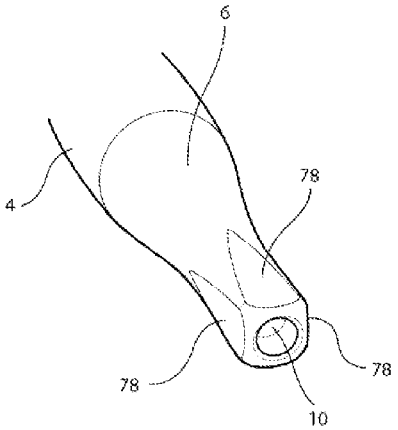

FIG. 134 shows a first dimensional view that depicts a generally cylindrical shaft having terminally trimmed surfaces to form distinctive sides or facets.

Figure 135:
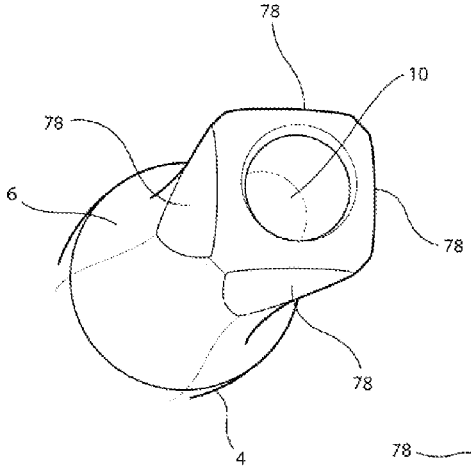

FIG. 135 shows a second dimensional view that depicts a generally cylindrical shaft having terminally trimmed surfaces to form distinctive sides or facets.

Figure 136:
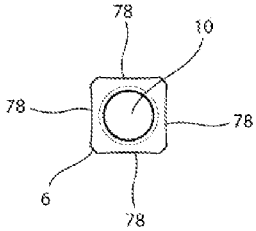

FIG. 136 Shows a plan view that reveals distinctive facets or sides that are formed by a shaft's terminally trimmed surfaces.

Figure 137:
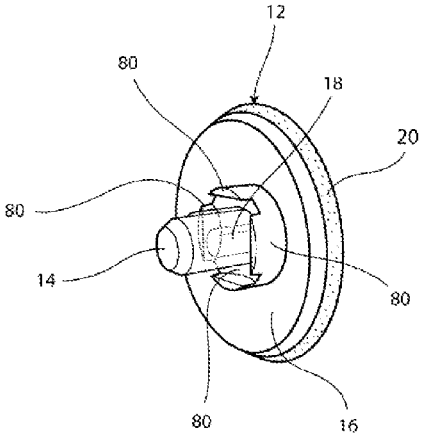

FIG. 137 dimensionally depicts an applicator that has a socket member formed onto its underside base area that is shaped to insertably communicate with a shaft's and/or ringlet's terminally trimmed surfaces.

Figure 138:
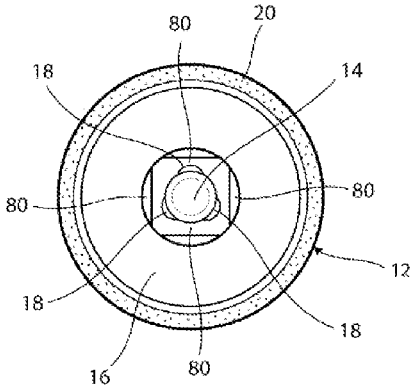

FIG. 138 shows an underside applicator plan view revealing a socket member that is shaped to insertably communicate with a shaft's and/or ringlet's terminally trimmed surfaces.

Figure 139A:
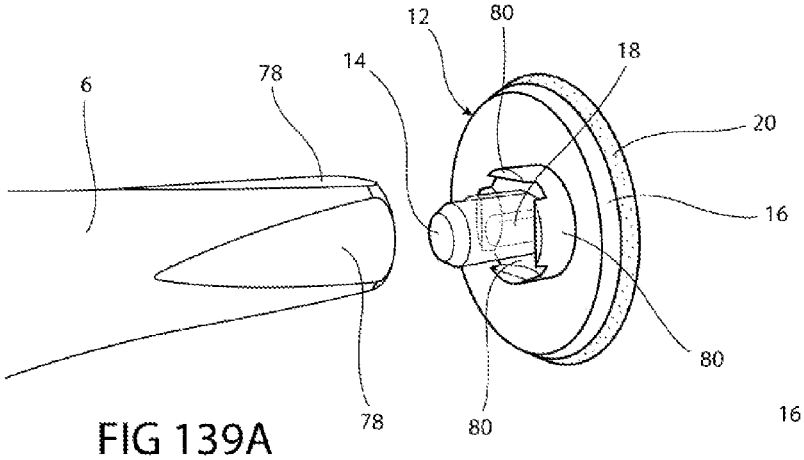
Figure 139B:
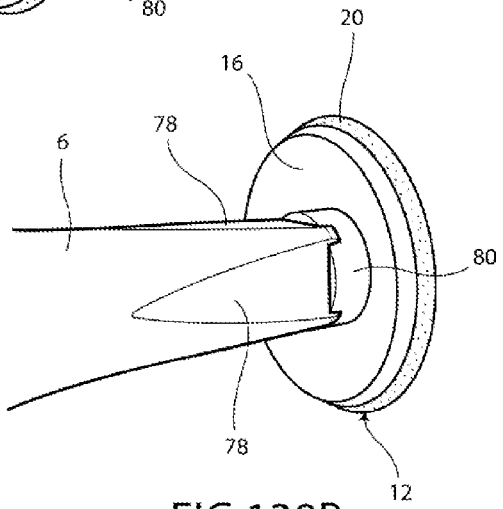

FIGS. 139A and 139B sequentially depict a shaft having a terminally trimmed surfaces, before and after it is inserted onto applicator that has a corresponding socket member.

Figure 140A:
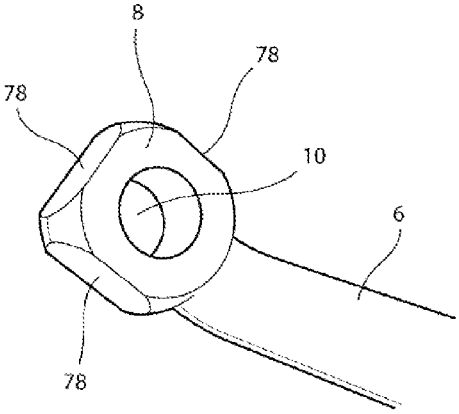
Figure 140B:
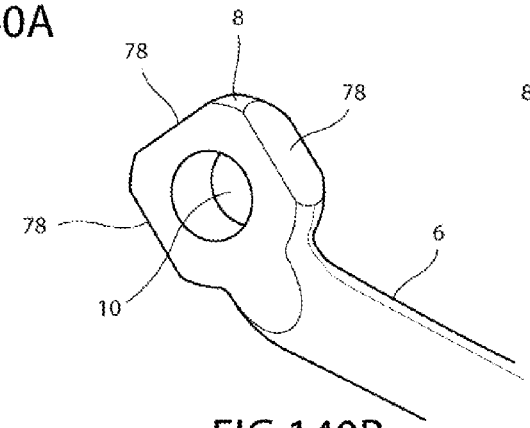

FIGS. 140A and 140B show a topside and underside dimensional view of a ringlet that has terminally trimmed surfaces that form faceted sides.

Figure 141:
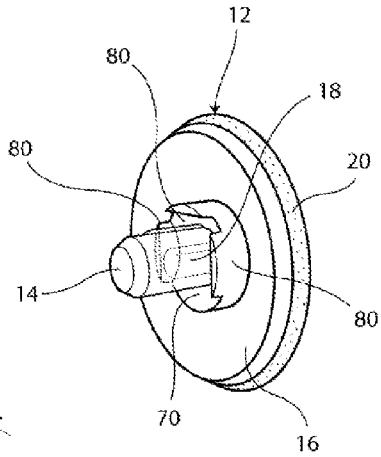

FIG. 141 shows a prototypical applicator that has a socket member formed around its inserting member's bottom area.

Figure 142:
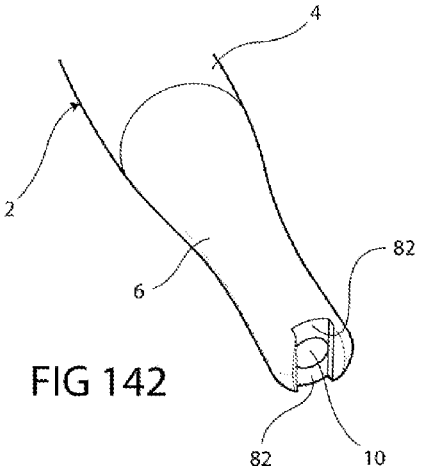

FIG. 142 dimensionally depicts a shaft that has a notch formed onto its end.

Figure 143:
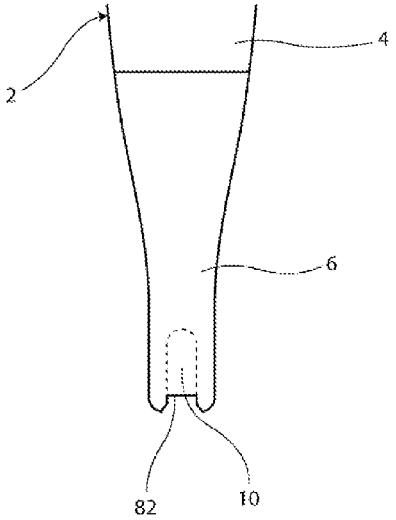

FIG. 143 shows a plan view of a shaft having a notch formed onto its end.

Figure 144:
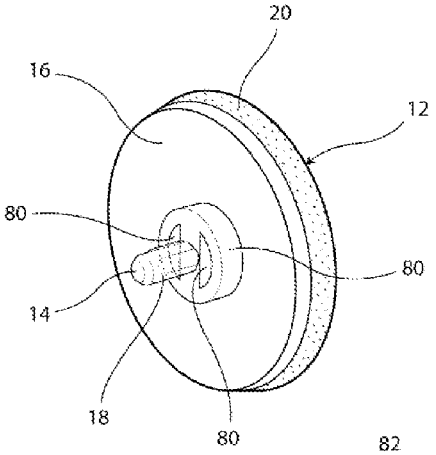

FIG. 144 dimensionally depicts a prototypical applicator that has a socket member formed onto its underside base area that is shaped to insertably communicate with a notched shaft end and/or ringlet.

Figure 145:
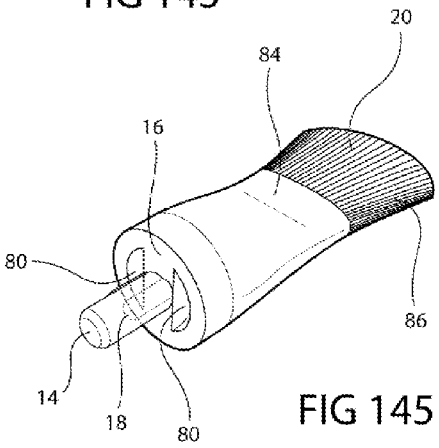

FIG. 145 dimensionally depicts a brush applicator that has a socket member formed onto its underside base area that is shaped to insertably communicate with a notched shaft end and/or ringlet.

Figure 146:
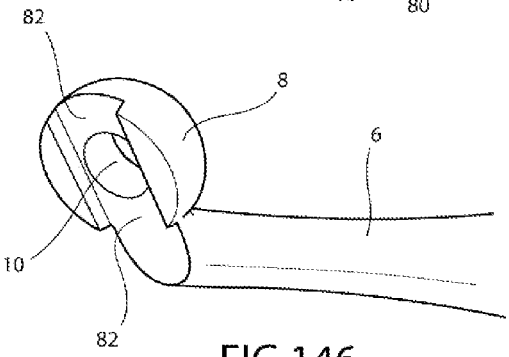

FIG. 146 shows a ringlet having notch that is formed across its flat bottom side.

Figure 147:
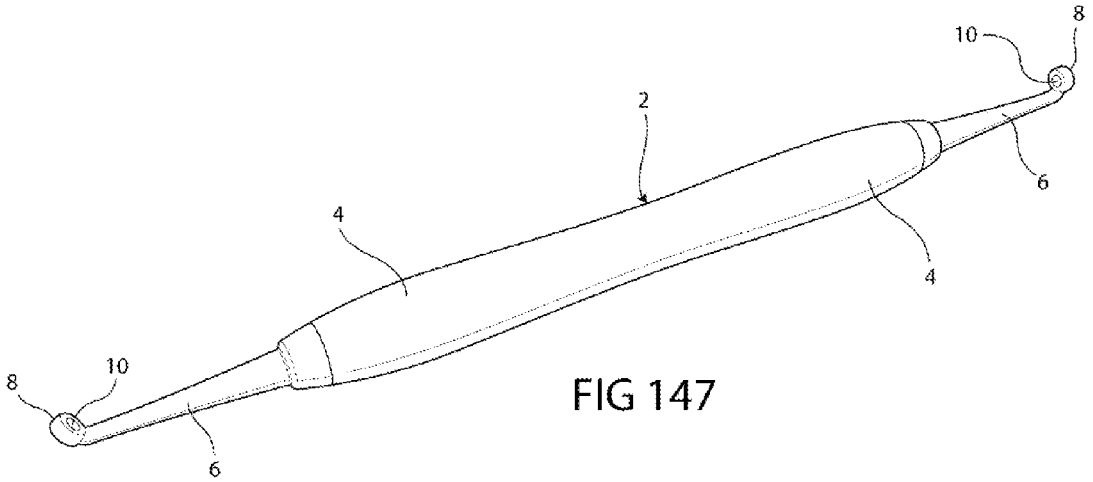
Figure 148:
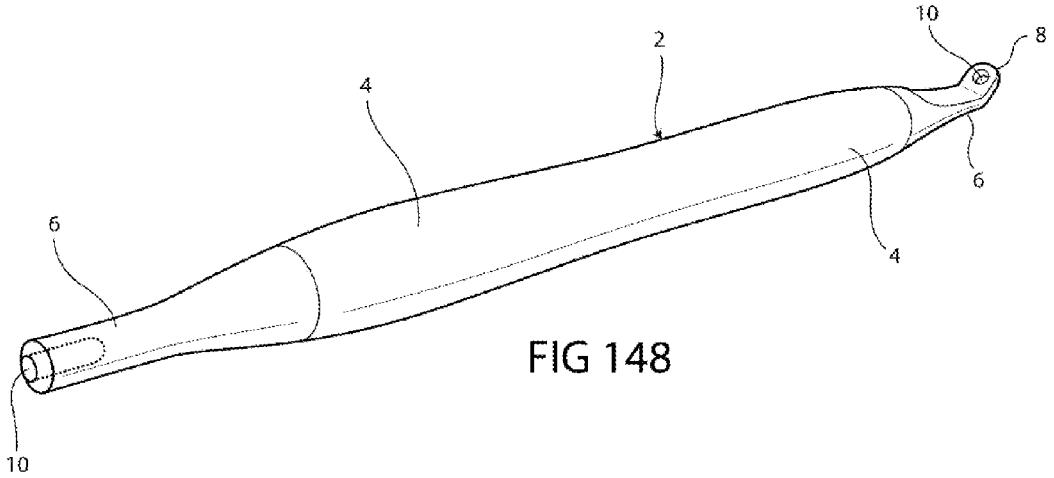

FIG. 147 show a double sided gripping body that has variably angled ringlets on either side FIG. 148 shows a double sided gripping body that has a ringlet on one side and an apertured shaft on the other.

Figure 149:
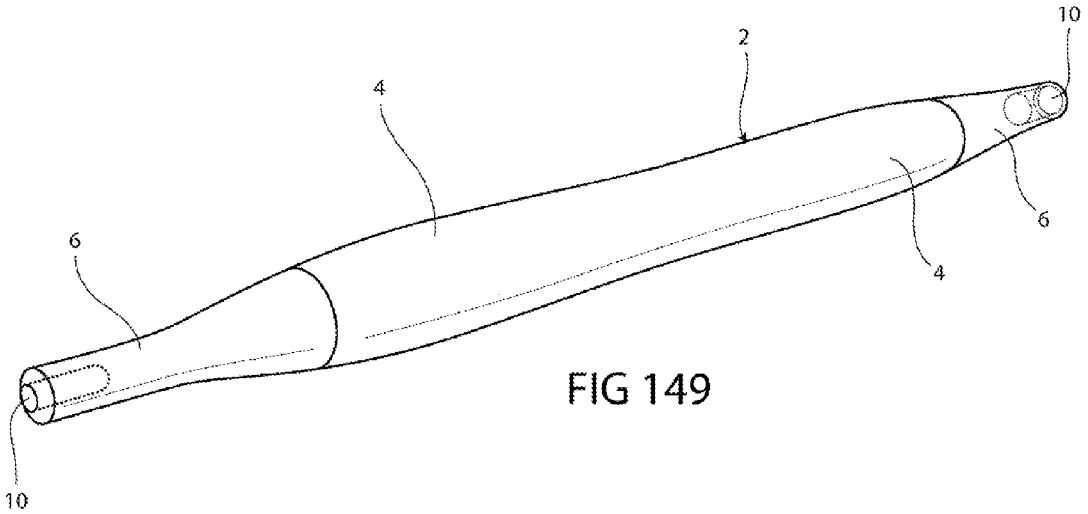

FIG. 149 shows a double sided gripping body with two apertured shafts, and each shaft has a different aperture size.

Figure 150:
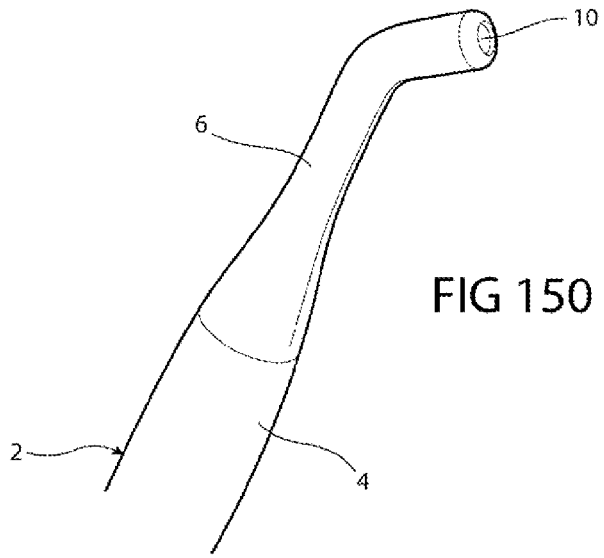

FIG. 150 shows a gripping body that has an apertured shaft that is bent or angled.

Figure 151:
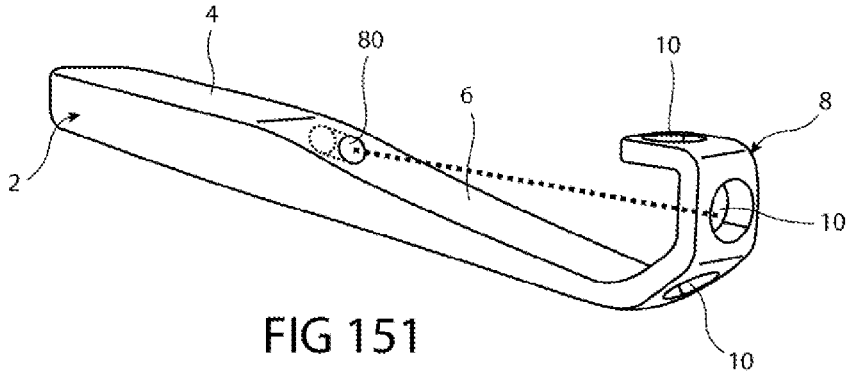
Figure 152:
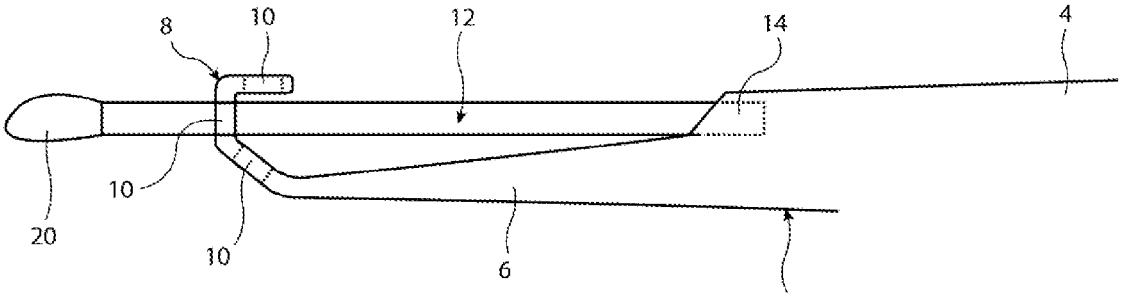

FIG. 151 shows a gripping body having three of variably angled ringlet apertures formed onto its end FIG. 152 shows the side view of a gripping body having two axially aligned apertures that are far enough apart to stably hold long shafted applicator that is inserted through the apertures.

Figure 153:
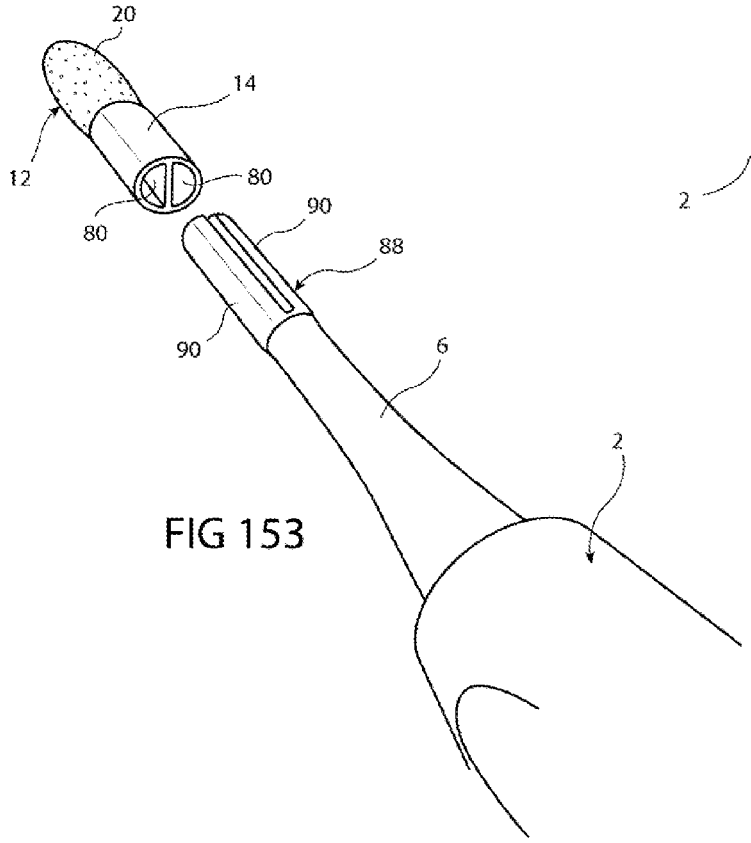

FIG. 153 shows a gripping body having a forked holder to conjoin with a corresponding applicator that has a bifurcated socket member.

Figure 154:
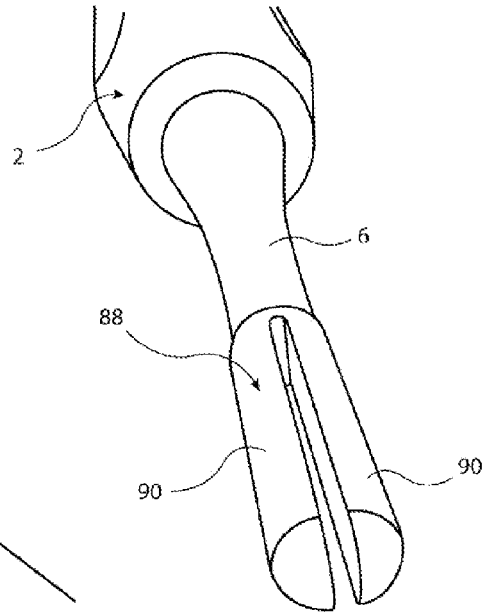

FIG. 154 shows a detail view of a fork holder and its tines.

Figure 155A:
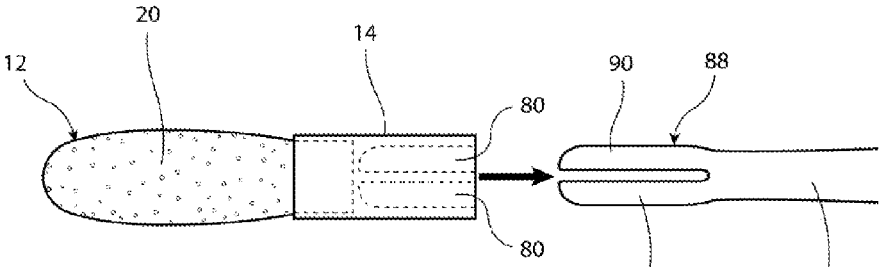

FIG. 155A shows an applicator having a bifurcated socket member before it is inserted onto a forked holder.

Figure 155B:
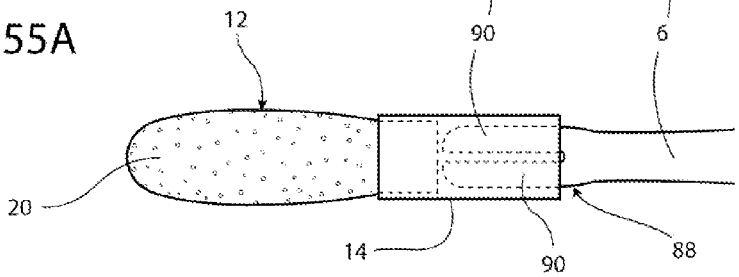

FIG. 155B shows an applicator with a bifurcated socket member inserted onto a forked holder.

Figure 156:
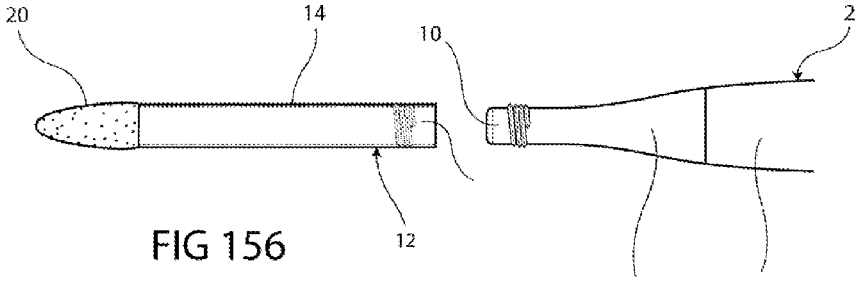

FIG. 156 shows a tapered and apertured shaft that has threading formed around its exterior to screw together with a corresponding tubular bodied applicator with internally formed threaded.

Figure 157:
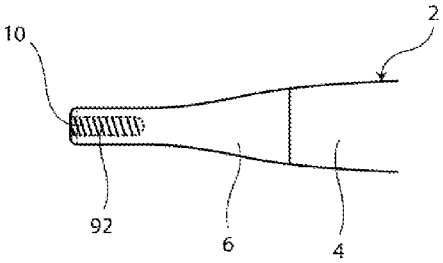

FIG. 157 depicts a shaft having an internally threaded aperture.

Figure 158:
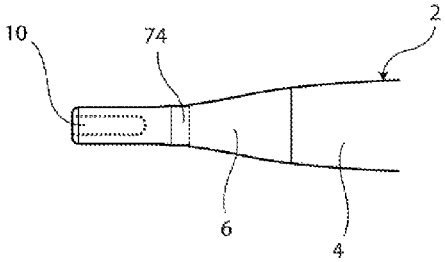

FIG. 158 shows a tapered shaft having a secondary taper to slightly widen its diameter in that area.

Figure 159:
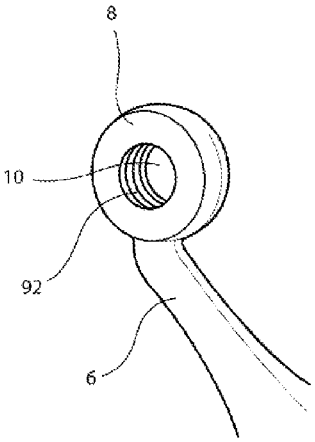

FIG. 159 Shows a ringlet having a threaded aperture.

Figure 160:
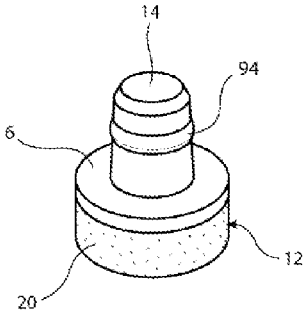

FIG. 160 shows an inserting member having a snapping ring formed around its circumference.

Figure 161:
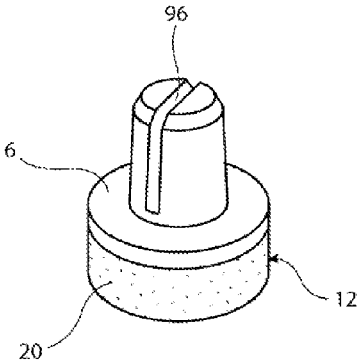

FIG. 161 shows an applicator that has a bifurcated inserting member.

DRAWINGS

Reference Numerals

2. Gripping Body
4. Handle
6. Shaft
8. Ringlet
10. Aperture
12. Applicator
14. Inserting Member
16. Base
18. Flute Extrusion
20. Applicating Member
22. Operator
24. Radial Motion
26. Surface
28. Cosmetic material
30. Preloaded applicator
32. Open cell foam
34. Closed cell foam
36. Container
38. Kit
40. Cosmetic Unidose
42. Card
44. Blister
46. Punch
48. Mirror
50. Cover
52. Tab
54. Perforation
56. Applicant
58 Cosmetic source
60. Orbital area
62. Lips
64. Face
66. Receptacle
68. Stop
70. Gap
72. Axis
74. Taper
76. Tubular body
78. Trimmed surface
80. Socket member
82. Notch
84. Ferrule
86. Bristles
88. Fork
90. Tine
92. Threading
94. Ring
96. Bifurcated inserting member

DETAILED DESCRIPTION

Preferred Embodiment—FIGS. 1-49

Figure 1:
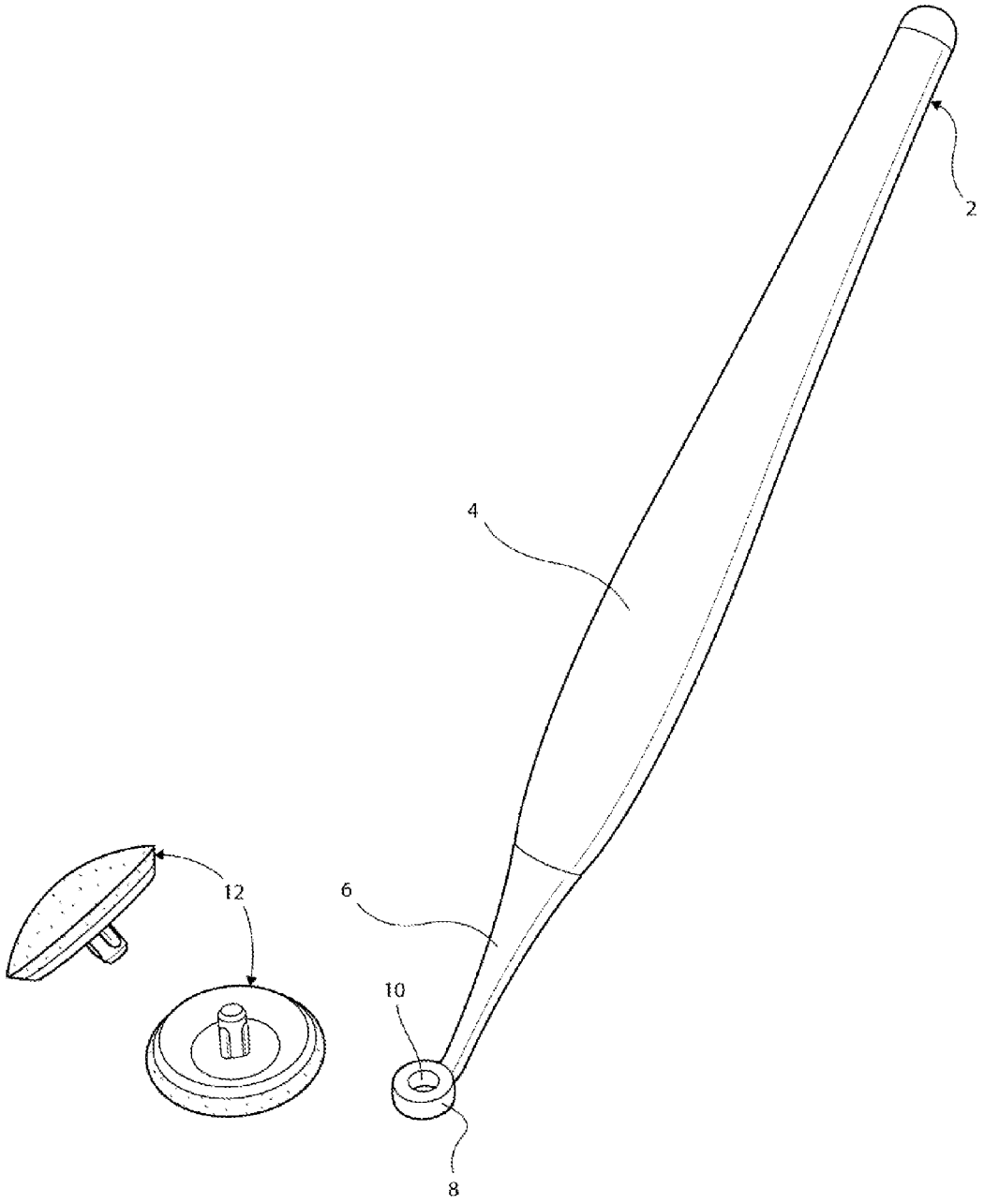
FIG. 1 depicts the hygienic applicator's gripping body along side of a prototypical cosmetic applicator.
Figure 2:
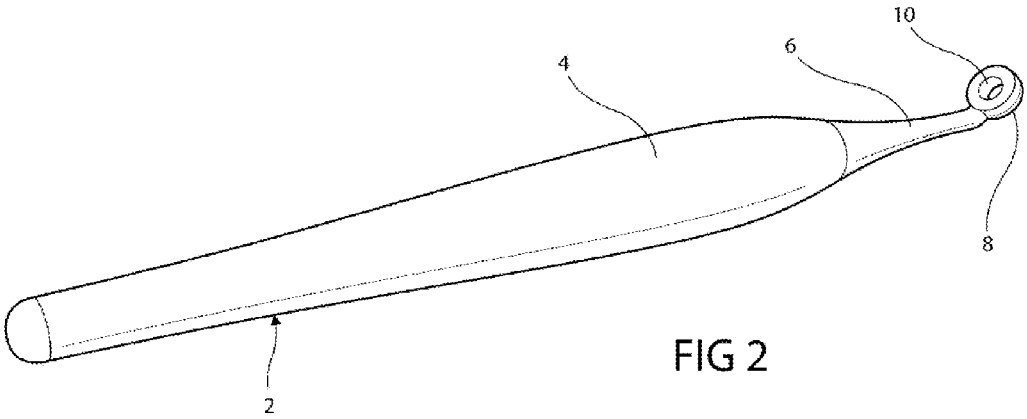
FIG. 2 shows a dimensional view of a gripping body to reveal its handle, shaft, and apertured ringlet.
Figure 3:
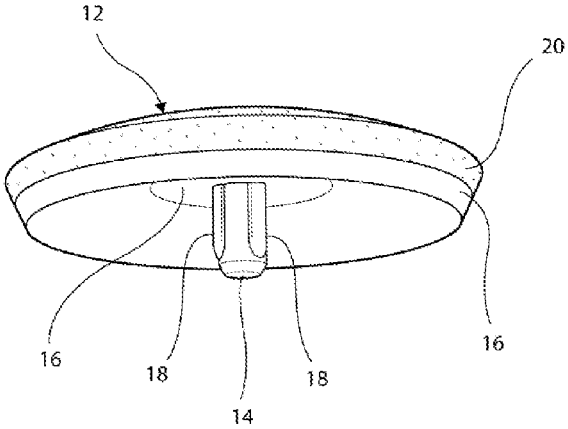
FIG. 3 shows an underside view of a typical cosmetic applicator.
Figure 4:
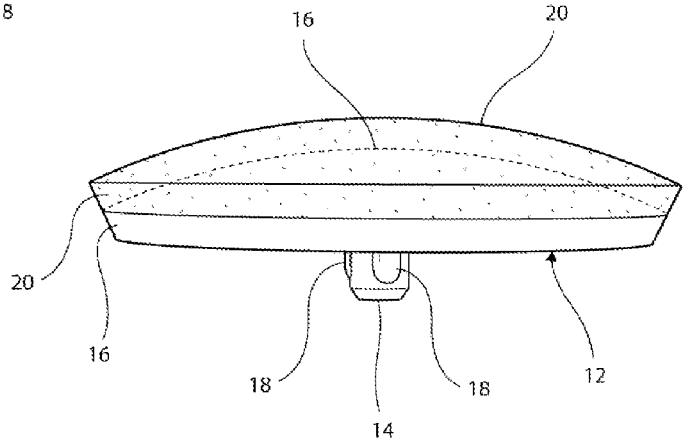
FIG. 4 shows a side/top side dimensional view of a typical applicator.

As shown in (FIG. 1), the hygienic cosmetic applicator is a two part system comprising an instrument-like gripping body (2) with a holder thereon to releasably grip a disposable applicator (12) tips. Generally speaking, a gripping body (2) has a handle (4) for grasping, a tapered shaft (6) emerging from on one end, and a ringlet (8) holder terminally emerging from thereof (FIG. 2). By contrast, an applicator (12) has a generally cylindrical inserting member (14) with a saucer-like base (16) formed onto one end and an applicating member (20) to hold and/or release a cosmetic material attached onto the base (16) (FIG. 3 and FIG. 4). The hygienic cosmetic applicator's fundamental mechanics are best depicted in (FIGS. 5A and 5B), where an applicator's (12) inserting member (14) frictionally plugs into a (2) ringlet's (8) aperture (10) to operably conjoin them, as seen in (FIGS. 6A and 6B).

The gripping body's (2) handle (4) is an elongated and generally cylindrical body that may be straight or ergonomically shaped for comfort (FIG. 2). It is preferably (but not limited to) 5 cm-12 cm long, and 5 mm-12 mm thick. The handle's (4) terminally formed shaft (6), as shown in (FIG. 7), originates from the handles gripping end. The shaft (6) is a generally cylindrical juncture that tapers substantially between its handle (4) origin and its ringlet (8) terminus. It is widest at its junction with the handle (4) and narrowest at its junction with the ringlet (8). Furthermore, it may comprise a separate member that is attached onto the handles (4) end (FIG. 8), or it may constitute a relatively long expanse if the handle (4) and shaft (6) are made from a single piece (FIG. 9) (In this case the junction between the handle and shaft may be determined by the end of the handles practical gripping area). In any event, the shaft (6) is preferably 15 mm-30 mm long. At its widest point (its juncture with the handle) it is preferably 4 mm-12 mm thick. At its narrowest point (its juncture with the ringlet), the shaft (6) is preferably 1 mm-4 mm thick.

The ringlet (8), as shown in (FIG. 10), emerges from the shaft's (6) narrow tapered end. As seen in (FIG. 11), it is a generally doughnut-shaped member that has a centrally formed aperture (10) there through. Furthermore, as depicted in (FIG. 12), the ringlet (8) is substantially angled at about fifty degrees at its juncture with the shaft (6). This is not limiting however, wherein a ringlet (8) may be variably angled from non-angled to ninety degrees (FIG. 13) or more. While the ringlet's (8) top side may be variably shaped, its bottom side is generally flat. Thus, when fully inserted onto an applicators (12) inserting member (14), its flat bottom will rest flush against the applicators (12) flat base (16) area. This is best shown in (FIGS. 14A and 14B), where a ringlet (12) is fully inserted onto an applicators inserting member (14) so that its bottom rests flush against the applicators (12) flat underside base (16) area. This is similarly shown in (FIGS. 15A and 15B), except the applicator (12) is inserted onto a ringlet (8) angled at ninety degrees.

Moreover, the ringlet's (8) overall height is less than an applicator's (12) inserting member (14). Thus, when fully conjoined as in (FIG. 5B), the inserting member's (14) upper end will extend above the ringlet's (8) top. This superfluous extension is enough to serve as an ejecting means for expelling an applicator (12) from the ringlet (8). This exemplified in (FIG. 16), where an operator (22) places a thumb on inserting members (14) exposed upper end, and then presses on the upper end to eject the applicator (12) from the ringlet's (8) aperture (10) (FIG. 17). Note, a ringlet (8) may be 4 mm wide, 1 mm thick, 1 mm-2 mm high, and have an aperture (10) that is about 2 mm in diameter. Alternatively, a ringlet (8) may be 3 mm wide, 1 mm thick, 1 mm-2 mm high, and have an aperture (10) that is about 1 mm in diameter. Alternatively, a ringlet (8) may be 5 mm wide, 1 to 2 mm high, 1 to 2 mm thick and have an aperture (10) that is about 3 mm in diameter. Nevertheless, these dimensions are merely examples of presently preferred ringlet sizes and are thus not limiting. A ringlet (8), therefore, may be variably sized and shaped to stably communicate with a desirably sized inserting member (14). Lastly, an aperture's (10) top and/or bottom openings may be suitably beveled to aid entry for an inserting member (14).

As seen in (FIGS. 3 and 4) an applicator (12) is a mushroom-like member having a generally cylindrical inserting member (14) that is stem-like and a terminally formed, saucer-like base (16) with an adherent applicating member (20) on top that is cap-like. The inserting member (14) is a generally cylindrical rod that has periodic fluting formed around its circumference. It is substantially elongated and emerges centrally from the base's (6) flat underside area (FIG. 18). Its top end is suitably beveled and its diameter (minus the fluting) is generally correspondent with, or slightly smaller than a ringlet's (8) aperture (10). Furthermore, its length is variable, wherein it is dependent upon a corresponding ringlet's (8) height. More specifically, a ringlet (8) with a shorter height (1 mm for example), will permit an applicator (12) to have a functionally shorter inserting member (14), whereas a taller ringlet (8) (2 mm for example) will require an applicator (12) to have a functionally longer inserting member (14). In any case, a presently preferred inserting member (14) length is between 3 mm-4 mm long.

The inserting member's (14) fluting, or fluted extrusions (18) are vertically elongated humps or bumps that are periodically formed around its circumference. As depicted in (FIG. 18), they originate at the inserting members (14) bottom (at its flat base juncture), and terminate a short distance below its beveled top. When seen in a plan view, as in (FIG. 19), the fluted extrusions (18) interrupt the inserting member's (14) general cylindricality. Furthermore, when encircled with a dotted line, as in (FIG. 20), the fluted extrusions (18) desirably increase the inserting member's (14) overall thickness at their periodic locations. Ultimately, this serves to intermittently thicken an inserting member's (14) diameter so that it is desirably wider than a corresponding aperture (10) at those locations.

This is best seen in (FIG. 21), a plan view overlay of an inserting member (14) and a ringlet (8). Prior to insertion, the fluted extrusions (18) are seen overlapping and extending beyond the aperture's (10) periphery. After insertion however, in (FIG. 22), the extrusions (22) deform and conform within the aperture (10) to generate retentive friction. Note, the size and number of fluted extrusions (18) can vary. For example, (FIGS. 23A, 23B) show an inserting member (14) that has three fluted extrusions (18) formed around its circumference, whereas (FIGS. 24A and 24B) show and inserting member (14) that has four fluted extrusions (18) formed around its circumference. These are merely examples however, and an inserting member (14) may have more or less fluted extrusions (18) than illustrated here. Note, a fluted extrusion (18) is preferably thick enough to periodically widen an inserting member's (14) overall diameter by 0.025 to 0.5 mm.

The applicator's (12) cap-like base (16) is terminally formed onto the inserting member's (14) end. Its topside is desirably convex and smooth for bonding with an applicating member (20). Its bottom side, by contrast, may be wholly flat, or partially concave with a flat center. For example, (FIG. 25) shows a cross section view of a smaller applicator (12) size that has a base (16) with a wholly flat underside. In contrast, (FIG. 26) shows the cross section of a larger applicator (12) size that has a generally concave underside with a flattened center area. In any case, a base's (16) flat underside area is platform-like, and it is wide enough to accommodate a corresponding ringlet (8). This can be seen in (FIG. 27), where a ringlet (8) is attached to a base (16) having a wholly flat underside, and (FIG. 28) where a ringlet (8) is attached to a base (16) having a generally concave underside with a flat center. This can also be seen in (FIG. 29) a plan view that employs a dotted circle to indicate the bases (16) flat underside area.

Note, an applicator's (12) base (16) size can vary substantially. This is due in part to the various requirements for cosmetic application. For example, larger dermal areas such as the face, cheeks, chin and forehead generally require larger applicators for efficient coverage, whereas smaller dermal areas such as the eyes or lips generally require smaller applicators. Therefore, a base (16) may have a diameter from that ranges from 2 mm to 40 mm or more and an applicator may have also have a general thickness of 0.5 mm to 1 mm. Moreover, a base (16) may have varying degrees of convexity. For example, a base's (16) convexity may range from nearly flat (FIG. 30), to substantially hemispherical (FIG. 31) to substantially ovoid (FIG. 32). Nevertheless, the degree of convexity should be sufficient to accommodate the natural radial motion (24) of an operator's (22) wrist. This is best exemplified in (FIGS. 33A, 33B, and 33C), a sequence that depicts how a convexly shaped applicator (12) contacts a surface during a radial brushing motion (24). As the operators (22) hand radially pivots at the wrist, the applicator's (12) convex surface maintains efficient contact with the surface.

An applicating member (20), as depicted in a (FIG. 34) detached view, is a pliant body of material that is bonded onto the bases (6) convex topside. It is generally cylindrical (FIG. 35) and has a first side to bond onto an inserting member's (14) base (16) and a second side that is intended to hold and/or release a cosmetic material (28) (FIG. 36). In the preferred embodiment, an applicating member (18) is preferably made from foam. Suitable foam types may either be open cell foam or closed cell foam. Furthermore, foam applicating members (20) may be blank, wherein they are devoid of cosmetic or, as pictured (FIG. 37), may have a pre-applied cosmetic material (28) to form a preloaded applicator (34). A preloaded applicator (34) is simply an applicator (12) that has an applicating member (20) that is or has been impregnated with a cosmetic material (28) during manufacture.

The manner for preloading an applicator (34) depends upon the foam type. For example, (FIG. 38) shows a cellular detail view of an open cell foam member that is preloaded by saturating its cells with a cosmetic material (28). By contrast, (FIG. 39) shows a cellular detail view of a close cell foam member that is preloaded by depositing a cosmetic material (28) onto its closed celled exterior. Preloading an applicator (12) may be accomplished by rubbing, spraying, dipping, molding, bonding, coating, immersing, compressing, soaking, laminating, inserting, or adhering. Suitable cosmetic types for preloading include but are not limited to: primer, lipstick, lip gloss, lip liner, lip plumper, lip balm, concealer, foundation, face powder, bronzer, mascara, eye shadow, eyeliner, eyebrow wax, gel, powder, cream, pencil, nail polish, and cosmetic removing agent. Suitable cosmetic forms for preloading may include: solutions, creams, emulsions, lotions, ointments, pastes, suspensions, powders, gels and solids.

Foam types for applicating members (20) are desirably non-toxic, environmentally compatible, highly absorbent (can expand up to 1½ times dry size for example), odorless and do not contain latex. Furthermore, they are compatible with cream, liquid, powdered and solid cosmetics. Also, they are capable of carrying and releasing liquid or solid additives including any applicable cosmetic material, cream, moisturizer, balm, exfoliant, fragrance and cosmetic removing agent. Some open cell foam types include but are not limited to flexible polyester polyurethane foam and flexible hydrophilic polyurethane foam. Suitable closed cell foam types are similarly non-toxic, environmentally compatible, and odorless, but, due to their cellular structure, are not absorbent. Therefore, they are particularly suitable for surface impregnation or surface layering with cosmetic solids and waxes, rather than pastes, creams or liquids. Some closed cell foam types may include but are not limited to polyethylene foam or a co-polymer such ethylene vinyl acetate (EVA) foam. Lastly, foam stock for fabricating applicating members may have additional layers or coatings. For example, foam for use may be flocked, laminated with fabrics or have a woven nap.

Regarding materials for manufacture, a gripping body's (2) handle (4) and/or shaft (6) may be made from metal, resin, fiber glass, wood or any combination thereof. Processes for manufacture may include machining, casting, welding, 3-D printing, or die stamping. Suitable metal types for fabrication may include but are not limited to stainless steel, brass, bronze, aluminum, titanium or any other suitable metal type. Furthermore, metal parts may have chrome, rhodium, palladium or gold plating. Plastic or resin may parts be formed by injection molding, machining, cutting, 3-D printing or other suitable thermoforming process. Suitable resin types for fabrication may include but are not limited to nylon, ABS, acrylic, vinyl, polyethylene, EVA polyvinyl carbonate, polypropylene, and polyurethane. Lastly, a gripping body (2) may be fabricated as a single piece or from an assembly of parts and furthermore, may have an elastomeric grip or a series of elastomeric gripping portions formed onto on its handle (4).

An inserting member (14) and its terminally formed base (16) may be fabricated from metal or resin. Metal inserting members (14) may be cast, machined, stamped or punched (from sheet metal) into shape. However, for cost, disposability, and superior operability, resin is the preferred material for fabrication. Therefore, suitable resins for fabricating inserting members (14) may include but are not limited to: nylon, ABS, acrylic, vinyl, polyethylene, EVA, polypropylene, polyvinyl carbonate, polyurethane or other suitable resinous material. They may be formed by injection molding, thermoforming sheets, stamping, 3-D printing or other suitable processes.

There a number of relevant packaging formants for the hygienic cosmetic applicator. A first packaging format, seen in (FIGS. 40A and 40B), shows a plurality of applicators (12) packaged into a hinged plastic container that may be opened and closed repeatedly as needed. A second packaging format seen in (FIG. 41) shows a gripping body (2) and a number of blank applicators (12) integrated into a typical cosmetic kit (30). Notably, the kit's (30) various cosmetic types each has its own applicator (12) tip proximally embedded into a receptacle. Thus, an operator (22) can selectively undock an applicator (12), apply a proximal cosmetic type, and then re-dock the applicator (12) after use. This manner of operation can ensure that the kits (30) various cosmetic types will not cross contaminate during its span of operation. A third packaging format, as seen in (FIG. 42) shows a gripping body (2) and a number of applicators (12) packaged in tandem with blister (44) packed cosmetic unidose (40) samples. These are then blister packaged together onto a card (42) backing. This format may optionally include a mirror (48) and a punch (46) hole for retail hangers.

There are also a number of packaging formats for preloaded applicators (30). For example, (FIG. 43) shows a dimensional see through package view of a preloaded applicator (30) that is sealed into a blister (44) cavity. When seen in (FIG. 44), a side cutaway package view, the applicator (30) is seated into a suitably sized blister (44) cavity that has a sealing a cover (50) and a tab (52) portion for removal. Similarly, (FIG. 45) shows a plurality of preloaded applicators (30) are individually sealed into blister (44) modules that are in turn, separably attached by a series of scorings or perforations (54). When seen in a side cutaway package view, as in (FIG. 46), the preloaded applicators (30) are seen individually seated in suitably sized blister (44) cavities that each have a cover (50) with a removing tab (52) portion. Furthermore, as depicted (FIG. 47A and FIG. 47B) an operator (22) can grasp a cover's (50) tab (52) to peel the cover (52) and expose a preloaded applicator (30) for use.

Alternatively, blank applicators (12) (that are devoid of cosmetic) or preloaded applicators (30) (that are impregnated with cosmetic) may be sealed into blister (44) cavities having cosmetic materials (28) deposited into their bottoms. For example (FIG. 48), a dimensional see through package view, shows an applicator (12) that is sealed within a blister (44) cavity that has a bedding of cosmetic material (28) in its bottom. When viewed in (FIG. 44), a side cutaway package view, the applicator (30) is seen seated on top of the embedded cosmetic material (28). Note, the amount of cosmetic material for embedding may be a comprise a cosmetic unidose (40) that is intended for a single application, or a cosmetic multi-dosage that is intended for more than one application. Furthermore, covers (50) for any of the aforementioned packaging formats may have suitable adhesive thereon for resealing.

Operation—FIGS. 16, 17, 50-60

Applying cosmetics with the hygienic cosmetic applicator is mostly conventional. Namely, an operator (22) must first determine a dermal area application, secondly select a suitable cosmetic type, and thirdly choose an appropriate applicator (12) size to apply it. If an operator (22) is applying a cosmetic to a larger dermal surface such as the cheeks, forehead or chin, a larger applicator (12) size should be selected. Conversely, if applying a cosmetic to a smaller dermal surface such as the eyes or lips, a smaller applicator (12) size should be selected.

After selecting a proper applicator (12) size, the operator (22) can use their fingers (FIG. 50) or other device such as a tweezers (not shown) to place it onto a flat surface. When placing the applicator (12) onto the surface, the operator (22) should orient it so that its applicating member (20) side faces down and its inserting member (14) side faces up (FIG. 51). Next, the operator should grasp the gripping body (2) by its handle (4) and vertically align its ringlet (8) over the inserting member (14) (FIG. 52). Next, the operator (22) should direct the ringlet (8) downwards and engage the inserting member (14) into its aperture (10). Next, pressing gently, the operator (22) should slide the ringlet down the inserting member's length until its bottom is flush with the flattened base area (16) (FIG. 53). When the ringlet is flush against the base (16), a portion of the inserting members (14) upper end will extend above its top (FIG. 20).

Note, there is alternative method for inserting an applicator (12) into the ringlet (8) using the fingers. To accomplish this, an operator (22) should first grip an applicator (12) by its base (16) rim and second, align its inserting member (14) with the ringlet's (8) aperture (10) (FIG. 54). Next, the operator (22) should engage the inserting member (14) into the aperture (10) and then use gentle pressure to slide the ringlet (8) down the inserting member's (14) length, until it's bottom is flush with the base (16) (FIG. 55). Again, when the ringlet (8) is flush, a portion of the inserting members (14) upper end will extend above its top. This signals that insertion is complete.

Now that the gripping body (2) and applicator are operably conjoined, the operator (22) can impregnate the applicating member (16) with cosmetic. First, the operator (22) should dip the applicating member (20) into an appropriate cosmetic source (58) and then directionally swipe it around to load its surface with the cosmetic material (28) (FIG. 56). After loading, the operator (22) can begin dermal application onto an applicant (56). If applying a cosmetic material to an applicant's (56) orbital area (60), the operator (22) can desirably swipe the applicating member (20) over the applicants (56) orbit region (FIG. 57). If applying a cosmetic material (28) to an applicant's (56) lips (62), the operator (22) can desirably sweep the cosmetically loaded applicating member (20) across the lip area (FIG. 58). If applying a cosmetic material (28) to an applicant's (56) a face (64) area (such as the cheeks, forehead nose or chin region), the operator (22) can desirably sweep the applicating member (20) over the face area (FIG. 59).

Note, there is an operational alternative for applying a cosmetic if an applicator (12) is preloaded with a cosmetic material (28). A preloaded applicator (30) is ready for use, wherein it has had cosmetic material pre-applied during manufacture. This pre-application obviates the operational need for manually swiping an applicating member (20) in cosmetic to load it. In this case, an operator (22) simply needs to insert a preloaded applicator (30) into a gripping body's (2) ringlet (8) aperture (10) and then apply the pre-applied cosmetic material onto a dermal surface.

After the cosmetic application is complete, the operator (22) should remove the used applicator (12) from the ringlet (8). To do this, the operator (2) should firmly grip the handle (4) and then place a finger, thumb, or other object onto the exposed inserting member's (14) end (FIG. 16). Next, applying sufficient pressure, the operator (22) should expel the applicator (12) from the ringlet's (8) aperture (10) (FIG. 17). After expulsion, used applicators (12) should be disposed of into a suitable receptacle (66) (FIG. 60).

Alternative Embodiments FIGS. 61*a* to 161

Due to the highly varied nature for applying cosmetics, there are substantial possibilities with regard to applicator (12) and gripping body (2) functionality.

For example, FIGS. 61A to 61C show an applicator (12) that is substantially flat, wherein it lacks the convexity of the preferred embodiment. In this embodiment, the inserting member's (14) terminally formed base (16) is disc-like and has a wholly flat surface to bond with an applicating member. The applicating member (20), is generally cylindrical and, by virtue of the base's flat bonding surface, retains a flat topside when it is bonded onto the base (16). This is clearly seen in (FIG. 61A), a bottom side dimensional view, (FIG. 61B) a topside dimensional view and (FIG. 61C) and a side view, where the applicators (12) base (16) and adherent applicating member (12) are flat.

(FIG. 62) shows a three-quarter dimensional view of an applicator (12) that has a set of bilaterally raised extrusions or stops (68) formed on its underside base (6) area. Generally speaking, a stop (68) is a raised bump or extrusion that has a channel, space, or gap (70) formed there through or alternatively, a set of bilaterally raised extrusions having a suitably large gap (70), in-between. A stop's (68) bilateral extrusions are high enough and its gap (70) is wide enough to sandwich a shafts (16) tapered end when it is inserted therein. This is best viewed in (FIG. 63), a dimensional view that depicts a shaft's (6) tapered end sandwiched in-between a stop's (68) bilateral extrusions. Moreover, when seen from the top in (FIG. 64), the stop (68) is positioned within proximity to applicators (12) inserting member (14). This proximity is sufficient so that the stop's (68) gap (70) can insertably communicate with a shafts tapered end (FIG. 65). Thus, when a ringlet (8) is fully inserted onto the applicators (12) inserting member (14), as seen in (FIG. 66), the shafts (6) end will enter the gap (70) and sandwich in-between the stops (68) bilateral extrusions.

(FIG. 67), by contrast, exhibits an applicator (12) having a plurality of stops (68) that are radially distributed around its underside base (16). Similarly, as seen in (FIG. 68), the gaps (70) in-between the stops (68) are sufficiently wide to accommodate and sandwich a shaft's (6) tapered end when the ringlet (8) is fully inserted onto an inserting member (14). Furthermore, as viewed in (FIGS. 67 and 68), the stops (68) have visibly tapered tops. When seen from an underside view in (FIG. 69), the radial distribution of the stops (68) is at regular intervals and when seen from the side, (FIG. 70) the stops (68) are at least as high as the corresponding ringlets (8) top.

(FIG. 71), a dimensional view, shows an applicator (12) that has a generally cylindrical inserting member (14) that is non-fluted. Instead, the inserting member (14) of this embodiment has a tapered body. This can be seen from the side in (FIG. 72), where a set dotted vertical lines reveals a gentle taper that widens from its top to its bottom. Moreover, as seen in (FIG. 73A and FIG. 73B), the inserting member's (14) taper is enough to frictionally insert and retain within a ringlet's (8) aperture (10).

While the applicator (12) of the preferred embodiment is generally round and symmetrically convex, the following applicator (12) embodiments are asymmetrically convex and variably curved. The basis for their varying curvatures is determined firstly by the shape of applicating member (20) and secondly, by the degree of convexity that can occur along one, two, or three axes. For the following examples, a round applicating member shape is assumed. Thus, (FIG. 74A) shows a round applicating member (20) shape projected onto a curved surface to form the basis for an applicator's (12) base (16) that is curved along one axis (FIG. 74B). By contrast, (FIG. 75A) shows a round applicating member (20) shape projected onto a curved surface to form the basis for applicator's (12) base (16) that is curved along two axes (FIG. 75B). Lastly, (FIG. 76A) shows a round applicating member (20) shape projected onto a curved surface to form the basis for an applicator's (12) base (16) that is curved along three axes. (FIG. 76B).

(FIG. 77), dimensionally depicts an applicator (12) embodiment that has a substantially u-shaped base (16). This taco shell-like base (16) has and outer or top side for bonding with an applicating member (20), an underside having a centrally raised flat portion, and an inserting member (14) terminally emerging from raised portion's flat top. When viewed dimensionally in (FIG. 78), the base's (16) flat underside is substantially stage-like. Moreover, when viewed from the top, in (FIG. 79), this flat underside is generally cylindrical and is sized to correspond with a ringlet's (8) overall width. Note, the base's (16) flat underside function is twofold. Firstly, it desirably elevates the inserting member (14) so that a ringlet (8) can fit inside of the base (16) and secondly, its flat top provides a flush surface for a ringlet's (8) bottom. This is best seen in (FIG. 80) where the applicator's (12) taco-like base substantially curves (16) to nest the raised flat underside, and in (FIG. 81), where the platform's elevation provides critical clearance and a flat surface for the ringlet's (8) bottom. Note, the base (16) in this embodiment is curved along a single axis, and therefore has straight a straight top when seen from the side (FIG. 82)

(FIG. 83) by contrast, depicts an applicator (12) having a shell-like base (16) that is curved along more than one axis. As seen in (FIG. 84), this applicator (12) embodiment has a flat circular underside base (16) portion that is substantially flush with the base's (16) overall bottom and furthermore, has an inserting member (14) emerging from its flat underside's center. Note, the applicator's (12) multi-axis curvature is indicated by dotted axis (70) lines that are revealed in several views. For example, (FIG. 85) shows a side view that exhibits a distinct curvature along a first axis (72), while (FIG. 86) shows a profile view that exhibits a distinct curvature along a second axis (72), and (FIG. 87) shows an underside view that exhibits a distinct curvature along a third axis (72).

Note, since the base's (16) flat underside is substantially flush with its overall bottom, the applicator (12) may be selectively turned when it is inserted into a ringlet (8). This is possible firstly because the flat underside area is positioned outside of the shell-like base's (16) interior area and is thus unimpeded. Secondly, the inserting member (14) is generally cylindrical and thus permits the applicator (12) to be freely rotated within the ringlet (8). This is clearly depicted in (FIGS. 88A, 88B, and 88C) where an applicator (12) is selectively turned so that it has a vertical orientation within the ringlet (8) and in (FIGS. 89A, 89B, and 89C) where the applicator (12) is selectively turned to have a horizontal orientation within the ringlet (8).

(FIG. 90) shows a dimensional view of a shell-like applicator (12) embodiment that has a substantially contra-angled underside base (16) area. This underside base (16) area is a raised and platform-like member that is angled to one side (FIG. 91). Furthermore, this platform like member has a flat top with an inserting member (14) centrally emerging from thereof. The bases (16) contra angled underside is most clearly depicted in (FIG. 92), a see through side view, that reveals the platform-like member's flat top and inserting member (14). Further views showing the bases (16) contra angled underside are seen in (FIG. 93), a profile view and in (FIG. 94) a bottom plan view.

The contra-angle of this embodiment is such that it counters or overrides a corresponding ringlet's (8) fixed angle to allow for multiple applicator (12) orientations within the same ringlet (8). This is seen in (FIG. 95) where a contra-angled applicator (12) is inserted into a ringlet (8) that is angled at forty five degrees and in (FIG. 96) where the same contra-angled applicator (12) is turned around and re-inserted into the same ringlet (8). More specifically, the applicator (12) in (FIG. 95) is inserted into the ringlet (8) so that it overrides the it's 45 degree angle to permit a substantially horizontal orientation within the ringlet (8). Simply turning the same applicator (12) around and reinserting it, as seen in (FIG. 96), overrides the ringlets (8) 45 degree orientation to permit a substantially vertical orientation within the ringlet (8). This contrasts with the fixed and static orientation potential of a standard (non contra angled) applicator. As seen in (FIG. 97) a standard applicator (12) permits only one orientation within a ringlet (8) and that orientation is wholly contingent upon the corresponding ringlets (8) angle.

(FIG. 98) depicts a taco-like applicator (12) embodiment that has a bilaterally formed stop (68) on one half of its inner base (16) area. When seen from the top in (FIG. 99), the bilateral stop (68) is formed so that there is a suitably wide gap (70) in-between. This resultant gap (70) can be clearly seen in (FIG. 100) a profile view. Moreover, the stops (68) bilateral extrusions and resultant gap (70) are positioned within proximity to applicators (12) inserting member (14). This proximal positioning is sufficient, so that the stop's (68) gap (70) can insertably correlate with a shafts (6) tapered end. Thus, when a ringlet (8) is fully inserted onto an inserting member (14), as seen in (FIG. 101), the shafts (6) end will insert into the gap and sandwich in-between the stops (68) extrusions (FIG. 102). Similarly, (FIGS. 103 and 104) show a related applicator (12) embodiment that has bilateral stops (68) formed on both halves of its inner base (16) area.

(FIG. 105), in contrast shows a taco-like applicator (12) embodiment having stops (68) with substantially beveled or tapered (74) upper ends. When seen in profile, (FIG. 106), the stops (68) taper (74) portions are sloped to desirably widen the opening into the stops (68) gap (70) area.

(FIG. 107) depicts partially conical applicator (12) that has a flat bottomed base (16) portion with an inserting member (14) centrally emerging from thereof. When seen in (FIG. 108), a side view, the applicators (12) conically shaped base (16) and adherent applicating member (20) is substantially pointed and furthermore, has a distinctively curved or contoured profile. The bases (16) partially conical shape is depicted (FIG. 109), a three quarter posterior view that reveals the base's (16) incomplete conical backside. When seen from the top in FIG. 110, the partially conical base (16) and applicating member (20) exhibit a substantially curved profile. When seen from the bottom in (FIG. 111), the bases (16) flat circular underside and centrally formed inserting member (14) is revealed.

(FIG. 112) shows a lip gloss cosmetic applicator (12) having an inserting member (14) with a generally cylindrical terminating base (16) having a socket member (80) formed therein to hold a substantially elongated applicating member (20). An applicating member (20) for this embodiment may be made from foam, a fibrous material or a suitable base material that is flocked (FIG. 113) shows an eye pencil preloaded applicator (30) having an inserting member (14) with a cone shaped base (16) that has a socket member (80) formed into its top to hold a suitably solid cosmetic. An applicating member (20) for this embodiment may be made from a unidose of cosmetic material (28) such as eye liner pencil, eye brow pencil or any other suitably solid cosmetic.

(FIG. 114) shows a brush applicator (12) having a generally cylindrical inserting member (14) with a generally cylindrical terminating base (16) that has a socket member (80) formed therein. The socket member (80) is substantially long and deep so that it can hold a brush applicating member (20). A bristled applicating member (20) for this embodiment may be made from a bristles that are natural or synthetic. Furthermore, if necessary, a metal or plastic ferrule can employed to hold the bristles onto the inserting member (14).

(FIG. 115) shows an eye liner applicator (12) having an inserting member (14) with a generally cylindrical terminating base (16), and the base (16) has a socket member (80)

formed therein to hold an elongated and generally conical eye liner applicating member (20). An applicating member (20) for this embodiment may be made from foam, fiber, elastomeric material, resin or other suitable material.

(FIG. 116) shows a mascara brush applicator (12) having an inserting member (14) with a generally cylindrical terminating base (16) having a socket member (80) formed therein to hold a mascara brush. A mascara brush applicating member (20) for this embodiment may be a wire bound or optionally an elastomeric variety.

(FIG. 117) shows an eye shadow applicator (12) having an inserting member (14) with a terminating base (16) to hold a paddle shaped applicating member (20). An applicating member (20) for this embodiment may be made from any suitable foam material.

Figure 119B:
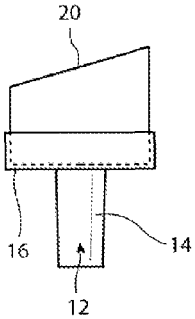

(FIG. 118A) shows an inserting member (14) embodiment having a generally cup shaped base (16) that is formed onto its non inserting end. The base (16) has circumferentially raised walls to form a suitably recessed socket member (80) within the base's (16) center area. Thus, as seen in (FIG. 118B), a socket member (80) can be used to hold an applicating member (20) within the base (16). Furthermore, (FIG. 119A), shows a cutaway side view that generally depicts a socket members (80) cupped profile, while (FIG. 119B), another side view, depicts a representative applicating member (20) that is inserted within the cupped profile. Note, this embodiment is merely representative and socket member (80) may be variably shaped, variably wide, and variably deep for holding different applicating members (20) types. Further note the applicating member in this embodiment may comprise a suitably stable cosmetic solid such as eye pencil or lipstick.

(FIG. 120) shows two views of an inserting member (14) embodiment that has substantially wedge shaped base (16), and the base (16) is desirably angled to hold an applicating member (20) thereon.

(FIG. 121) shows seven variously shaped applicators (12) that respectively have depict a triangular shaped inserting member (14) and base (16), a square shaped inserting member (14) and base (16), a rectilinear shaped inserting member (14) and base (16), a polygonal or multifaceted inserting member (14) and base (16), an elliptical shaped inserting member (14) and base (16), a tear drop shaped inserting member (14) and base (16) and an irregularly shaped inserting member (14) having a notch (82) formed along its length and a round base (16) on its non-inserting terminus. Note, the various inserting member (14) permutations may be suitably tapered or have fluted extrusions (18) formed thereon.

FIG. 122 shows a gripping body (2) having a handle (4) with a tapered shaft (6) emerging from its gripping side, and the tapered shaft (6) has a suitably deep aperture (10) terminally formed into its end. When seen in (FIG. 123), a close up view, the shaft (6) is widest at its juncture with the handle (4) and then tapers substantially to form a elongated and generally cylindrical end portion. This elongated cylindrical end portion, along with the terminally formed aperture (10), is dually functional wherein it can hold two different applicator (12) types. This is best seen in (FIG. 124) a sequence that depicts a prototypical applicator (12) (of the preferred embodiment) being frictionally inserted into a shaft's (6) aperture (10), and in (FIG. 125) a sequence that depicts an applicator (12) having a tubular body (76) inserting member (14) being frictionally slipped onto a shaft's (6) elongated cylindrical end. Note, the shaft's (6) elongated cylindrical end portion can incorporate various tapers, extrusions, rings, or other formations on the end portion to facilitate frictional retention with a tubular bodied (76) applicator (12).

(FIG. 126) shows a cosmetic applicator (12) having a mascara brush applicating member (20) attached into one end of a substantially elongated tubular body (76), and the tubular body's (76) other end has an opening or aperture (10) to frictionally insert onto a handle (4) having a suitably sized tapered shaft (6)

(FIG. 127) shows a cosmetic applicator (12) having a fiber tipped applicating member (20) attached into one end of a substantially elongated tubular body (76), and the tubular body's (76) other end has an opening or aperture (10) to frictionally insert onto a handle (4) having a suitably sized tapered shaft (6)

(FIG. 128) shows a cosmetic applicator (12) having a brush applicating member (20) attached into one end of a substantially elongated tubular body (76), and the tubular body's (76) other end has an opening or aperture (10) to frictionally insert onto a handle (4) having a suitably sized tapered shaft (6)

(FIG. 129) Shows a cosmetic applicator (12) embodiment having a mascara brush applicating member (20) that is attached to one end of substantially elongated inserting member (14) that is sized to frictionally insert into a tapered shaft (6) having a terminally formed aperture (10).

(FIG. 130) shows a cosmetic applicator (12) having a fiber tipped applicating member (20) that is attached to one end of substantially elongated inserting member (14) that is sized to frictionally insert into a tapered shaft (6) having a terminally formed aperture (10).

(FIG. 131) shows a cosmetic applicator (12) having a brush applicating member (20) that is attached to one end of substantially elongated inserting member (14) that is sized to frictionally insert into a tapered shaft (6) having a terminally formed aperture (10).

(FIG. 132) shows a gripping body (2) that has a handle (4) with a tapered shaft (6) emerging from its gripping side and the shaft (6) has a substantially large aperture (10) terminally formed into its end. The terminally formed aperture (10) in this embodiment is large enough to hold a conventional disposable applicator's (12) shaft like handle therein. Note, a disposable applicators shaft like handle can dually serve as a inserting member (14). This can be seen in (FIG. 133), a side view that shows a conventional applicator's (12) handle acting as an inserting member (14), wherein it is frictionally inserted into the shafts (6) apertured (10) end. Further note, conventional disposable applicators (12) commonly have shaft handles that are around 4 mm thick. The aperture (10) in this embodiment, therefore is preferably 4 mm in diameter.

(FIG. 134) Shows a generally a cylindrical shaft (6) that has been cut or trimmed to form a substantially faceted termination that has an aperture (10) formed into its end. Collectively, these faceted sides or trimmed surfaces (78) form a substantially squared end that is key-like, wherein it can insertably interlock with a corresponding applicator (12). This is best seen in (FIG. 139A and FIG. 139B), where the shaft's (6) squared end insertably interlocks with an applicator (12) having a correspondingly shaped socket member (80) formed around its inserting member (14) area. As seen in (FIG. 135), the shafts' (6) trimmed surfaces (78) create four terminally distinctive sides which are explicitly seen in (FIG. 136), a plan view that reveals the shaft's (6) squared end and centrally formed aperture (10). Note the size and number of trimmed surfaces (78) can vary. For example, a shafts (6) end may have one trimmed surface (78) to create a single facet or side or alternatively, a shaft (6) may have a plurality of trimmed surfaces (78) to create a multi faceted shaft that can resemble commonly available Allen or hex keys.

(FIG. 137) shows an applicator (12) that has a socket member (80) encircling its inserting member (14). The socket member (80) is generally cylindrical and has one or more circumferentially raised members or side walls that form a substantially cupped interior for holding a shafts (6) trimmed termination therein (when it is fully inserted on the applicator's inserting member). In this embodiment, the side wall's insides are straight and collectively form a generally square shaped socket interior. This can be clearly seen in (FIG. 138), an underside plan view that reveals the squared socket interior that is formed by the raised side walls. Note, this squared interior insertably corresponds with a shafts (6) terminally trimmed end so that when conjoined, they from an interlocking communication (FIG. 139A and FIG. 139B).

Further note, the socket member (80) depicted in this embodiment is representative and therefore not limiting. For example, an applicators (12) socket member (80) side walls may be solid, wherein they form uninterrupted periphery around an inserting member (14), or as embodied, the side walls may have a number spaces or gaps in-between, whereby forming distinctively separate raised wall portions. Furthermore, in contrast to the squared socket interior of this embodiment, a socket interior may triangular, pentagonal, hexagonal, octagonal or even star shaped.

(FIGS. 140A and 140B) show a ringlet (8) embodiment that has peripherally trimmed surfaces (78) that form distinctively faceted sides. Collectively, the trimmed surfaces (78) give the ringlet (8) a substantially square shaped appearance. As with the prior embodiment, the ringlet's (8) trimmed surface (78) sides are key-like, and can insertably interlock with a corresponding interface or socket member (80) that is formed onto an applicator's (12) underside base (16). (FIG. 141) for example, shows an applicator (12) that has a socket member (80) encircling the inserting member's (14) bottom area. The socket (80) is generally cylindrical and has one or more circumferentially raised members or side walls to form a substantially cupped interior for holding a ringlet (8) therein. Furthermore, these raised members or side walls correspond with a ringlet's (8) trimmed surface (78) sides. Therefore, when they are conjoined, the ringlets (8) trimmed surface (78) sides and the socket's (80) raised side walls form an interlocking communication. (not shown). Note, there is a distinctive opening or gap (70) that is formed into the sockets (80) side wall area that is large enough to accommodate a ringlet's (8) tapered shaft (6) juncture.

(FIG. 142) shows a generally cylindrical shaft (6) that has a substantially deep groove or notch (82) formed through its apertured (10) end. The notch (82) extends through the shafts (6) middle, whereby forming bilaterally raised sides (FIG. 143), and is generally as wide as its aperture (10). The notch (82) is suitably wide and deep so that it's bilaterally raised sides, can insertably communicate with a corresponding interface or socket member (80) that is formed onto or into an applicator (12). This is seen in (FIG. 144) and in (FIG. 145), wherein the embodied applicators (12) both have a socketed interfaces that surround their inserting member (14) area. This interface is suitably shaped to interlock with the shafts (6) notched (82) end, when they are fully conjoined. Note a notches (82) size and orientation is variable. Furthermore, more than one notch (82) may be embodied to form an end that has notches (82) in parallel, or notches (82) that cross one another.

(FIG. 144) shows a prototypical applicator (12) embodiment that has a socket member (82) formed around its inserting member's (14) bottom. The platform-like socket member (82) is generally cylindrical and has bilaterally depressed or indented portions that flank the inserting member (14) sides. These depressions are deep enough to insertably communicate with ringlet (8) or shaft (8) having corresponding raised portions (FIG. 142 and FIG. 146). In contrast, (FIG. 45) reveals an applicator (12) with a similar socket member (82) interface, but on a non-prototypical applicator (12) type. The applicator (12) in this embodiment is a brush, wherein its applicating member (20) is comprised from bristles (86) that are bound in a ferrule (84).

(FIG. 146) shows a ringlet (8) that has a substantially deep groove or notch (82) formed across its flat bottom side. The notch (82) extends through the ringlet's (8) middle, whereby forming bilaterally raised sides, and is generally as wide as its aperture (10). Note, a notch (82) is suitably wide and deep so that it's bilaterally raised sides can insertably communicate with an interface or socket member (80) that is formed onto or into a corresponding applicator (12). This is seen in (FIG. 144) and in FIG. 145), wherein the embodied applicators (12) both have a socketed interfaces that surround their inserting member (14) area. This interface is suitably shaped to interlock with the ringlets (8) notched (82) underside, when they are fully conjoined. Note a notches (82) size and orientation is variable. Furthermore, more than one notch (82) may be embodied to form an underside that has notches (82) in parallel, or notches (82) that cross one another.

(FIG. 147) shows a double sided gripping body (2) having ringlet (8) holders on both of its ends. Each ringlet (8) aperture (10) may be variably sized to accommodate different applicator (12) gauges, and each ringlet (8) may also have a predetermined holding angle. In this embodiment for example, one ringlet (8) is angled at 45 degrees while the other ringlet (8) is angled at 90 degrees.

(FIG. 148) Shows a double sided gripping body (2) having hybrid holders. One side of the gripping body's handle (4) has a tapered shaft with a terminally formed aperture (10), while the side has a suitably angled ringlet (8).

(FIG. 149) Shows a double sided gripping body (2) having apertured shafts (6) on both ends. Each aperture (10) may variably sized to hold different applicator (12) gauges.

(FIG. 150) shows a gripping body (2) having a tapered shaft (6) that is bent to desirably angle a terminally formed aperture (10). The shafts (6) bend occurs near its end, and in this particular embodiment, is angled at around fifty degrees. Note a shaft (6) may be bent at any angle deemed necessary for operation.

(FIG. 151) shows a griping body (2) that has a multi-apertured terminus. More specifically, the gripping body (2) has a handle (4) for grasping, an elongated shaft (6) emerging from one end, and a variably angled, hook shaped terminus that has an aperture (10) for each of its angled portions. Each aperture (10) therefore, has a holding angle that is pre-determined by terminus's various angled portions. In this embodiment, for example, the terminus has three angled portions and three apertures (10) for each of the portions. Moreover, near the shafts (6) origin (within proximity to its juncture to the handle), is a desirably deep socket member (80) that is axially aligned with one the terminus's apertures (10). This alignment, as indicated by a dotted line in (FIG. 151), is far enough apart to allow the aligned socket (80) and aperture (10) to stably hold a suitably long applicator (12) that is inserted there through (FIG. 152).

(FIG. 153) shows a gripping body (2) embodiment having a fork (88) holder (6) to conjoin with a cosmetic applicator (12) that has a bifurcated socket member (80). The fork (88) is terminally formed onto the end of a tapered shaft (6) that emerges from one of the handles (4) ends (FIG. 154). The tines (90) are sized and shaped to frictionally insert into the applicator's (12) bifurcated socket (80) (FIGS. 155A, 155B).

(FIG. 156) shows a tapered shaft (6) with threading (92) formed around its exterior and furthermore, a corresponding tubular bodied (76) applicator (12) that is internally threaded (92).

(FIG. 157), by contrast depicts a shaft (6) having an internally threaded (92) aperture (10) to screw together with a corresponding applicator (12) having a threaded inserting member (14)

(FIG. 158) shows a shaft (6) having an elongated cylindrical end portion that has secondary taper to slightly widen the cylindrical portion so that it can frictionally grasp tubular bodied (76) applicators (12) open end.

FIG. 159 shows a ringlet (9) having an aperture (10) that is threaded (92)

FIG. 160 shows an inserting member (14) having a snapping ring (94) formed around its circumference.

FIG. 161 shows an applicator (12) that has a bifurcated inserting member (96).

Advantages

From the description above, a number of advantages for the hygienic cosmetic applicator system are revealed:

(a) A standardized system allows for a plethora of applicator types to plug into a single, highly dexterous handle design.

(b) A dexterous handle design will increase an operator's efficiency and therefore improve cosmetic results.

(c) Handle's are reusable and are easy to disinfect using a wipe or solution.

(d) Single use applicators can range from improbably minute to exceptionally large and remain equally compatible with the system's easy to use format.

(e) Single use applicators can greatly lower pathogenic cross contamination when used in conjunction with fresh, uncontaminated cosmetic sources.

(f) Single use applicators are fabricated using a bare minimum of materials, which is cost effective and therefore economically advantageous.

(g) Single use applicators, when compared to standard disposables, use vastly less material per unit which is environmentally conscious.

(h) When used in cosmetic kits, supplied applicators can maintain cosmetic homogeneity by preventing the cross blending of shades, colors and cosmetic types.

CONCLUSIONS, RAMIFICATIONS, AND SCOPE

Accordingly, the reader will see that the hygienic cosmetic applicator system, and its vast applicator potential, can be used to achieve a higher standard of hygiene and cosmetic performance. When used on a per person basis, and with clean cosmetic sources, the hygienic applicator system can greatly aid in diminishing pathogenic cross contamination between users. The reader will also see that the hygienic cosmetic applicator of this invention will create value for cosmetic enterprises and their customers. Customers will appreciate the exclusivity of single use applicators, whereas cosmetologists will appreciate a wide variety of applicator types paired with the dexterous ergonomics of a medical-grade instrument.

This is especially pertinent with a double sided instrument that can afford vast applicator configurability and the efficiency of two rapidly accessible applicating ends. This stands in stark contrast to conventional disposable applicators that are static and that cannot be changed. Moreover, conventional disposables are invariably equipped with short and skimpy handles that are difficult to wield and with all of their excess material are bulky to store and create unnecessary environmental waste. The hygienic cosmetic applicator system, by contrast, creates minimal waste and can store a vast amount of applicators into a compact packaging format. Thus, the hygienic cosmetic applicator will simultaneously elevate the standard of cosmetic care, improve the quality of cosmetic application, and be cost effective. There are further advantages in that:

- Customers will have a new found assurance of cleanliness and hygiene when sampling cosmetics.
- Higher cosmetic care standards will increase cosmetic counter participation for customers who were uncomfortable with sharing cosmetics applicators.
- With retail versions, cosmetic users can casually purchase single use applicators for hygienic use at home Although the description above contains much specificity, it should not be construed as to limiting the scope of the embodiments, but as merely providing illustrations of some of the presently preferred embodiments. For example, a gripping body's handle may be bent, angled or curved. Furthermore, a gripping body may be disposable. Additionally, a gripping body's tapered shaft may have more than one ringlet and/or aperture, for simultaneously holding multiple applicators on its end. Also, a ringlet may have additional shapes. For example a ringlet and/or its aperture may be triangular shaped, square shaped, rectilinear shaped, oval shaped, star shaped, multifaceted, polygonal shaped, cross shaped, gear shaped, or be variably asymmetric. The above shapes are also applicable for tapered shaft ends that have apertures formed therein.

Note, although single use applicators are generally preferred, applicators can be made and indicated for repeated usage with cosmetic kits and at home. Further note, an applicator's inserting member portion may incorporate various alternatives for conjoining with a gripping body. For example, an inserting member may be threaded so that it can screw into a corresponding ringlet or shaft aperture. An inserting member may also have raised rings, snaps, channels, grooves, or pressure sensitive members formed therein or thereon to attachably communicate with a ringlet and/or shaft that has corresponding features.

Moreover, a base (and its corresponding applicating member) may be oval, square, rectilinear, triangular, tear drop shaped, polygonal, variably asymmetric or variably contoured. A base (and its corresponding applicating member) may also be wedge shaped, chisel shaped, paddle shaped, cupped, pointed, or beveled. A base's topside may incorporate any number of indentations, channels, grooves, extrusions or holes to provide a gripping advantage for an applicating member. By contrast, a bases bottom side may include various extrusions, channels holes or grooves that may or may not be radially formed to stably interlock with corresponding a ringlet or shaft. An applicator's inserting member and/or base portion may also be made from an elastomeric material that is not wholly rigid, wherein it is adaptively pliant. Lastly, if needed, the base area may be eliminated altogether.

An applicator's applicating member may be made from any material that is suitable for cosmetic application. Some alternative material examples may include natural fibers, synthetic fibers, felt, flocked felt, flocked foam, cloth, rubber, paper, silicone, resin, Teflon, metal, ceramic, or any suitable base material that can be flocked. An applicating member may also be made from any material that is not generally used for cosmetic application such as graphite, artist's pigments or erasers. Note, an applicating member's shape may or may not correspond with its underlying base. More specifically, an applicating member may have portions that under hang and are indented within a base's shape and/or overhang wherein they extend beyond the base's periphery. Note, applicating members that are brushes they may have natural and/or synthetic bristles. If necessary, a bristled applicating member's may be bound with or inserted into a traditional ferrule. Lastly any feature or attribute that has been described, disclosed and/or depicted within this specification may be combined and configured in any manner deemed suitable and with any frequency.

Regarding packaging, the hygienic cosmetic applicator system may be integrated together with any number of cosmetic types. For example, a gripping body and at least one or more cosmetic applicators may be integrated into package that contains at least one or more cosmetic types. Thus, the hygienic applicator system may be integrated into packages having a single cosmetic type or into a packages having a plurality of cosmetic types. Cosmetics types may be of a unidose variety that is enough for a single application and are individually blister packaged. Cosmetics types may also be an amount of cosmetic material that is enough for multiple applications and are deposited into wells within a hinged case or other container. Lastly any feature or attribute that has been described, disclosed and/or depicted within this specification may be combined and configured in any manner deemed suitable and with any frequency.

Thus, the scope of the invention should be determined by the appended claims and their legal equivalents, rather than by the examples given.

I claim:

1. A kit for a hygienic cosmetic applicator system with various cosmetics comprising:

(a) a cylindrical gripping body having a proximal end and a tapered distal end, a cylindrical shaft portion attaches to said proximal end, wherein said shaft portion including a widest end connects to said proximal end and a tapered end, a donut shaped ringlet with a centrally formed aperture is terminally formed onto or into said shaft tapered end, said ringlet being substantially perpendicular to a longitudinal axis of said gripping body, and (b) a plurality of disposable cosmetic applicator tips each having a saucer shaped base member and a convex foam application member, the saucer shaped base member having opposed top and bottom sides, wherein the bottom side has a flat center, an inserting rod portion centrally extending from said flat center wherein said inserting rod portion includes vertically elongated bumps which are periodically formed around a circumferential surface of said inserting rod portion, said convex foam application member attaches to the top side of the base member, wherein said application member having preloaded cosmetic material; said base member being removably coupled to the donut shaped ringlet by vertically aligning and engaging said inserting rod portion with said ringlet aperture such that the ringlet being flushed against said flat center of the base member, and said plurality of disposable applicator tips being individually sealed into blister modules which are separately attached by a series of perforations, each blister including a cover and a tab, and (c) a card backing member supporting said blister modules and the gripping body.

2. The hygienic cosmetic applicator system of claim 1 whose gripping body is straight or curved.

3. The hygienic cosmetic applicator system of claim 1 whose gripping body is fabricated from metal, plastic or a combination thereof.

4. The hygienic cosmetic applicator system of claim 1 whose applicator tips are open cell foam or closed cell foam.

5. The hygienic cosmetic applicator system of claim 1 whose formed base is convex for bonding with said application member and has a bottom side that is flat or concave with a flat center area.

6. The hygienic cosmetic applicator system of claim 1 whose application member is preloaded or impregnated with a cosmetic material during manufacture.

7. The hygienic cosmetic applicator system of claim 1 whose gripping body is single sided.

8. The hygienic cosmetic applicator system of claim 1 whose at least one or more cosmetic types is a plurality of cosmetic types.

9. The hygienic cosmetic applicator system of claim 1 including a case.

* * * * *